US008192241B2

(12) United States Patent
Tanaka et al.

(10) Patent No.: US 8,192,241 B2
(45) Date of Patent: Jun. 5, 2012

(54) FUEL SUPPLY SYSTEM FOR OUTBOARD MOTOR AND OUTBOARD MOTOR

(75) Inventors: Seiichi Tanaka, Shizuoka (JP); Takuma Itou, Shizuoka (JP)

(73) Assignee: Yamaha Hatsudoki Kabushiki Kaisha, Shizuoka (JP)

( * ) Notice: Subject to any disclaimer, the term of this patent is extended or adjusted under 35 U.S.C. 154(b) by 297 days.

(21) Appl. No.: 12/559,578

(22) Filed: Sep. 15, 2009

(65) Prior Publication Data

US 2010/0068954 A1 Mar. 18, 2010

(30) Foreign Application Priority Data

Sep. 18, 2008 (JP) ..... 2008-238885
Sep. 25, 2008 (JP) ..... 2008-246809

(51) Int. Cl.
*F02B 61/04* (2006.01)

(52) U.S. Cl. ..... 440/88 F

(58) Field of Classification Search ..... 440/88 F, 440/88 R, 77; 403/349
See application file for complete search history.

(56) References Cited

U.S. PATENT DOCUMENTS 2,833,158 A * 5/1958 Damon ..... 74/504
3,475,001 A * 10/1969 Hieber ..... 251/149.8
3,499,243 A * 3/1970 Artin ..... 43/56
3,500,859 A * 3/1970 Pearson ..... 137/614.05
4,305,180 A * 12/1981 Schwartz ..... 439/296
4,449,945 A * 5/1984 Ferguson ..... 440/53
4,722,708 A * 2/1988 Baltz ..... 440/88 R
4,842,439 A * 6/1989 Caldwell et al. ..... 403/290
4,898,211 A * 2/1990 Fournier et al. ..... 137/615
4,969,847 A * 11/1990 Curtis et al. ..... 440/77
5,076,320 A * 12/1991 Robinson ..... 137/454.2
5,372,464 A * 12/1994 Bureller ..... 408/72 B
6,244,917 B1 * 6/2001 Hartke et al. ..... 440/88 R
7,275,521 B2 * 10/2007 Usui et al. ..... 123/468
7,296,781 B2 * 11/2007 Akabane ..... 251/129.21
7,780,150 B2 * 8/2010 Yamazaki ..... 261/36.2
7,927,161 B2 * 4/2011 Schaefer, Jr. ..... 440/88 F
2002/0185110 A1 * 12/2002 Wada et al. ..... 123/445
2005/0284447 A1 * 12/2005 Usui et al. ..... 123/468

FOREIGN PATENT DOCUMENTS

EP 0 887 527 A2 12/1998
JP 2004-211818 A 7/2004

* cited by examiner

*Primary Examiner* — Stephen Avila
(74) *Attorney, Agent, or Firm* — Keating & Bennett, LLP

(57) ABSTRACT

A fuel supply system includes a fuel supply channel and a joint unit. The joint unit includes first and second joint members and a sealing member. The first and second joint members are arranged to be connectable to and separable from each other. The sealing member is arranged to seal a gap between the first and second joint members in a state in which the first and second joint members are connected. The first joint member includes a first flow channel, a first valve, and a first fitting portion. The second joint member includes a second flow channel, a second valve, and a second fitting portion. The first valve has a first pressing end and a first valve body. The second valve has a second pressing end and a second valve body. The first and second fitting portions are arranged to fit each other.

15 Claims, 33 Drawing Sheets

FUEL SUPPLY SYSTEM FOR OUTBOARD MOTOR AND OUTBOARD MOTOR

BACKGROUND OF THE INVENTION

1. Field of the Invention

The present invention relates to a fuel supply system for an outboard motor including a joint unit arranged to connect a fuel tank and an outboard motor main body. Further, the present invention relates to an outboard motor with the fuel supply system.

2. Description of the Related Art

A joint unit according to a prior art is described in Japanese Unexamined Patent Application Publication No. 2004-211818. The joint unit includes a coupler arranged to allow a fluid to flow therein, and an injection port arranged to be connectable to the coupler.

A nozzle arranged to make a fluid flow into the inside of the coupler is attached to the coupler. A check valve is provided inside the injection port. The check valve is arranged to open when a push button provided on the coupler is depressed after the coupler and the injection port are connected.

The coupler is provided with a guide arranged to allow the injection port to be inserted therein. The guide is held by a spring member which urges the guide in a direction in which the injection port is inserted. The joint unit is arranged to be connectable to the injection port by inserting the injection port in the guide of the coupler and pushing-in the injection port into the inner side of the guide against an urging force of the spring member.

SUMMARY OF THE INVENTION

The inventors of preferred embodiments of the invention described and claimed in the present application conducted an extensive study and research regarding the design and development of a fuel supply system for an outboard motor and an outboard motor, and in doing so, discovered and first recognized new unique challenges and problems as described in greater detail below.

In detail, in the joint unit of the above-described prior art, an operator connects the coupler and the injection port, and then must open the check valve of the injection port by depressing the push button of the coupler. Therefore, the operation to be performed by a user when connecting the joint unit becomes troublesome. Even when the joint unit is used as a joint unit for connecting the fuel tank and the outboard motor main body, as described above, the operation by a user for connecting the joint unit is troublesome.

In the joint unit according to the aforementioned conventional art, when the injection port is connected to the coupler, a user is required to insert the injection port into the guide of the coupler and to push in the injection port into the inner side of the guide against an urging force of the spring member. Therefore, the operation for connecting the joint unit is troublesome. Even when the joint unit is used as a joint unit for connecting the fuel tank and the outboard motor main body, as described above, the operation for connecting the joint unit is troublesome.

In order to over come the previously unrecognized and unsolved problems described above, a preferred embodiment of the present invention provides a fuel supply system for an outboard motor, arranged to supply fuel into the outboard motor main body from a fuel tank. The fuel supply system includes a fuel supply channel and a joint unit. The joint unit includes first and second joint members and a sealing member. The first and second joint members are arranged to be connectable to and separable from each other. The sealing member is arranged to seal a gap between the first and second joint members in a state in which the first and second joint members are connected. The first joint member includes a first flow channel arranged for a fuel to flow therethrough, a first valve arranged in the first flow channel, and a tubular first fitting portion arranged to surround the first flow channel. Also, the second joint member includes a second flow channel arranged for a fuel to flow therethrough, a second valve arranged in the second flow channel, and a tubular second fitting portion arranged to surround the second flow channel. The first valve has a first pressing end which is arranged to be pressed by the second joint member when the first and second joint members are connected in a predetermined coupling direction. The first valve further includes a first valve body arranged to be displaced when the first pressing end is pressed. Also, the second valve has a second pressing end which is arranged to be pressed by the first joint member when the first and second joint members are connected in the coupling direction. Further, the second valve includes a second valve body arranged to be displaced when the second pressing end is pressed. The first and second fitting portions are arranged to fit each other before the first and second pressing ends come into contact with the second and first joint members, respectively, when the first and second joint members are connected. The sealing member is held on the first or second joint member so as to seal a gap between the first and second fitting portions before the first and second pressing ends come into contact with the second and first joint members, respectively, when the first and second joint members are connected.

With this arrangement, when the first joint member and the second joint member are connected in the coupling direction, the first and second pressing ends are pressed by the second and first joint members, respectively. Accordingly, the first valve body is displaced and the first valve opens. Similarly, the second valve body is displaced and the first valve opens. In other words, simply by connecting the first joint member and the second joint member, the first and second valves are automatically opened. Therefore, when the first joint member and the second joint member are connected, a user is not required to perform a separate operation for opening the first and second valves. Accordingly, the user's operation when connecting a joint unit can be prevented from becoming troublesome.

Also, the sealing member may be held on the second fitting portion. In this case, a first distance in the coupling direction from the first pressing end to a tip end of the first fitting portion is preferably greater than a second distance in the coupling direction from the second pressing end to the sealing member. The first distance is defined as positive when the tip end of the first fitting portion is positioned closer to the second joint member than the first pressing end. The second distance is defined as negative when the sealing member is positioned closer to the first joint member than the second pressing end.

Also, the sealing member may be held on the first fitting portion. In this case, a third distance in the coupling direction from the first pressing end to the sealing member is preferably greater than a fourth distance in the coupling direction from the second pressing end to a tip end of the second fitting portion. The third distance is defined as positive when the sealing member is positioned closer to the second joint member than the first pressing end. The fourth distance is defined as negative when the tip end of the second fitting portion is positioned closer to the first joint member than the second pressing end.

Also, the first fitting portion may be formed of a single member so as to have a tubular shape, or may be formed of a plurality of members so as to have a tubular shape as a whole. Similarly, the second fitting portion may be formed of a single member so as to have a tubular shape, or may be formed of a plurality of members so as to have a tubular shape as a whole. In detail, for example, the first fitting portion may include a tubular inner fitting portion arranged to surround the first flow channel, and a tubular outer fitting portion arranged to surround a periphery of the inner fitting portion. Respective first ends of the inner fitting portion and the outer fitting portion may be arranged to allow the second fitting portion to be fitted therebetween from the second joint member side. The respective second ends of the inner fitting portion and the outer fitting portion may be arranged to be hermetically sealed to each other. The sealing member may include a first seal arranged to seal a gap between the inner fitting portion and the second fitting portion. The sealing member may include a second seal arranged to seal a gap between the outer fitting portion and the second fitting portion. Further, the sealing member may include both of the first and second seals.

Also, the joint unit may further include a tubular cover member which is attached to the second joint member and arranged to surround a periphery of the second joint member. The sealing member may be held on an outer peripheral portion of the second joint member inside the cover member.

Also, in a preferred embodiment of the present invention, the joint unit may further include a tubular connecting member, a convex portion, and a concave portion. The connecting member may be arranged to surround a periphery of the first joint member in a state in which the first and second joint members are connected. The convex portion may be provided on one of an outer peripheral portion of the first joint member and an inner peripheral portion of the connecting member. The concave portion may be provided on the other of the outer peripheral portion of the first joint member and the inner peripheral portion of the connecting member. The convex portion and the concave portion may be arranged to be engageable with each other. Further, the convex portion and the concave portion may be arranged to be rotatable relative to each other while engaging with each other. The concave portion may be arranged to guide the convex portion to a predetermined connecting position along the concave portion along with relative rotations of the convex portion and the concave portion in one of the rotation directions. The second joint member and the connecting member may be arranged to move integrally to the first joint member side when the convex portion is guided toward the connecting position. The first and second joint members may be arranged to be connected to each other when the convex portion is arranged at the connecting position.

Also, the concave portion may be arranged such that the convex portion is arranged at the connecting position according to relative rotations by an angle less than one rotation of the convex portion and the concave portion.

Also, the concave portion may include a guide surface arranged to extend so as to incline with respect to the coupling direction.

Also, the joint unit may further include a movement restricting portion. The movement restricting portion may be provided on one of the outer peripheral portion of the first joint member and the inner peripheral portion of the connecting member together with the concave portion. Further, the movement restricting portion may be arranged such that the convex portion restricts movement from the connecting portion.

Also, the concave portion may include a guide groove arranged to extend so as to incline with respect to the coupling direction.

Also, the second joint member may further include an annular groove provided on the outer peripheral portion of the second joint member. The annular groove may be arranged to surround the outer peripheral portion of the second joint member. Also, the connecting member may include a tubular portion arranged to surround the second joint member and an engagement protruding portion arranged to protrude inward from the tubular portion. Also, the annular groove may include a pair of inner wall surfaces opposed to each other via a space in the coupling direction. The engagement protruding portion may be arranged between the pair of inner wall surfaces. The connecting member may be arranged to move to the first joint member side when the convex portion is guided toward the connecting position by the concave portion.

Also, one of the first and second joint members may be joined to the fuel tank or the outboard motor main body. In this case, the other of the first and second joint members may be joined to the fuel supply channel.

Also, an outboard motor of a preferred embodiment of the present invention includes a fuel tank, an outboard motor main body, and a fuel supply system. The fuel supply system is arranged to supply a fuel to the outboard motor main body from the fuel tank. The fuel supply system includes a fuel supply channel and a joint unit arranged to join the fuel supply channel to the fuel tank or the outboard motor main body. The joint unit includes first and second joint members and a sealing member. The first and second joint members are arranged to be connectable to and separable from each other. The sealing member is arranged to seal a gap between the first and second joint member in a state in which the first and second joint members are connected to each other. The first joint member includes a first flow channel arranged for a fuel to flow therethough, a first valve arranged in the first flow channel, and a tubular first fitting portion arranged to surround the first flow channel. Also, the second joint member includes a second flow channel arranged for a fuel to flow therethough, a second valve arranged in the second flow channel, and a tubular second fitting portion arranged to surround the second flow channel. The first valve has a first pressing end to be pressed by the second joint member when the first and second joint members are connected in a predetermined coupling direction. The first valve further includes a first valve body arranged to be displaced when the first pressing end is pressed. Also, the second valve has a second pressing end to be pressed by the first joint member when the first and second joint members are connected in the coupling direction. The second valve further includes a second valve body arranged to be displaced when the second pressing end is pressed. The first and second fitting portions are arranged to fit each other before the first and second pressing ends come into contact with the second and first joint members, respectively, when the first and second joint members are connected. The sealing member is held on the first or second joint member so as to seal a gap between the first and second fitting portions before the first and second pressing ends come into contact with the second and first joint members, respectively, when the first and second joint members are connected.

Other elements, features, steps, characteristics, and advantages of the present invention will become more apparent from the following detailed description of the preferred embodiments with reference to the attached drawings.

DETAILED DESCRIPTION OF THE PREFERRED EMBODIMENTS

First Preferred Embodiment

Figure 1:
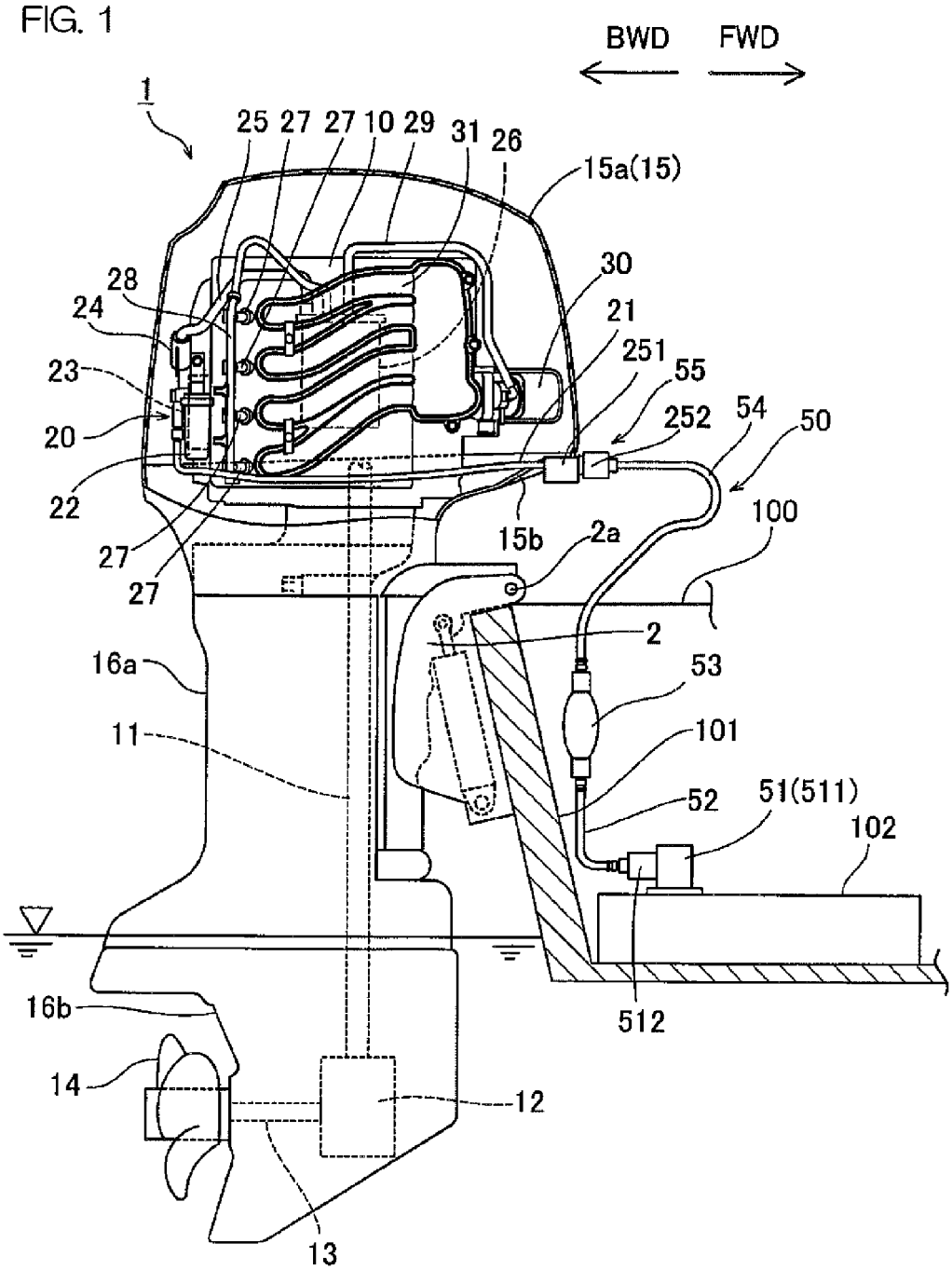
FIG. 1 is a side view showing an arrangement of an outboard motor and a fuel supply system for the same according to a first preferred embodiment of the present invention.

FIG. 1 is a side view showing an arrangement of an outboard motor and a fuel supply system for the same of a first preferred embodiment of the present invention. FIG. 2 to FIG. 9B are views for describing an arrangement of the outboard motor and the fuel supply system for the same shown in FIG. 1. Hereinafter, structures of the outboard motor 1 and a fuel supply system for the same of the first preferred embodiment of the present invention will be described with reference to FIG. 1 to FIG. 9B.

As shown in FIG. 1, the outboard motor 1 is attached to a transom board 101 provided on the backward (the arrow BWD direction) side of a hull 100 via a clamp bracket 2. The outboard motor 1 is an example of an outboard motor main body according to a preferred embodiment of the present invention. The clamp bracket 2 is arranged to support the outboard motor 1 swingably vertically around a tilt shaft 2*a* with respect to the hull 100. A fuel tank 102 arranged to store a fuel (for example, gasoline) is provided in the hull 100. The fuel tank 102 is connected to the outboard motor 1 by an external fuel pathway 50. The fuel tank 102 is an example of a fuel tank according to a preferred embodiment of the present invention.

The outboard motor 1 includes an engine 10, a drive shaft 11, a forward-reverse switching mechanism 12, a propeller shaft 13, and a propeller 14. The drive shaft 11 is rotated by a driving force of the engine 10. The drive shaft 11 is arranged to extend vertically. The forward-reverse switching mechanism 12 is connected to a lower end of the drive shaft 11. The forward-reverse switching mechanism 12 is further connected to the propeller shaft 13. The propeller shaft 13 is arranged to extend horizontally. The propeller 14 is attached to a rear end portion of the propeller shaft 13.

Also, the engine 10 is accommodated inside the engine cover 15. The engine cover 15 includes an upper cover 15*a* and a lower cover 15*b*. The drive shaft 11, the forward-reverse switching mechanism 12, and the propeller shaft 13 are accommodated in the upper case 16*a* and the lowercase 16*b*. The upper case 16*a* and the lowercase 16*b* are arranged below the engine cover 15.

Inside the engine cover 15, in addition, an internal fuel pathway 20 arranged to guide the fuel inside the fuel tank 102 to the engine 10 is accommodated. The internal fuel pathway 20 includes a hose 21, a water separating filter 22, a low-pressure pump 23, a filter 24, and a hose 25. One side of the hose 21 is attached to a main body side joint 251. The other side of the hose 21 is connected to the water separating filter 22. The low-pressure pump 23 is connected to the water separating filter 22. The filter 24 is arranged to filtrate the fuel led-out from the low-pressure pump 23. One side of the hose 25 is connected to the filter 24.

Also, the internal fuel pathway 20 further includes a vapor separator tank 26 and a delivery pipe 28. To the vapor separator tank 26, the other side of the hose 25 is connected. Also, the delivery pipe 28 is connected to the vapor separator tank 26. To the delivery pipe 28, preferably four, injectors 27 are connected. Each injector 27 is arranged to inject the fuel in the vapor separator tank 26 inside the engine 10. In the present preferred embodiment, a fuel supply system according to a preferred embodiment of the present invention includes the internal fuel pathway 20 and an external fuel pathway 50.

The water separating filter 22 is arranged to remove water mixed in the fuel. The low-pressure pump 23 is arranged to suction the fuel in the fuel tank 102. Further, the low-pressure pump 23 is arranged to feed the fuel into the vapor separator tank 26. In addition, the vapor separator tank 26 is arranged to store the fuel suctioned by the low-pressure pump 23. Further, the vapor separator tank 26 is arranged to feed the fuel stored inside the vapor separator tank 26 into the delivery pipe 28 by a high-pressure pump (not shown) provided inside the vapor separator tank 26. The delivery pipe 28 is arranged to distribute the fuel to the injectors 27. Further, the delivery pipe 28 is arranged to inject the fuel into a combustion chamber (not shown) of an engine 10 by each injector 27.

Also, to the vapor separator tank 26, one side of the hose 29 is connected. The other side of the hose 29 is connected to an air intake port 30. The hose 29 is arranged to lead-out vapor (steam) of the fuel generated inside the vapor separator tank 26. In addition, from the air intake port 30, air to be sent into the engine 10 is taken in. The air intake port 30 is connected to an intake manifold 31. Air taken in through the air intake port 30 and vapor of the fuel led out from the vapor separator tank 26 are made to flow into the combustion chamber of the engine 10 via the intake manifold 31. Accordingly, vapor of the fuel generated in the vapor separator tank 26 can be burned inside the engine 10.

Also, the external fuel pathway 50 includes a joint unit 51, a hose 52, a primer pump 53, a hose 54, and a joint unit 55. The hose 52, the primer pump 53, and the internal space of the hose 54 are an example of a fuel supply channel according to a preferred embodiment of the present invention. Also, the joint unit 55 is an example of a joint unit according to a preferred embodiment of the present invention. The joint unit 51 is attached to the fuel tank 102. The joint unit 51 is connected to the primer pump 53 by the hose 52. One side and the other side of the hose 52 are connected to the joint unit 51 and the primer pump 53, respectively. Also, the primer pump 53 is connected to the joint unit 55 by the hose 54. One side and the other side of the hose 54 are connected to the primer pump 53 and the joint unit 55, respectively.

The joint unit 51 includes a tank side joint 511 attached to the fuel tank 102 and a hose side joint 512 which can be attached to and removed from the tank side joint 511. Also, the primer pump 53 is arranged to feed the fuel into the low-pressure pump 23 as appropriate. For example, in the case in which the fuel has not reached the low-pressure pump 23, the primer pump 53 is operated by a user and the fuel is fed into the low-pressure pump 23 from the primer pump 53.

Figure 2:
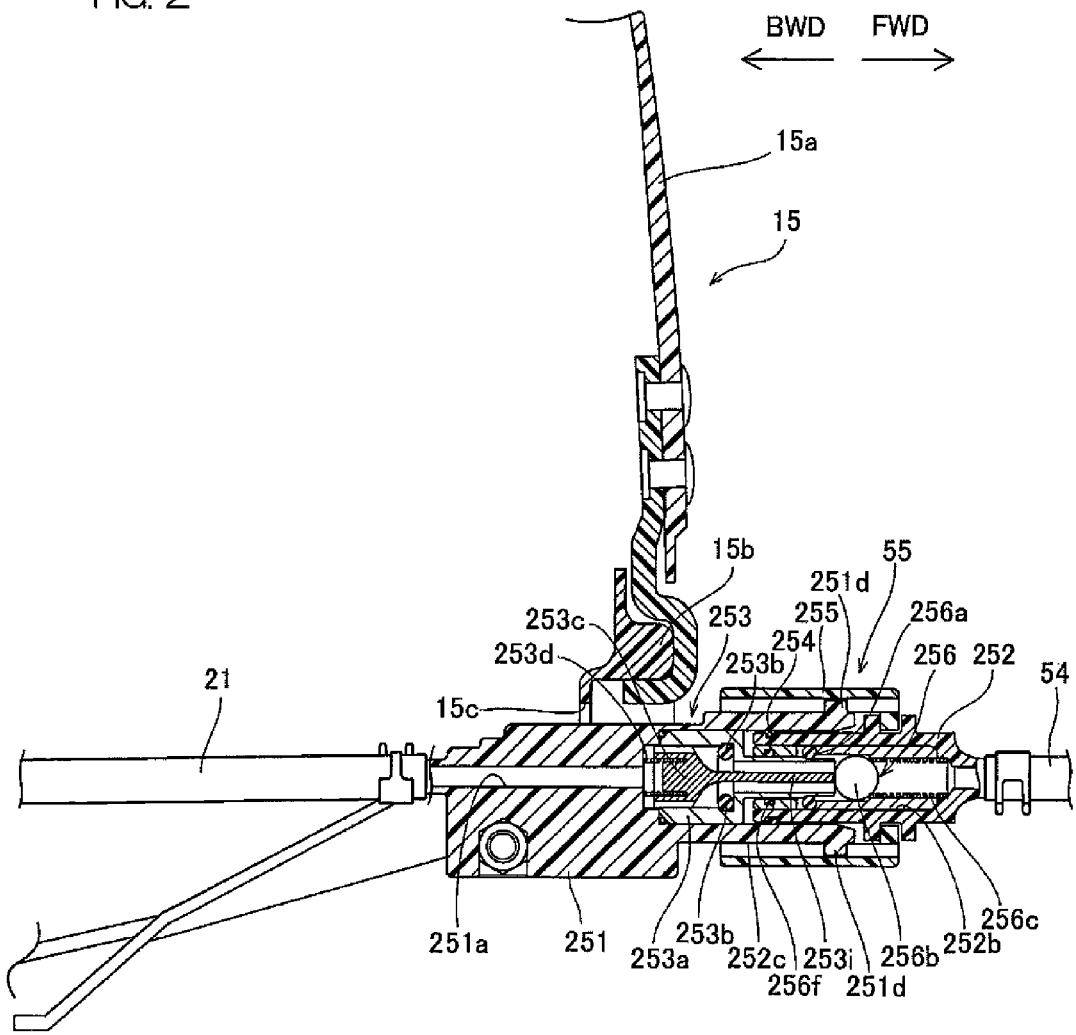
FIG. 2 is a sectional view showing a joint unit of the fuel supply system for an outboard motor of the first preferred embodiment of the present invention.

Further, as shown in FIG. 2, the joint unit 55 includes a main body side joint 251 attached to the engine cover 15 and a hose side joint 252 arranged to be connectable to the main body side joint 251. The main body side joint 251 is an example of a first joint member according to a preferred embodiment of the present invention, and the hose side joint 252 is an example of a second joint member according to a preferred embodiment of the present invention. The main body side joint 251 and the hose side joint 252 are connected in the front-rear direction (in the arrow FWD direction and the arrow BWD direction). That is, in the present preferred embodiment, the front-rear direction corresponds to a coupling direction according to a preferred embodiment of the present invention.

The main body side joint 251 is arranged at an opening 15*c* provided on a front portion (portion on the arrow FWD direction side) of the lower cover 15*b*. The portion on the hose side joint 252 side (arrow FWD direction side) of the main body side joint 251 projects forward (arrow FWD direction) from the opening 15*c*. The main body side joint 251 is preferably screwed or fixed to the lower cover 15*b*.

Figure 3:
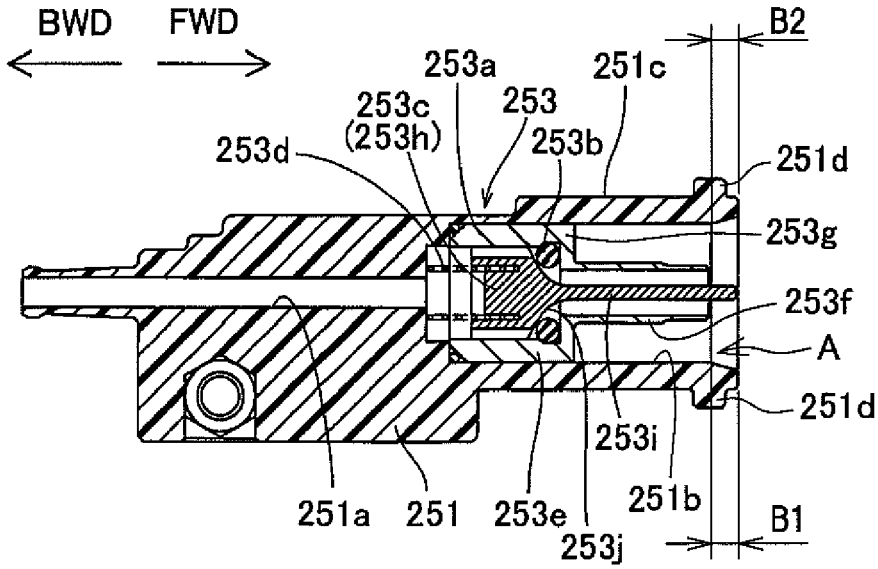
FIG. 3 is a sectional view for describing a structure of a main body side joint of the fuel supply system for an outboard motor of the first preferred embodiment of the present invention.

Also, as shown in FIG. 3, the main body side joint 251 is made of, for example, a resin. Inside the main body side joint 251, a passage portion 251*a* arranged to extend in the front-rear direction in which the fuel can flow is provided. The passage portion 251*a* is an example of a first flow channel according to a preferred embodiment of the present invention. The arrow BWD direction side of the passage portion 251*a* is connected to the hose 21 (see FIG. 2). In addition, on the arrow FWD direction side of the passage portion 251*a*, an opening 251*b* with a diameter larger than that of the passage portion 251*a* is provided. The opening 251*b* is an example of a first fitting portion and an outer fitting portion according to a preferred embodiment of the present invention. The opening 251*b* is arranged to extend in the front-rear direction similar to the passage portion 251*a*. In the opening 251*b*, a portion on the side (arrow FWD direction side) to be connected to the hose side joint 252 is the tip end portion (front end portion) of the opening 251*b*. The vicinity A of the tip end portion of the opening 251*b* is arranged to increase (expand) in diameter of the opening 251*b* as it goes to the tip end portion.

Also, on the outer peripheral portion 251*c* of the opening 251*b* of the main body side joint 251, a pair of upper and lower convex portions 251*d* are provided. The pair of convex portions 251*d* are an example of a convex portion according to a preferred embodiment of the present invention. The pair of convex portions 251*d* are provided in the vicinity of the end portion on the arrow FWD direction side of the outer peripheral portion 251*c*. The pair of convex portions 251*d* protrude outward from the outer peripheral portion 251*c*, respectively. The pair of convex portions 251*d* preferably have columnar shapes, respectively.

Also, in the opening 251*b* of the main body side joint 251, a valve unit 253 is provided. The valve unit 253 is an example of a first valve according to a preferred embodiment of the present invention. The valve unit 253 is arranged to come into contact with a valve unit 256 described later when the main body side joint 251 and the hose side joint 252 are connected to each other. Further, the valve unit 253 and the valve unit 256 press each other when the main body side joint 251 and the hose side joint 252 are connected. The valve unit 253 and the valve unit 256 are arranged to open when they press each other. The valve unit 253 includes a case member 253*a* fixed to the opening 251*b*, an O-ring 253*b* accommodated inside the case member 253*a*, a valve member 253*c* capable of opening and closing, and a spring member 253*d* which urges the valve member 253*c* to the O-ring 253*b* side (arrow FWD direction side).

The case member 253*a* includes a large-diameter portion 253*e*, a small-diameter portion 253*f*, and a connecting portion 253*g*. The large-diameter portion 253*e* is fitted in contact with the inner peripheral surface of the opening 251*b*. The outer peripheral surface of the large diameter portion 253*e* and the inner peripheral surface of the opening 251*b* are hermetically sealed to each other. In addition, the diameter of the small-diameter portion 253*f* is smaller than that of the large-diameter portion 253*e*. The large-diameter portion 253*e* and the small-diameter portion 253*f* are connected by the connecting portion 253*g*. The O-ring 253*b* is arranged in the vicinity of the coupling portion between the connecting portion 253*g* and the large-diameter portion 253*e*. Specifically, the O-ring 253*b* is held by the case member 253*a* so as not to move in the circumferential direction and the arrow FWD direction. As described later, on the hose side joint 252, an opening side sleeve 256*d* is provided. The case member 253*a* is arranged such that the outer peripheral surface of the small-diameter portion 253*f* is opposed to the inner peripheral surface of the opening side sleeve 256*d*. Further, the case member 253*a* is arranged to allow the fuel to flow inside the case member 253*a*. The case member 253*a* is an example of a first fitting portion and an inner fitting portion according to a preferred embodiment of the present invention.

Also, the valve member 253*c* includes a main body portion 253*h*, a projecting portion 253*i*, and a connecting portion 253*j*. The main body portion 253*h* is accommodated inside the large-diameter portion 253*e* of the case member 253*a*. The projecting portion 253*i* extends forward (the arrow FWD direction) from the main body portion 253*h*. The main body portion 253*h* and the projecting portion 253*i* are connected by the connecting portion 253*j*. The connecting portion 253*j* is arranged to define a curved surface which gradually decreases in diameter as it goes to the projecting portion 253*i*. When the connecting portion 253*j* is brought into contact with the inner peripheral surface of the O-ring 253*b*, the valve member 253*c* and the O-ring 253*b* are closed to each other. Accordingly, the flow of the fuel inside the valve unit 253 is stopped.

The projecting portion 253*i* is arranged to project to the arrow FWD direction side more than the small-diameter portion 253*f* of the case member 253*a* in a state in which the connecting portion 253*j* is in contact with the inner peripheral surface of the O-ring 253*b*. The projecting portion 253*i* is arranged to come into contact with a spherical member 256*b* provided inside the hose side joint 252 when the main body side joint 251 and the hose side joint 252*a* reconnected. Further, the projecting portion 253*i* is arranged to press the spherical member 256*b* when the main body side joint 251 and the hose side joint 252 are connected. The projecting portion 253*i* is arranged so as not to project outward more than the end portion (end portion on the arrow FWD direction side) of the hose side joint 252 side of the main body side joint 251 regardless of whether or not the connecting portion 253*j* is in contact with the inner peripheral surface of the O-ring 253*b*.

Also, on a rear portion (portion on the arrow BWD direction side) of the main body portion 253*h* of the valve member 253*c*, the spring member 253*d* is arranged. The spring member 253*d* may be a coil spring, for example. The portion on the arrow BWD direction side of the spring member 253*d* is held on the end portion on the arrow BWD direction side of the opening 251*b*.

Figure 4:
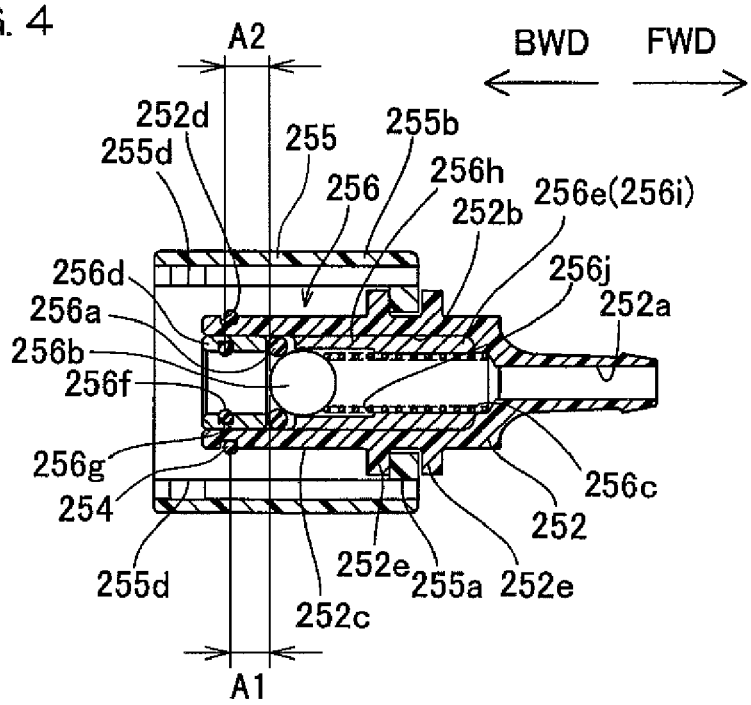
FIG. 4 is a sectional view for describing a structure of a hose side joint of the fuel supply system for an outboard motor of the first preferred embodiment of the present invention.

On the other hand, as shown in FIG. 2 and FIG. 4, the hose side joint 252 is connected to the hose 54 (see FIG. 2) of the external fuel pathway 50. Also, the hose side joint 252 is made of, for example, a resin as shown in FIG. 4. Inside the hose side joint 252, a passage portion 252*a* connected to the hose 54 (see FIG. 2) and arranged to extend in the front-rear direction is provided. The passage portion 252*a* is an example of a second flow channel according to a preferred embodiment of the present invention. On the arrow BWD direction side of the passage portion 252*a*, an opening 252*b* with a diameter larger than that of the passage portion 252*a* is provided. The opening 252*b* is arranged to extend in the front-rear direction similar to the passage portion 252*a*.

Also, the diameter of the outer peripheral surface 252*c* corresponding to the opening 252*b* of the hose side joint 252 is slightly smaller than the diameter of the opening 251*b* (inner peripheral surface) of the main body side joint 251. In other words, the outer peripheral surface 252*c* of the hose side joint 252 is arranged to be inserted (engaged) in the opening 251*b* of the main body side joint 251.

Also, on the outer peripheral surface 252*c* of the hose side joint 252, an annular groove portion 252*d* arranged to extend in the circumferential direction of the outer peripheral surface 252*c* is provided. In the groove portion 252*d*, an O-ring 254 is fitted. The O-ring 254 is arranged to seal the portion (engaged portion) between the inner peripheral surface of the opening 251*b* of the main body side joint 251 and the outer peripheral surface 252*c* of the hose side joint 252. The O-ring 254 is an example of a sealing member and a second seal according to a preferred embodiment of the present invention.

The groove portion 252*d* is provided in the vicinity of the tip end portion on the main body side joint 251 side (arrow BWD direction side) of the outer peripheral surface 252*c*. Therefore, the O-ring 254 is arranged in the vicinity of the tip end portion on the main body side joint 251 side (arrow BWD direction side) of the outer peripheral surface 252*c* of the hose side joint 252.

Figure 6:
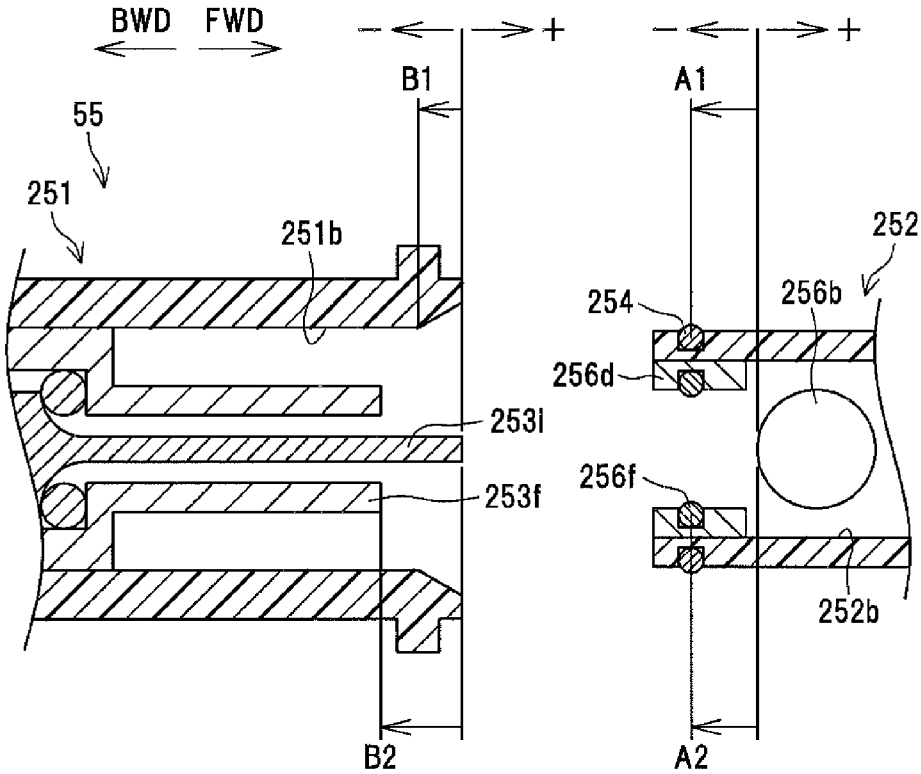
FIG. 6 is a schematic view of a portion of the joint unit of the fuel supply system for an outboard motor of the first preferred embodiment of the present invention.

In detail, as shown in FIG. 6, a first distance B1 is a distance in the front-rear direction from a tip end portion of the projecting portion 253*i* to a tip end portion of the inner peripheral surface of the opening 251*b*. The first distance B1 is defined as positive when the tip end portion of the inner peripheral surface of the opening 251*b* is positioned closer to the hose side joint 252 than the tip end portion of the projecting portion 253*i*. Further, a second distance A1 is a distance in the front-rear direction from a tip end of the spherical member 256*b* to the O-ring 254. The second distance A1 is defined as negative when the O-ring 254 is positioned closer to the main body side joint 251 than the tip end of the spherical member 256*b*. The joint unit 55 is arranged such that the first distance B1 becomes greater than the second distance A1 ($A1<0$, $B1<0$, and $B1>A1$). In addition, the tip end portion of the inner peripheral surface of the opening 251*b* is a tip end portion of the cylindrical surface, and does not include a tapered portion. The valve member 253*c* is an example of a first valve body according to a preferred embodiment of the present invention, and the tip end portion of the projecting portion 253*i* is an example of a first pressing end according to a preferred embodiment of the present invention. Also, the spherical member 256*b* is an example of a second valve body according to a preferred embodiment of the present invention, and the tip end of the spherical member 256*b* is an example of a second pressing end according to a preferred embodiment of the present invention.

Also, on the outer peripheral surface 252*c* of the hose side joint 252, a pair of flange portions 252*e* are provided. The pair of flange portions 252*e* have disk shapes, respectively. The pair of flange portions 252*e* are arranged on the arrow FWD direction side of the groove portion 252*d*. The pair of flange portions 252*e* are opposed to each other via a predetermined space in the front-rear direction. Between the pair of flange portions 252*e*, an annular groove arranged to extend in the circumferential direction of the outer peripheral surface 252*c* is provided. The annular groove is an example of an annular groove according to a preferred embodiment of the present invention. Also, the two surfaces opposed to each other of the pair of flange portions 252*e* are an example of a pair of inner wall surfaces according to a preferred embodiment of the present invention.

Between the pair of flange portions 252*e*, a protruding portion 255*a* of the joint cover 255 is fitted. The joint cover 255 is an example of a cover member and a connecting member according to a preferred embodiment of the present invention. The joint cover 255 is made of, for example, a resin. The joint cover 255 includes a protruding portion 255*a* and a cylindrical cover portion 255*b*. The protruding portion 255*a* is an example of an engagement protruding portion according to a preferred embodiment of the present invention. Also, the cover portion 255*b* is an example of a tubular portion according to a preferred embodiment of the present invention. The cover portion 255*b* is arranged to cover the O-ring 254 via a predetermined space. In other words, the joint cover 255 covers the O-ring 254 to prevent the O-ring 254 from being exposed.

Figure 5:
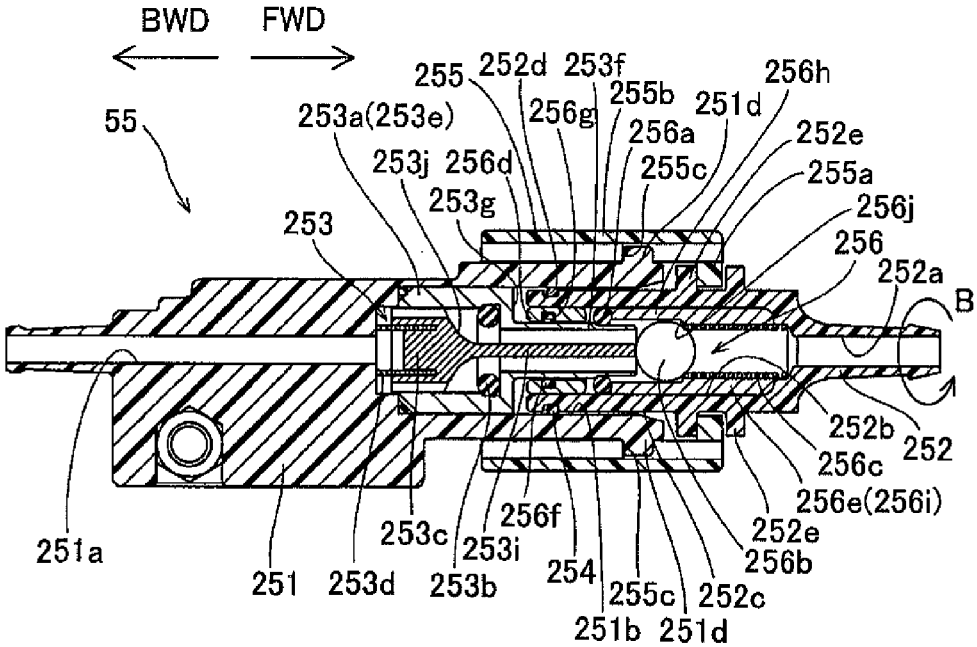
FIG. 5 is a sectional view for describing the structure of the joint unit of the fuel supply system for an outboard motor of the first preferred embodiment of the present invention.

Also, as shown in FIG. 5, the joint cover 255 is arranged to be engageable with the pair of convex portions 251*d* of the main body side joint 251. In detail, as shown in FIG. 5 to FIG. 8, on the inner peripheral surface of the cover portion 255*b* of the joint cover 255, a pair of guide surfaces 255*c* are provided. As shown in FIG. 7 to FIG. 9B, each guide surface 255*c* extends in the circumferential direction of the cover portion 255*b* along the inner peripheral surface of the cover portion 255*b*. Further, each guide surface 255*c* inclines with respect to the front-rear direction. Each guide surface 255*c* is arranged to define a curved surface which opens in the arrow FWD direction. Each guide surface 255*c* is arranged to guide the convex portion 251*d* to an accommodating portion 255*f* (connecting positions) along the guide surfaces 255*c*. The pair of guide surfaces 255*c* are examples of a concave portion and a guide surface according to a preferred embodiment of the present invention. Also, the accommodating portion 255*f* is an example of a movement restricting portion according to a preferred embodiment of the present invention.

Figure 7:
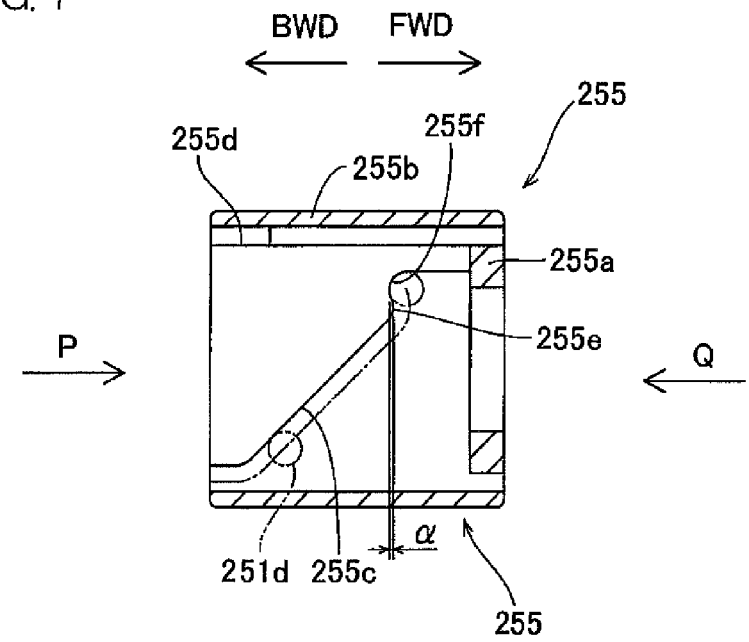
FIG. 7 is a sectional view for describing a structure of a joint cover of the fuel supply system for an outboard motor of the first preferred embodiment of the present invention.
Figure 8:
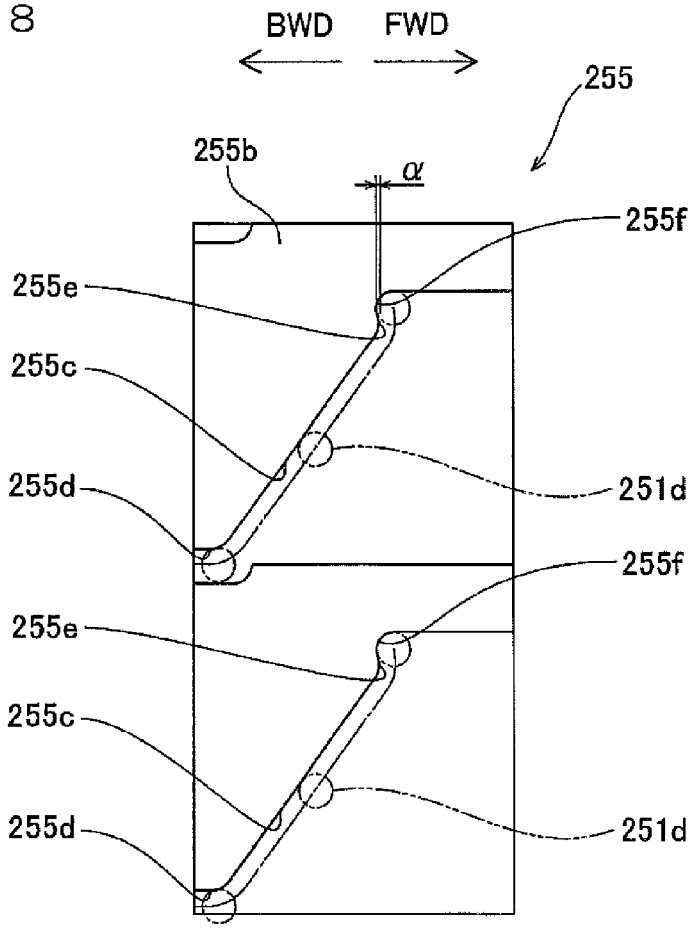
FIG. 8 is a development view for describing a structure of an inner peripheral surface of the joint cover of the fuel supply system for an outboard motor of the first preferred embodiment of the present invention.
Figure 9A:
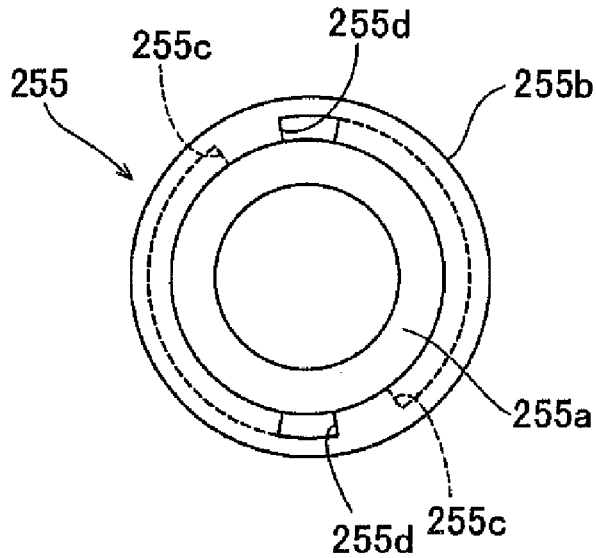
FIG. 9A is a view from the arrow P direction of FIG. 7.
Figure 9B:
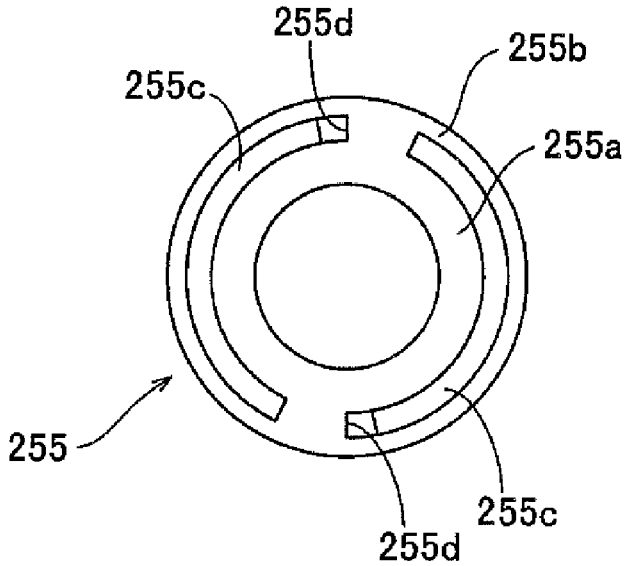
FIG. 9B is a view from the arrow Q direction of FIG. 7.

By arranging the joint cover 255 as described above, the pair of convex portions 251*d* of the main body side joint 251 can be inserted from openings 255*d* on the arrow BWD direction side of the cove portion 255*b* of the joint cover 255. Further, the pair of convex portions 251*d* of the main body side joint 251 can be engaged with the pair of guide surfaces 255*c*, respectively. Then, in this state, by rotating the joint cover 255 counterclockwise (direction B of FIG. 5) by about 170 degrees, for example, as viewed from the arrow FWD direction side, each convex portion 251*d* can be moved along the corresponding guide surface 255*c* while being brought into contact with the guide surfaces 255*c*. Accordingly, as shown in FIG. 5, the joint cover 255 is moved in a direction of approaching the main body side joint 251. Therefore, the hose side joint 252 can be moved to the main body side joint 251 side against reaction forces of the spring member 253*d* of the valve unit 253 and the spring member 256*c* of the valve unit 256 described later. Also, as shown in FIG. 7 and FIG. 8, each convex portion 251*d* moves over a mountain portion 255*e* of the corresponding guide surface 255*c*, and is then accommodated in the corresponding accommodating portion 255*f* by reaction forces of the spring members 253*d* and 256*c* (see FIG. 5). The distance α (see FIG. 7 and FIG. 8) in the front-rear direction between the mountain portion 255*e* of the guide surface 255*c* and the accommodating portion 255*f* is, for example, approximately 0.5 millimeters.

Also, as shown in FIG. 4, in the opening 252*b* of the hose side joint 252, a valve unit 256 is provided. The valve unit 256 includes an O-ring 256*a*, a spherical member 256*b*, and a spring member 256*c*. The O-ring 256*a* is arranged along the inner peripheral surface of the opening 252*b* of the hose side joint 252. The O-ring 256*a* extends in the circumferential direction of the opening 252*b*. The spherical member 256*b* is arranged to be capable of coming into linear contact with the O-ring 256*a* across the entire circumference of the O-ring 256*a*. Also, the spherical member 256*b* is urged toward the O-ring 256*a* by the spring member 256*c*. The valve unit 256 is an example of a second valve according to a preferred embodiment of the present invention.

As shown in FIG. 4, the O-ring 256*a* is held between an opening side sleeve 256*d* and a hose side sleeve 256*e*. The opening side sleeve 256*d* has a cylindrical shape. The opening side sleeve 256*d* is fitted to an end portion on the arrow BWD direction side of the opening 252*b*. The opening side sleeve 256*d* and the opening 252*b* form a tubular shape as a whole. As shown in FIG. 5, the opening side sleeve 256*d* is arranged to allow the small-diameter portion 253*f* of the case member 253*a* to be inserted therein. In the present preferred embodiment, a second fitting portion according to a preferred embodiment of the present invention is defined by the opening side sleeve 256*d* and the opening 252*b*.

Also, as shown in FIG. 4, on the inner peripheral surface of the opening side sleeve 256*d*, the O-ring 256*f* is arranged. The O-ring 256*f* is an example of a sealing member and a first seal according to a preferred embodiment of the present invention. On the inner peripheral surface in the vicinity of the tip end side on the valve unit 253 side of the opening side sleeve 256*d*, a groove portion 256*g* is provided. The O-ring 256*f* is arranged within the groove portion 256*g*. The O-ring 256*f* is arranged to seal a gap between the outer peripheral surface of the small-diameter portion 253*f* and the inner peripheral surface of the opening side sleeve 256*d*. Also, the O-ring 256*f* is arranged in the vicinity of the tip end side of the valve unit 256.

In detail, as shown in FIG. 6, a first distance B2 is a distance in the front-rear direction from the tip end portion of the projecting portion 253*i* to a tip end portion of the small-diameter portion 253*f*. The first distance B2 is defined as positive when the tip end portion of the small-diameter portion 253*f* is positioned closer to the hose side joint 252 than the tip end portion of the projecting portion 253*i*. Further, a second distance A2 is a distance in the front-rear direction from the tip end of the spherical member 256*b* to the O-ring 256*f*. The second distance A2 is defined as negative when the O-ring 256*f* is positioned closer to the main body side joint 251 than the tip end of the spherical member 256*b*. The joint unit 55 is arranged such that the first distance B2 becomes greater than the second distance A2 (A2<0, B2<0, and B2>A2).

Also, as shown in FIG. 4, the hose side sleeve 256*e* has a cylindrical shape. The hose side sleeve 256*e* is fitted in the opening 252*b*. The hose side sleeve 256*e* is arranged on the arrow FWD direction side of the opening side sleeve 256*d*. A space is provided between the opening side sleeve 256*d* and the hose side sleeve 256*e*. Also, the hose side sleeve 256*e* has a large-diameter portion 256*h* and a small-diameter portion 256*i*. The large-diameter portion 256*h* is arranged on the arrow BWD direction side of the small-diameter portion 256*i*. The outer diameter of the large-diameter portion 256*h* and the outer diameter of the small-diameter portion 256*i* are substantially equal to each other. Also, the inner diameter of the large-diameter portion 256*h* is larger than the inner diameter of the small-diameter portion 256*i*. Between the inner peripheral surface of the large-diameter portion 256*h* and the inner peripheral surface of the small-diameter portion 256*i*, a step portion 256*j* is provided.

The spherical member 256*b* is arranged inside the large-diameter portion 256*h* of the hose side sleeve 256*e*. The spherical member 256*b* is arranged movably between the O-ring 256*a* and the step portion 256*j*. By linear contact of the spherical member 256*b* with the O-ring 256*a* across the entire circumference of the O-ring 256, the spherical member 256*b* and the O-ring 256*a* are closed to each other. Accordingly, the flow of the fuel inside the hose side joint 252 is stopped.

Also, the spring member 256*c* may be a coil spring, for example. One side of the spring member 256*c* is supported on an end portion on the arrow FWD direction side of the opening 252*b* of the hose side joint 252. Also, the other side of the spring member 256*c* is arranged to urge a portion on the arrow FWD direction side of the spherical member 256*b*. Accordingly, the spherical member 256*b* is pressed toward the O-ring 256*b* by the spring member 256*c*.

As shown in FIG. 5, when the main body side joint 251 and the hose side joint 252 are connected to each other, the spherical member 256*b* is pressed in the arrow FWD direction by the projecting portion 253*i* of the valve unit 253 of the main body side joint 251. Accordingly, the spherical member 256*b* and the O-ring 256*a* separate from each other and the valve unit 256 opens. Then, when the spherical member 256*b* comes into contact with the step portion 256*j*, the projecting portion 253 is pressed in the arrow BWD direction by the spherical member 256*b*. Therefore, the valve member 253*c* of the valve unit 253 moves in the arrow BWD direction. Accordingly, the O-ring 253*b* and the valve member 253*c* of the valve unit 253 separate from each other and the valve unit 253 opens.

FIG. 10 to FIG. 17 are views for describing operations of valve units when the main body side joint and the hose side joint are connected with the fuel supply system for an outboard motor of the first preferred embodiment. First, with reference to FIG. 7, FIG. 8, and FIG. 10 to FIG. 17, operations of the valve units 253 and 256 when the main body side joint 251 and the hose side joint 252 are connected with the fuel supply system of the outboard motor 1 of the first preferred embodiment of the present invention will be described.

Figure 10:
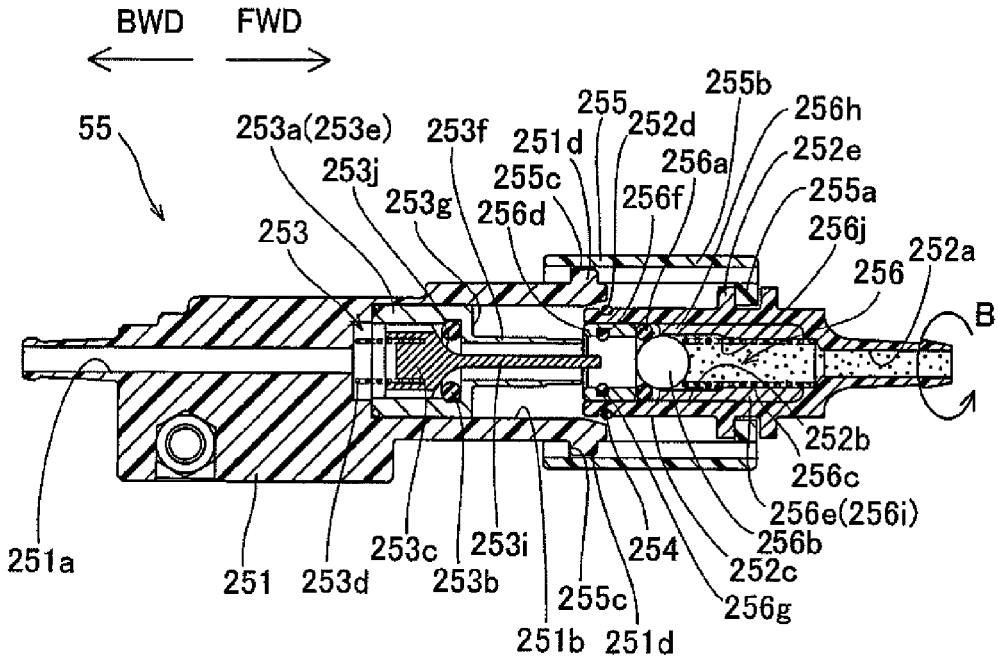
FIG. 10 is a view for describing operations of valve units when the main body side joint and the hose side joint are connected with the fuel supply system for an outboard motor of the first preferred embodiment of the present invention.

First, as shown in FIG. 10, a portion on the arrow BWD direction side of the opening 252*b* of the hose side joint 252 is engaged with the opening 251*b* of the main body side joint 251. Further, the openings 255*d* of the joint cover 255 are engaged with the convex portions 251*d* of the main body side joint 251. As described above, the vicinity A of the tip end portion (front end portion) of the opening 251*b* of the main body side joint 251 is arranged to increase (expand) in diameter of the opening 251*b* as it goes to the front end portion. Therefore, the O-ring 254 hardly comes into contact with the corner of the opening 251*b*.

Thereafter, in a state in which the convex portions 251*d* of the main body side joint 251 are engaged with the openings 255*d* of the joint cover 255, the joint cover 255 is rotated in the direction B. Accordingly, the convex portions 251*d* of the main body side joint 251 are moved along the guide surfaces 255*c* of the joint cover 255. Then, along with the movements of the convex portions 251*d*, the main body side joint 251 and the hose side joint 252 are moved relative to each other in the connecting directions.

Figure 11:
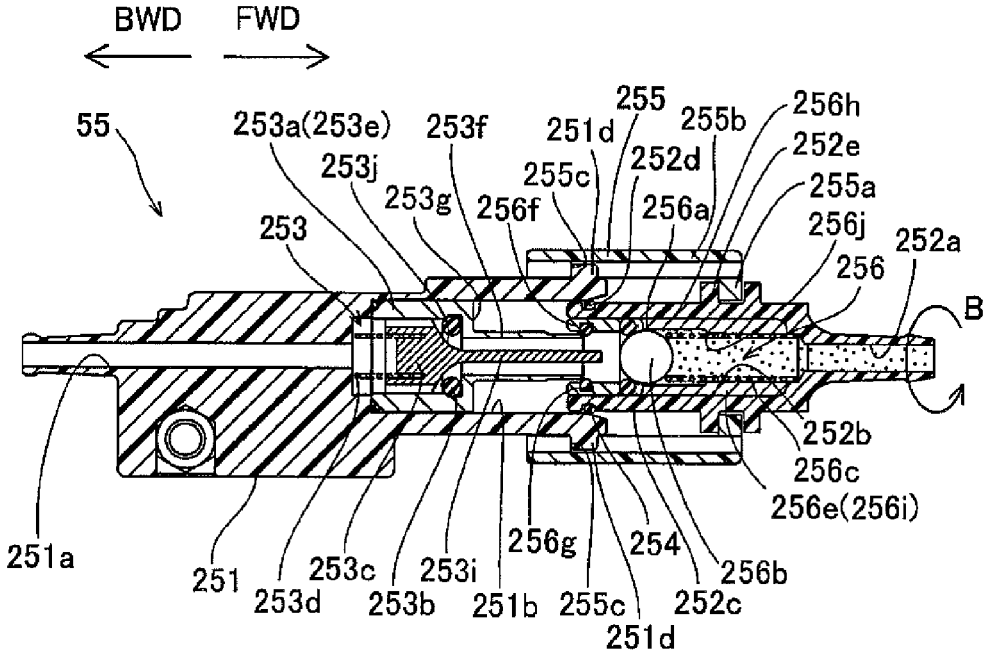
FIG. 11 is a view for describing operations of the valve units when the main body side joint and the hose side joint are connected with the fuel supply system for an outboard motor of the first preferred embodiment of the present invention.

Then, as shown in FIG. 11, when the joint cover 255 is further rotated in the direction B, the opening 251*b* (inner peripheral surface) of the main body side joint 251 comes into contact with the O-ring 254 arranged in the groove portion 252*d* of the hose side joint 252. Further, the outer peripheral surface of the small-diameter portion 253*f* of the case member 253*a* comes into contact with the O-ring 256*f* arranged in the groove portion 256*g*. Accordingly, a gap between the opening 251*b* of the main body side joint 251 and the outer peripheral surface 252*c* of the hose side joint 252 is sealed. Further, a gap between the outer peripheral surface of the small-diameter portion 253*f* of the case member 253*a* and the inner peripheral surface of the opening side sleeve 256*d* is sealed.

Figure 12:
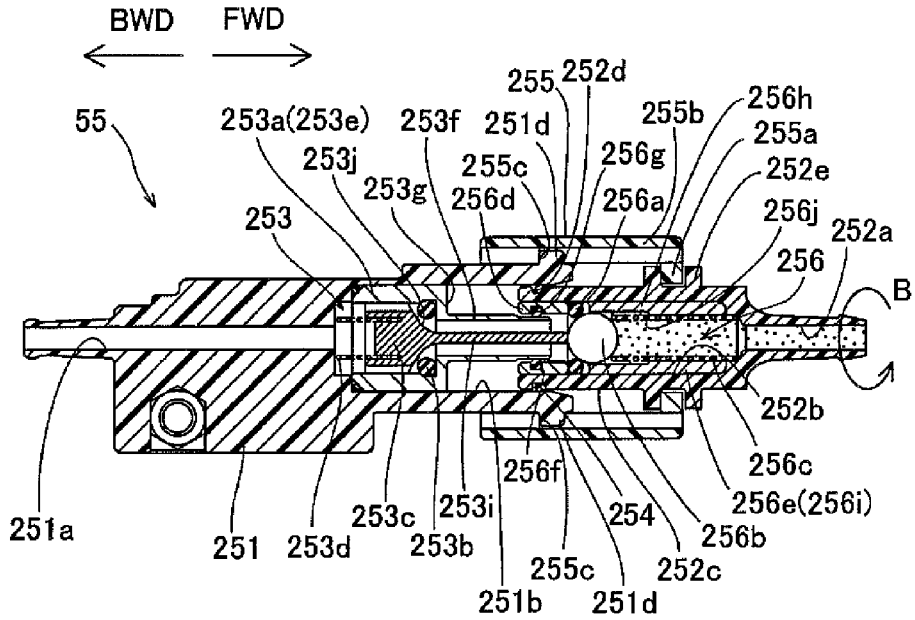
FIG. 12 is a view for describing operations of the valve units when the main body side joint and the hose side joint are connected with the fuel supply system for an outboard motor of the first preferred embodiment of the present invention.
Figure 13:
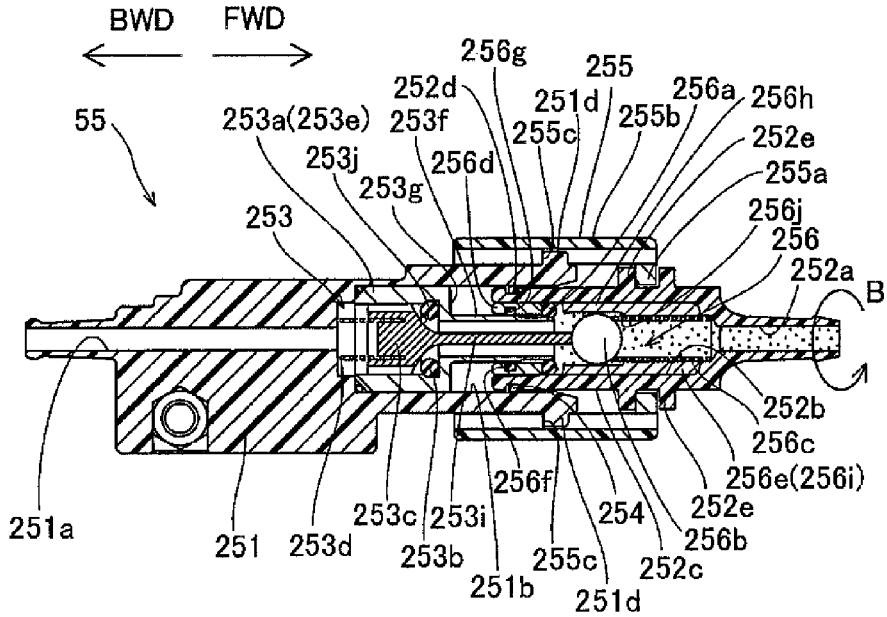
FIG. 13 is a view for describing operations of the valve units when the main body side joint and the hose side joint are connected with the fuel supply system for an outboard motor of the first preferred embodiment of the present invention.

Then, as shown in FIG. 12 and FIG. 13, when the joint cover 255 is further rotated in the direction B, the tip end portion of the projecting portion 253*i* of the valve unit 253 and the spherical member 256*b* of the valve unit 256 come into contact with each other. Further, the spherical member 256*b* is pressed to the arrow FWD direction side by the tip end portion of the projecting portion 253*i*. Accordingly, the spherical member 256*b* moves in the arrow FWD direction side against the urging force of the spring member 256*c*. Therefore, a gap is generated between the spherical member 256*b* and the O-ring 256*a*. As a result, the valve unit 256 is opened. Therefore, the fuel from the hose 54 side flows into the opening 251*b* of the main body side joint 251. At this time, a gap between the opening 251*b* of the main body side joint 251 and the outer peripheral surface 252*c* of the hose side joint 252 is sealed by the O-ring 254. Therefore, the fuel which has flowed in the opening 251*b* does not substantially flow out to the outside.

Figure 14:
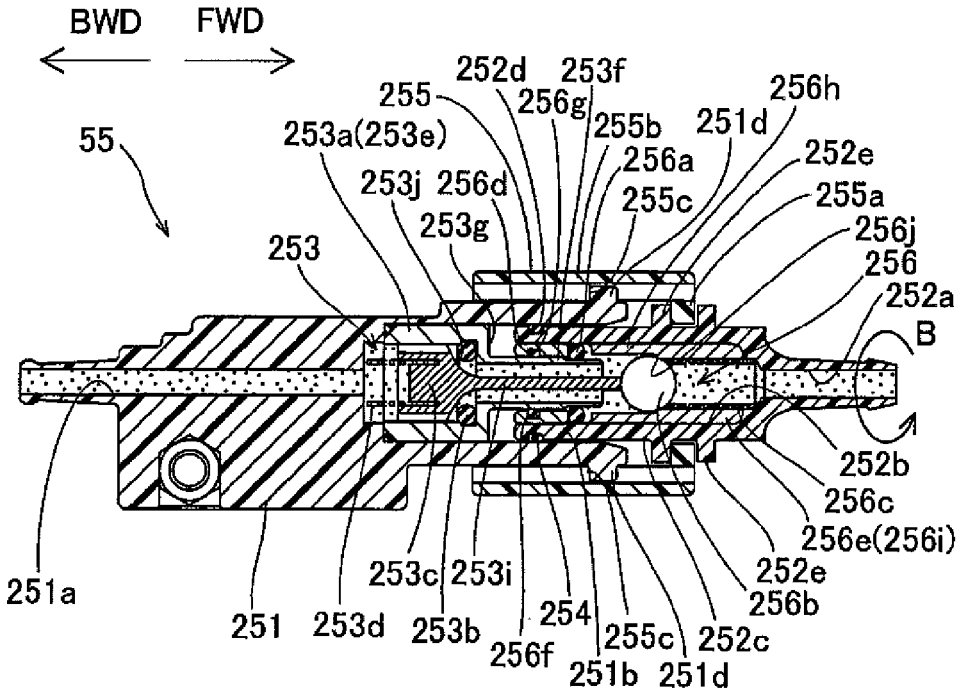
FIG. 14 is a view for describing operations of the valve units when the main body side joint and the hose side joint are connected with the fuel supply system for an outboard motor of the first preferred embodiment of the present invention.
Figure 15:
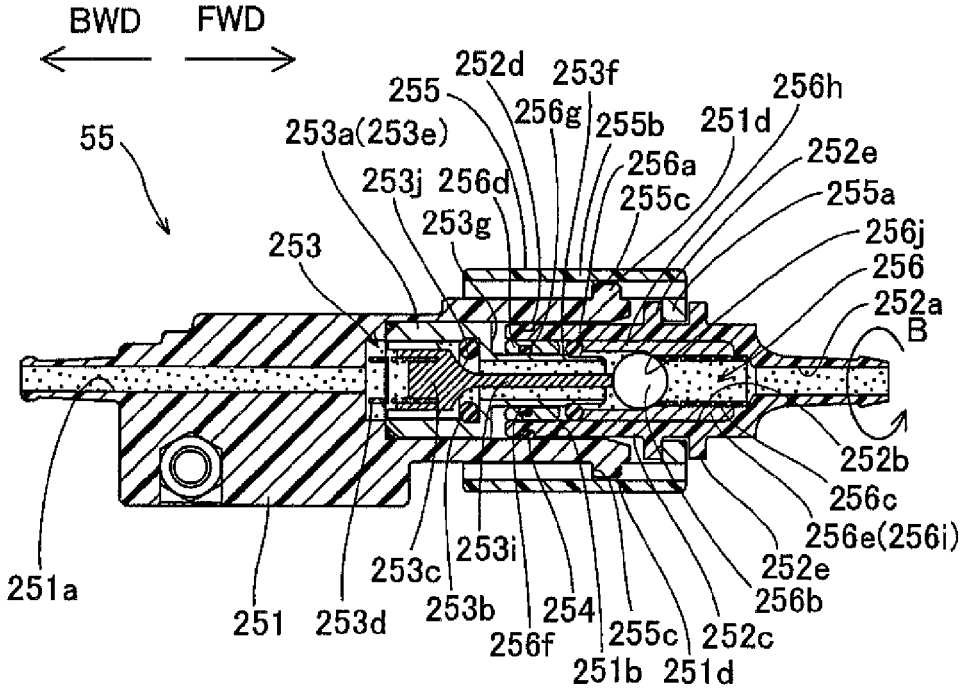
FIG. 15 is a view for describing operations of the valve units when the main body side joint and the hose side joint are connected with the fuel supply system for an outboard motor of the first preferred embodiment of the present invention.

Thereafter, as shown in FIG. 14 and FIG. 15, when the joint cover 255 is further rotated in the direction B, the spherical member 256*b* comes into contact with the step portion 256*j* of the hose side sleeve 256*e*. As a result, the valve member 253*c* moves in the arrow BWD direction against the urging force of the spring member 253*d*. Accordingly, a gap is generated between the O-ring 253*b* and the connecting portion 253*j* of the valve member 253*c*. As a result, the fuel from the hose 54 side and the fuel which flew in the opening 251*b* flow into the passage portion 251*a*.

Figure 16:
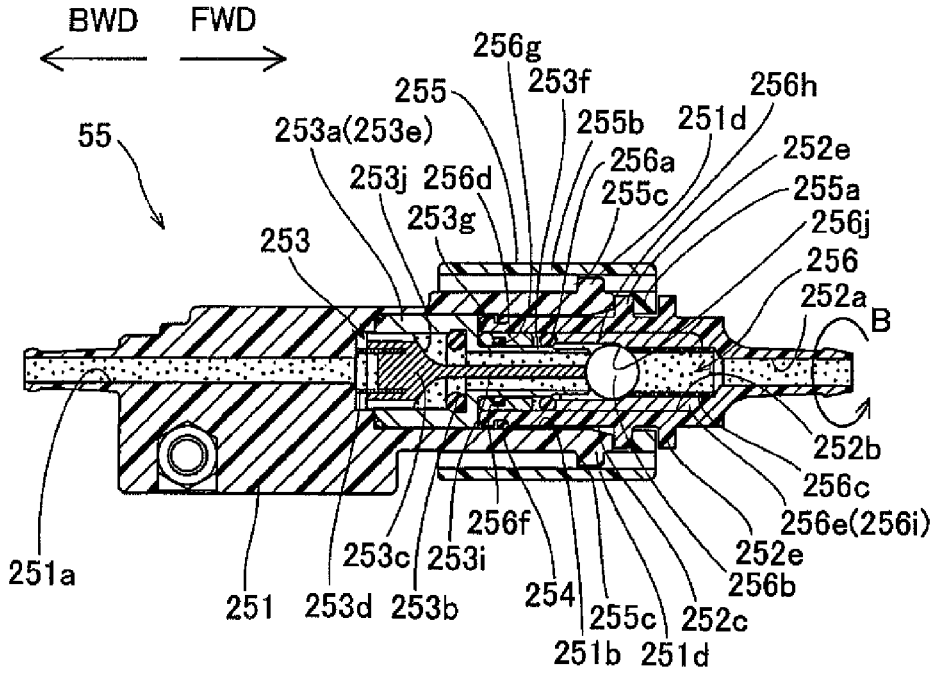
FIG. 16 is a view for describing operations of the valve units when the main body side joint and the hose side joint are connected with the fuel supply system for an outboard motor of the first preferred embodiment of the present invention.
Figure 17:
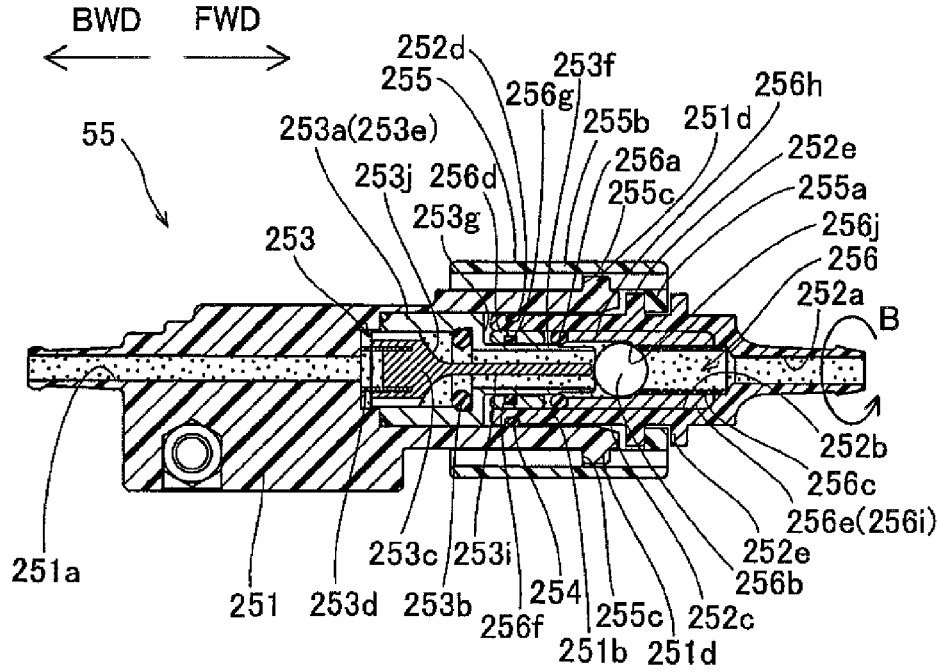
FIG. 17 is a view for describing operations of the valve units when the main body side joint and the hose side joint are connected with the fuel supply system for an outboard motor of the first preferred embodiment of the present invention.

Then, when the joint cover 255 is further rotated in the direction B, as shown in FIG. 7 and FIG. 8, the convex portions 251*d* of the main body side joint 251 reach the mountain portions 255*e* of the guide surfaces 255*c*. At this time, as shown in FIG. 16, the outer peripheral portion of the small-diameter portion 253*f* of the case member 253*a* comes into linear contact with the O-ring 256*a*. Therefore, the fuel from the hose 54 side directly flows into the passage portion 251*a* via the inside of the case member 253*a*.

Thereafter, when the joint cover 255 is further rotated in the direction B, as shown in FIG. 7 and FIG. 8, the convex portions 251*d* of the main body side joint 251 move over the mountain portions 255*e* of the guide surfaces 255*c* and are accommodated in the accommodating portions 255*f*. Also, at this time, the valve member 253*c* (projecting portion 253*i*) of the valve unit 253 and the spherical member 256*b* of the valve unit 256 press each other by the urging forces of the spring members 253*d* and 256*c*. Therefore, it is difficult for the convex portions 251*d* to separate from the accommodating portions 255*f*. Accordingly, the main body side joint 251 and the hose side joint 252 are connected to each other.

Next, technical effects and advantages in the outboard motor and the fuel supply system for the same of the first preferred embodiment of the present invention will be illustrated hereinafter.

In the first preferred embodiment, the valve units 253 and 256 are automatically opened simply by connecting the main body side joint 251 and the hose side joint 252. Therefore, a user is not required to perform a separate operation for opening the valve unit 253 and the valve unit 256 for making the fuel flow to the main body side joint 251 and the hose side joint 252. Accordingly, a user's operation when connecting the joint unit 55 can be prevented from becoming troublesome.

Also, in the first preferred embodiment, the O-rings 254 and 256*f* are arranged to seal a gap between the main body side joint and the hose side joint 252 before the fuel flows to the main body side joint 251 and the hose side joint 252. In other words, the O-rings and 256*f* are arranged to seal a gap between the main body side joint 251 and the hose side joint 252 before the valve units 253 and open. Accordingly, after the valve unit 253 and the valve unit 256 are opened, the fuel can be prevented from leaking from the portion between the main body side joint 251 and the hose side joint 252. As a result, hygiene of a user can be kept when connecting the joint unit 55.

Also, in the first preferred embodiment, the O-ring 254 and the O-ring 256*f* are arranged so as not to be exposed to the outside. Therefore, dust, etc., can be prevented from adhering to the O-ring 254 and the O-ring 256*f*, and accordingly, deterioration in sealing performance of the O-ring 254 and O-ring 256*f* due to adhesion of dust, etc., can be prevented. Further, deterioration of the O-ring 254 and the O-ring 256*f* due to adhesion of dust, etc., can be prevented.

Also, in the first preferred embodiment, the O-ring 256*f* which seals a gap between the valve unit 253 of the main body side joint 251 and the valve unit 256 of the hose side joint 252 is provided. Therefore, when the valve unit 253 and the valve unit 256 are opened, the O-ring 256*f* can prevent the fuel from leaking from the portion between the valve unit 253 and the valve unit 256.

Also, in the first preferred embodiment, the opening side sleeve 256*d* is provided on the valve unit 256 of the hose side joint 252. The opening side sleeve 256*d* is arranged to allow the valve unit 253 of the main body side joint 251 to be inserted therein. Further, on the opening side sleeve 256*d*, the O-ring 256*f* is provided. The O-ring 256*f* is arranged to seal a gap between the opening side sleeve 256*d* and a portion (small-diameter portion 253*f*) of the valve unit 253. Accordingly, the fuel can be easily prevented from leaking from the portion between the valve unit 253 and the valve unit 256.

Also, in the first preferred embodiment, on a portion opposed to the valve unit 253 on the inner peripheral surface of the opening side sleeve 256*d*, a groove portion 256*g* is provided. The O-ring 256*f* is arranged within the groove portion 256*g*. Therefore, the O-ring 256*f* can be prevented from moving by the groove portion 256*g*.

Also, in the first preferred embodiment, the O-ring 256*f* is arranged in the vicinity of the tip end side of the valve unit 256. Therefore, immediately after the connection between the main body side joint 251 and the hose side joint 252 starts, a gap between the valve unit 253 and the valve unit 256 can be sealed immediately. Accordingly, a gap between the valve unit 253 and the valve unit 256 can be easily sealed before these are opened.

Also, in the first preferred embodiment, an O-ring 254 is provided on the hose side joint 252. The O-ring 254 is arranged to seal a gap between the opening 251*b* of the main body side joint 251 and the outer peripheral surface 252*c* of the hose side joint 252. Therefore, when the fuel leaks from the portion at which the O-ring 256*f* is arranged, this fuel can be dammed by the O-ring 254. Therefore, as compared with the case in which only the O-ring 256*f* is arranged, the fuel can be reliably prevented from leaking.

Also, in the first preferred embodiment, the valve unit 253 and the valve unit 256 are arranged to open by pressing each other. Therefore, merely by connecting the main body side joint 251 and the hose side joint 252, the valve unit 253 and the valve unit 256 can be easily opened. Also, the O-ring 254 and the O-ring 256*f* are arranged at positions at which they can seal a gap between the main body side joint 251 and the hose side joint 252 before the valve unit 253 and the valve unit 256 come into contact with each other. Therefore, before the valve unit 253 and the valve unit 256 are opened, a gap between the main body side joint 251 and the hose side joint 252 can be easily sealed.

Also, in the first preferred embodiment, the projecting portion 253*i* of the valve unit 253 is arranged so as not to project to the arrow FWD direction side. Therefore, the projecting portion 253*i* can be prevented from being pressed by mistake. Therefore, the valve unit 253 can be prevented from being opened by mistake.

Also, in the first preferred embodiment, the joint cover 255 is provided on the joint unit 55. The joint cover 255 is arranged to cover a portion of the hose side joint 252 to prevent the O-ring 254 and the O-ring 256*f* from being exposed to the outside. Therefore, the O-ring 254 and the O-ring 256*f* are reliably protected by the joint cover 255.

Also, in the first preferred embodiment, the main body side joint 251 and the hose side joint 252 are arranged to be connected to each other by rotation of the joint cover 255 in a predetermined direction (direction B). Therefore, merely by rotating the joint cover 255 in the predetermined direction, the main body side joint 251 and the hose side joint 252 can be easily connected to each other.

Second Preferred Embodiment

Figure 18:
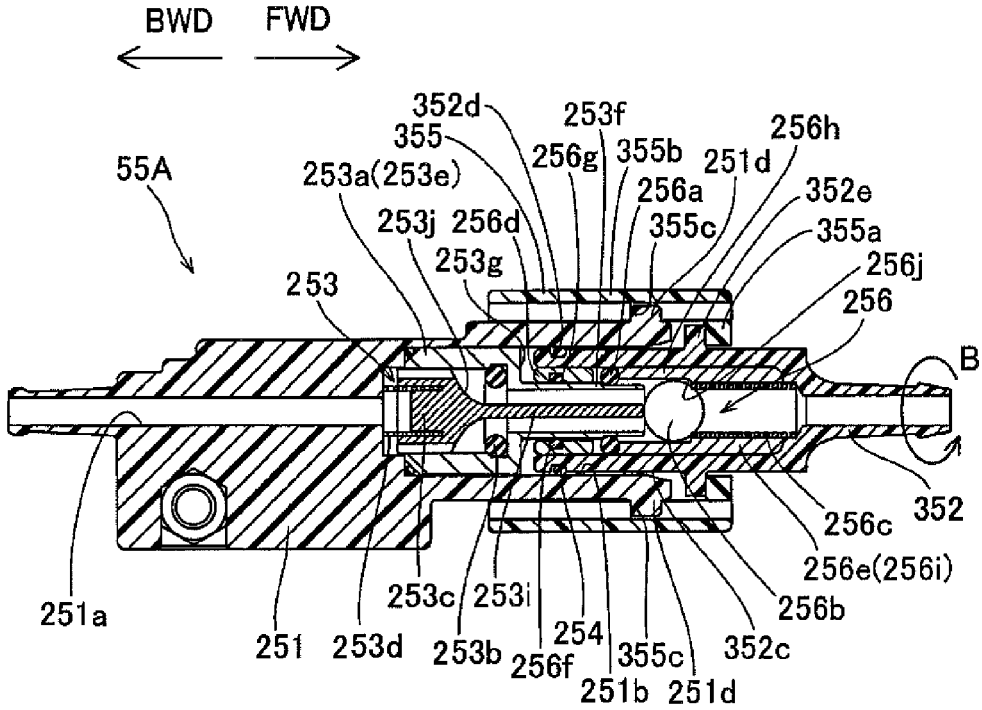
FIG. 18 is a view for describing an arrangement of a joint unit and a joint cover of a fuel supply system for an outboard motor according to a second preferred embodiment of the present invention.
Figure 19:
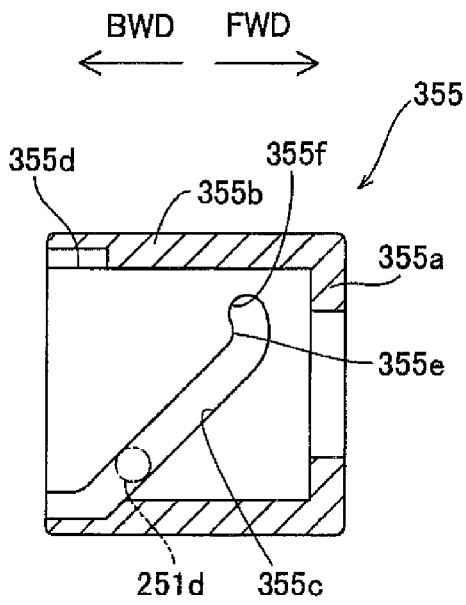
FIG. 19 is a sectional view for describing an arrangement of the joint cover of the fuel supply system for an outboard motor of the second preferred embodiment of the present invention.
Figure 20:
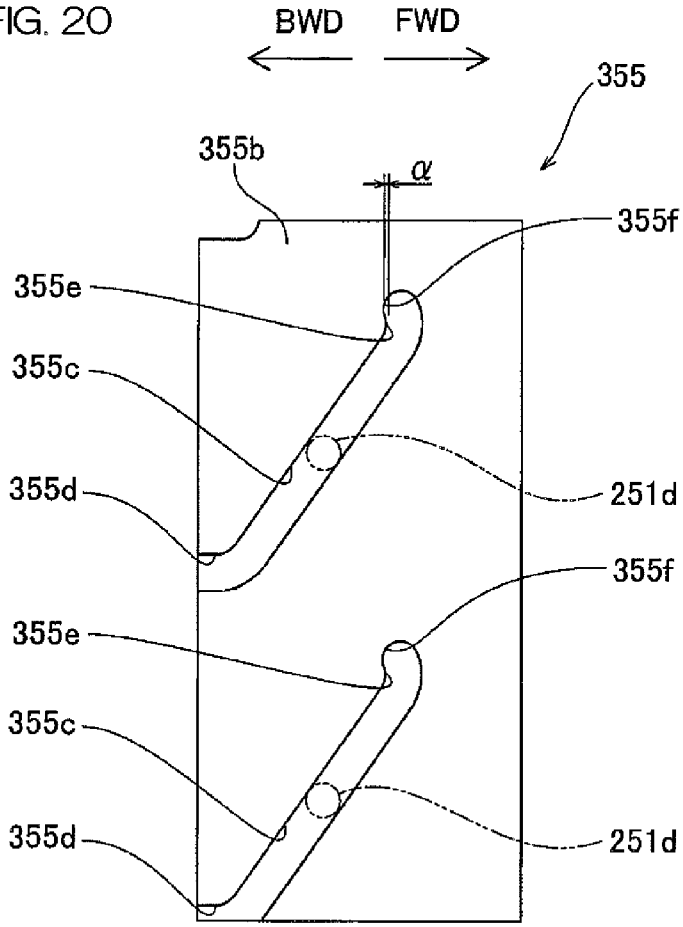
FIG. 20 is a development view for describing an arrangement of the inner peripheral surface of the joint cover of the fuel supply system for an outboard motor of the second preferred embodiment of the present invention.

FIG. 18 is a view for describing an arrangement of a joint unit and a joint cover of a fuel supply system for an outboard motor of a second preferred embodiment of the present invention. FIG. 19 and FIG. 20 are views for describing the arrangement of the joint cover of the fuel supply system for an outboard motor of the second preferred embodiment of the present invention. Hereinafter, an arrangement of the fuel supply system for an outboard motor of the second preferred embodiment of the present invention will be described with reference to FIG. 18 to FIG. 20. The second preferred embodiment describes an example in which, different from the first preferred embodiment, guide surfaces 355*c* of a joint cover 355 of a joint unit 55A are arranged like grooves.

As shown in FIG. 18, on the outer peripheral surface 352*c* of the hose side joint 352, one flange portion 352*e* is provided. The flange portion 352*e* has a disk shape. The flange portion 352*e* is arranged on the arrow FWD direction side of the groove portion 352*d*. In detail, the flange portion 352*e* is provided at substantially the center in the front-rear direction of the outer peripheral surface 352*c* of the hose side joint 352. The hose side joint 352 is an example of a second joint member according to a preferred embodiment of the present invention.

A protruding portion 355*a* of the joint cover 355 is arranged adjacent to the surface on the arrow FWD direction side of the flange portion 352*e*. The joint cover 355 is an example of a cover member and a connecting member according to a preferred embodiment of the present invention. The joint cover 355 is made of, for example, a resin. The joint cover 355 includes a protruding portion 355*a* and a cylindrical cover portion 355*b*. The cover portion 355*b* is arranged to cover the groove portion 352*d* of the hose side joint 352 via a predetermined space. In the groove portion 352*d*, an O-ring 254 is arranged. Therefore, the joint cover 355 is arranged to cover the O-ring 254 and the O-ring 256*f*. The joint cover 355 covers the O-ring 254 and the O-ring 256*f* to prevent these from being exposed to the outside.

Also, the joint cover 355 is arranged to be engageable with the pair of convex portions 251*d* of the main body side joint 251. In detail, as shown in FIG. 18 to FIG. 20, on the inner peripheral surface of the cover portion 355*b* of the joint cover 355, a pair of guide surfaces 355*c* are provided. Each guide surface 355*c* has a groove shape. Each guide surface 355*c* is an example of a guide groove according to a preferred embodiment of the present invention. Each guide surface 355*c* extends in the circumferential direction of the cover portion 355*b* along the inner peripheral surface of the cover portion 355*b*. Further, each guide surface 355*c* inclines with respect to the front-rear direction. Each convex portion 251*d* of the main body side joint 251 (see FIG. 18) is arranged to be engaged with the corresponding guide surface 355*c* while being fitted in the guide surface 355*c*.

By arranging the joint cover 355 as described above, the pair of convex portions 251*d* of the main body side joint 251 can be inserted from the openings 355*d* on the arrow BWD direction side of the cover portion 355*b* of the joint cover 355. Further, the pair of convex portions 251*d* can be engaged with the pair of guide surfaces 355*c*, respectively. In the state in which each convex portion 251*d* engages with the corresponding guide surface 355*c*, by rotating the joint cover 355 by 170 degrees counterclockwise (direction B in FIG. 18) as viewed from the arrow FWD direction side, the pair of convex portions 251*d* can be moved along the pair of guide surfaces 355*c*, respectively.

As shown in FIG. 19 and FIG. 20, each convex portion 251*d* is arranged to be accommodated in the corresponding accommodating portion 355*f* by reaction forces of the spring members 253*d* and 256*c* (see FIG. 18) after getting over the mountain portion 355*e* of the corresponding guide surface 355*c*. The distance α (see FIG. 20) in the front-rear direction between the mountain portion 355*e* of the guide surface 355*c* and the accommodating portion 355*f* is, for example, approximately 0.5 millimeters.

Other structures, operations, and effects of the second preferred embodiment are the same as in the first preferred embodiment described above.

Third Preferred Embodiment

Figure 21:
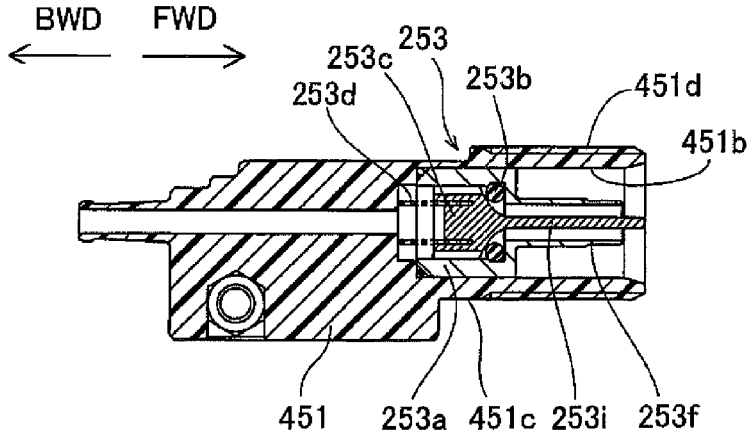
FIG. 21 is a sectional view for describing an arrangement of a main body side joint unit of the fuel supply system for an outboard motor of the third preferred embodiment of the present invention.
Figure 22:
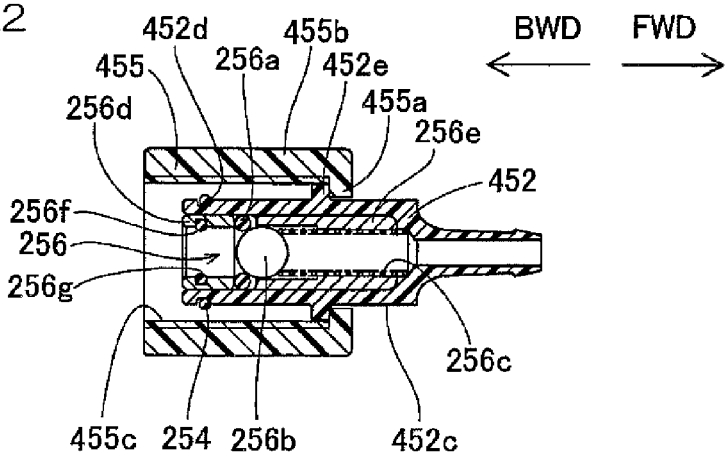
FIG. 22 is a sectional view for describing an arrangement of a hose side joint unit and a joint cover of a fuel supply system for an outboard motor of a third preferred embodiment of the present invention.
Figure 23:
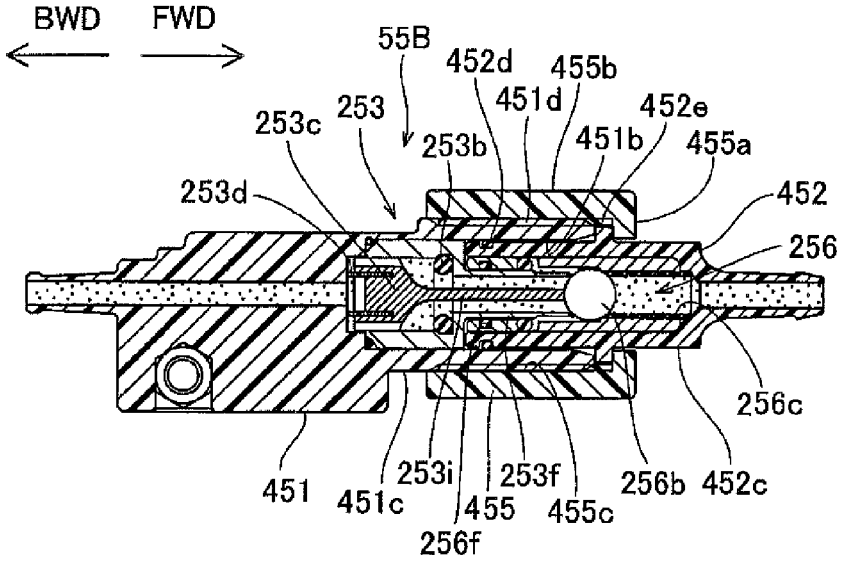
FIG. 23 is a view for describing an arrangement of the joint unit and the joint cover of the fuel supply system for an outboard motor of the third preferred embodiment of the present invention.

FIG. 21 is a sectional view for describing an arrangement of a main body side joint unit of a fuel supply system for an outboard motor of a third preferred embodiment of the prevent invention. FIG. 22 is a sectional view for describing an arrangement of a hose side joint unit and a joint cover of the fuel supply system for an outboard motor of the third preferred embodiment of the present invention. FIG. 23 is a view for describing the joint unit and the joint cover of the fuel supply system for an outboard motor of the third preferred embodiment of the present invention. Hereinafter, an arrangement of the fuel supply system for an outboard motor of the third preferred embodiment of the present invention will be described in detail with reference to FIG. 21 to FIG. 23. In the third preferred embodiment, different from the first and second preferred embodiments, a thread portion 455*c* is provided on the inner peripheral surface of the cover portion 455*b* of the joint cover 455. Further, in the third preferred embodiment, on the outer peripheral portion 451*c* of the main body side joint 451, a thread portion 451*d* corresponding to the thread portion 455*c* is provided.

The joint unit 55B includes a thread portion 451*d*. As shown in FIG. 21, the thread portion 451*d* is provided on the outer peripheral portion 451*c* of the opening 451*b* of the main body side joint 451. The main body side joint 451 is an example of a first joint member according to a preferred embodiment of the present invention. Also, the thread portion 451*d* is an example of a convex portion according to a preferred embodiment of the present invention.

Also, as shown in FIG. 22, on the outer peripheral surface 452*c* of the hose side joint 452, one flange portion 452*e* is provided. The flange portion 452*e* has a disk shape. The flange portion 452*e* is arranged on the arrow FWD direction side of the groove portion 452*d*. In detail, the flange portion 452*e* is provided at substantially the center in the front-rear direction of the outer peripheral surface 452*c* of the hose side joint 452. The hose side joint 452 is an example of a second joint member according to a preferred embodiment of the present invention.

Also, a protruding portion 455*a* of the joint cover 455 is arranged adjacent to a surface on the arrow FWD direction side of the flange portion 452*e*. The joint cover 455 is an example of a cover member and a connecting member according to a preferred embodiment of the present invention. The joint cover 455 is made of, for example, a resin. The joint cover 455 includes the protruding portion 455*a* and a cylindrical cover portion 455*b*. The cover portion 455*b* is arranged to cover the groove portion 452*d* of the hose side joint 452 via a predetermined space. In the groove portion 452*d*, an O-ring 254 is arranged. Therefore, the joint cover 455 is arranged to cover the O-ring 254 and the O-ring 256*f*. The joint cover 455 covers the O-rings 254 and 256*f* to prevent the O-rings 254 and 256*f* from being exposed to the outside.

Also, the joint cover 455 is arranged to be engageable with the thread portion 451*d* (see FIG. 21) of the outer peripheral portion 451*c* of the main body side joint 451. In detail, the joint unit 55B includes a thread portion 455*c*. The thread portion 455*c* is an example of a concave portion according to a preferred embodiment of the present invention. The thread portion 455*c* is provided on the inner peripheral surface of the cover portion 455*b* of the joint cover 455. As shown in FIG. 23, the screw portion 451*d* is arranged to be capable of being screwed to the thread portion 455*c*. As shown in FIG. 23, by screwing the thread portion 451*d* and the thread portion 455*c* to each other, the main body side joint 451 and the hose side joint 452 can be connected to each other.

Other structures and effects of the third preferred embodiment are the same as those of the first and second preferred embodiments described above.

Fourth Preferred Embodiment

FIG. 24 to FIG. 33 are views for describing an arrangement of an outboard motor and a fuel supply system for the same of a fourth preferred embodiment of the present invention. Hereinafter, the arrangement of the fuel supply system for an outboard motor of the fourth preferred embodiment of the present invention will be described in detail with reference to FIG. 24 to FIG. 33.

Figure 24:
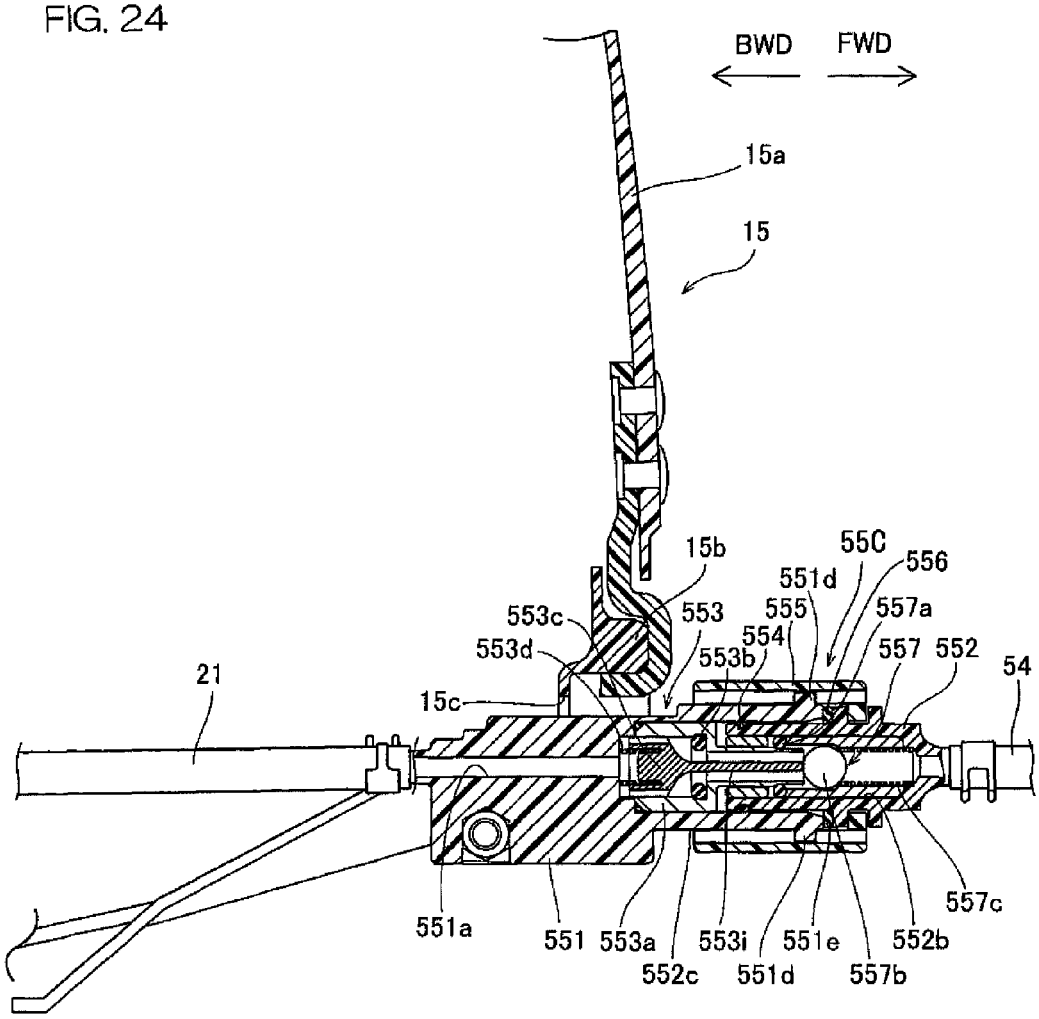
FIG. 24 is a sectional view showing a joint unit of a fuel supply system for an outboard motor of a fourth preferred embodiment of the present invention.

As shown in FIG. 24, a joint unit 55C includes a main body side joint 551 attached to the engine cover 15, and a hose side joint 552 arranged to be connectable to the main body side joint 551. The main body side joint 551 is an example of a first joint member according to a preferred embodiment of the present invention, and the hose side joint 552 is an example of a second joint member according to a preferred embodiment of the present invention. The main body side joint 551 and the hose side joint 552 are connected in the front-rear direction (arrow FWD direction and arrow BWD direction). That is, in the present preferred embodiment, the front-rear direction corresponds to a coupling direction according to a preferred embodiment of the present invention.

The main body side joint 551 is arranged in an opening 15*c* provided on a front portion (portion on the arrow FWD direction side) of the lower cover 15*b*. The portion on the hose side joint 552 side (arrow FWD direction side) of the main body side joint 551 protrudes forward (arrow FWD direction) from the opening 15*c*. The main body side joint 551 is screwed or fixed to the lower cover 15*b*.

Figure 25:
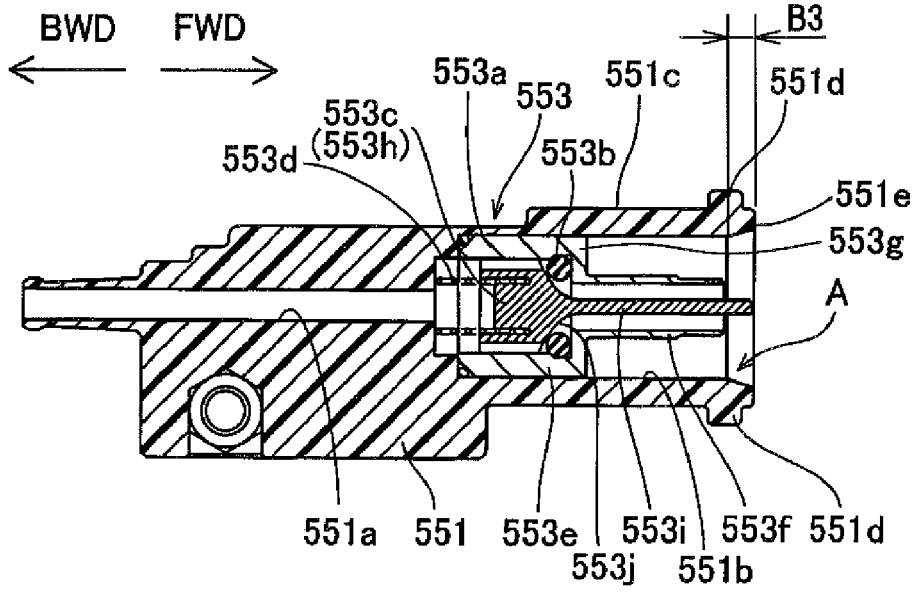
FIG. 25 is a sectional view for describing a structure of a main body side joint of the fuel supply system for an outboard motor of the fourth preferred embodiment of the present invention.

Also, the main body side joint 551 is made of, for example, a resin as shown in FIG. 25. Inside the main body side joint 551, a passage portion 551*a* arranged to extend in the front-rear direction in which a fuel can flow is provided. The arrow BWD direction side of the passage portion 551*a* is connected to the hose 21 (see FIG. 24). Also, on the arrow FWD direction side of the passage portion 551*a*, an opening 551*b* with a diameter larger than that of the passage portion 551*a* is provided. The opening 551*b* is arranged to extend in the front-rear direction similar to the passage portion 551*a*. In the opening 551*b*, a portion on the side (arrow FWD direction side) to be connected to the hose side joint 552 is a tip end portion 551*e* (front end portion) of the opening 551*b*. The vicinity A of the tip end portion 551*e* (front end portion) of the opening 551*b* is arranged to increase (expand) in diameter of the opening 551*b* as it goes to the tip end portion 551*e*.

Also, on the outer peripheral portion 551*c* of the opening 551*b* of the main body side joint 551, a pair of convex portions 551*d* are provided. The pair of convex portions 551*d* are provided at an interval of 180 degrees around the central axis of the outer peripheral portion 551*c*. Also, the pair of convex portions 551*d* are provided in the vicinity of the end portion on the arrow FWD direction side of the outer peripheral portion 551*c*, respectively. The pair of convex portions 551*d* protrudes outward from the outer peripheral portion 551*c*, respectively. The pair of convex portions 551*d* have columnar shapes, respectively.

Also, in the opening 551*b* of the main body side joint 551, a valve unit 553 is provided. The valve unit 553 is an example of a first valve according to a preferred embodiment of the present invention. The valve unit 553 is arranged to come into contact with the valve unit 557 described later when the main body side joint 551 and the hose side joint 552 are connected. Further, the valve unit 553 and the valve unit 557 are arranged to press each other when the main body side joint 551 and the hose side joint 552 are connected. The valve unit 553 and the valve unit 557 are arranged to open by pressing each other. The valve unit 553 includes a case member 553*a* fixed to the opening 551*b*, an O-ring 553*b* accommodated inside the case member 553*a*, a valve member 553*c* capable of opening and closing, and a spring member 553*d* which urges the valve member 553*c* to the O-ring 553*b* side (arrow FWD direction side).

The case member 553*a* includes a large-diameter portion 553*e*, a small-diameter portion 553*f*, and a connecting portion 553*g*. The large-diameter portion 553*e* is fitted in contact with the inner peripheral surface of the opening 551*b*. The outer peripheral surface of the large-diameter portion 553*e* and the inner peripheral surface of the opening 551*b* are hermetically sealed to each other. Also, the diameter of the small-diameter portion 553*f* is smaller than that of the large-diameter portion 553*e*. The large-diameter portion 553*e* and the small-diameter portion 553*f* are connected by the connecting portion 553*g*. The O-ring 553*b* is arranged in the vicinity of the coupling portion between the connecting portion 553*g* and the large-diameter portion 553*e*. The O-ring 553*b* is held by the case member 553*a* so as not to move in the circumferential direction and in the arrow FWD direction.

Also, the valve member 553*c* includes a main body portion 553*h*, a projecting portion 553*i*, and a connecting portion 553*j*. The main body portion 553*h* is accommodated inside the large-diameter portion 553*e* of the case member 553*a*. The projecting portion 553*i* extends forward (arrow FWD direction) from the main body portion 553*h*. The main body portion 553*h* and the projecting portion 553*i* are connected by the connecting portion 553*j*. The connecting portion 553*j* is arranged to define a curved surface with a diameter which becomes gradually smaller as it goes to the projecting portion 553*i*. By contact of the connecting portion 553*j* with the inner peripheral surface of the O-ring 553*b*, the valve member 553*c* and the O-ring 553*b* are closed to each other. Accordingly, the flow of the fuel in the valve unit 553 is stopped.

Also, the projecting portion 553*i* is arranged to project to the arrow FWD direction side of the case member 553*a* in a state in which the connecting portion 553*j* is in contact with the inner peripheral surface of the O-ring 553*b*. The projecting portion 553*i* is arranged to come into contact with a spherical member 557*b* provided inside the hose side joint 552 when the main body side joint 551 and the hose side joint 552 are connected. Further, the projecting portion 553*i* is arranged to press the spherical member 557*b* when the main body side joint 551 and the hose side joint 552 are connected. The projecting portion 553*i* is arranged so as not to project outward of the end portion on the hose side joint 552 side (end portion on the arrow FWD direction side) of the main body side joint 551 regardless of whether or not the connecting portion 553*j* is in contact with the inner peripheral surface of the O-ring 553*b*.

Also, on a rear portion (portion on the arrow BWD direction side) of the main body portion 552*h* of the valve member 553*c*, a spring member 553*d* is arranged. The spring member 553*d* may be a coil spring, for example. A portion on the arrow BWD direction side of the spring member 553*d* is held on an end portion on the arrow BWD direction side of the opening 551*b*.

Figure 26:
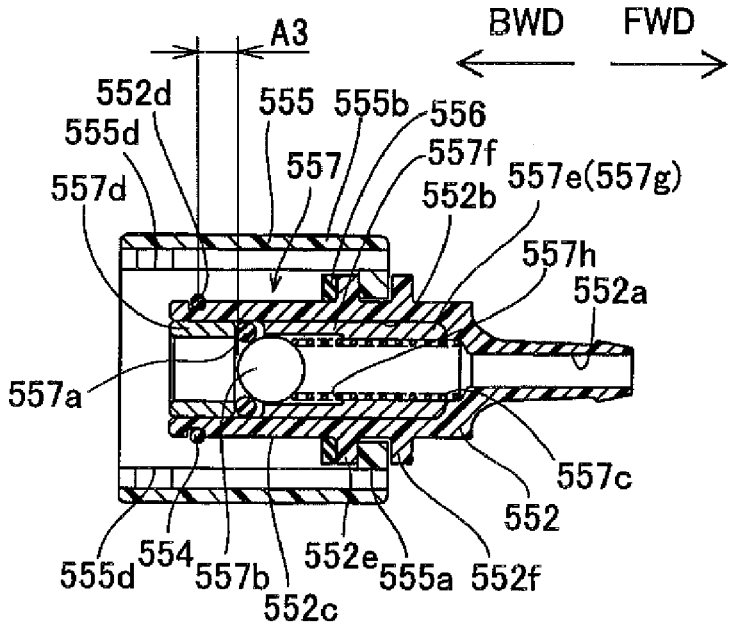
FIG. 26 is a sectional view for describing a structure of a hose side joint of the fuel supply system for an outboard motor of the fourth preferred embodiment of the present invention.

Also, the hose side joint 552 is connected to a hose 54 (see FIG. 24) of an external fuel pathway 50. Also, as shown in FIG. 26, the hose side joint 552 is made of, for example, a resin. Inside the hose side joint 552, a passage portion 552*a* connected to the hose 54 (see FIG. 24) and arranged to extend in the front-rear direction is provided. Also, on the arrow BWD direction side of the passage portion 552*a*, an opening 552*b* with a diameter larger than that of the passage portion 552*a* is provided. The opening 552*b* is arranged to extend in the front-rear direction similar to the passage portion 552*a*.

Also, as shown in FIG. 5, the diameter of the outer peripheral surface 552*c* corresponding to the opening 552*b* of the hose side joint 552 is slightly smaller than the diameter of the opening 551*b* (inner peripheral surface) of the main body side joint 551. In other words, the outer peripheral surface 552*c* of the hose side joint 552 is arranged to be inserted in the opening 551*b* of the main body side joint 551.

Further, as shown in FIG. 26, on the outer peripheral surface 252*c* of the hose side joint 552, an annular groove portion 552*d* arranged to extend in the circumferential direction of the outer peripheral surface 552*c* is provided. In the groove portion 552*d*, an O-ring 554 is fitted. The O-ring 554 is arranged to seal a gap between the inner peripheral surface of the opening 552*b* of the main body side joint 551 and the outer peripheral surface 552*c* of the hose side joint 552. The O-ring 554 is an example of a sealing member and a second seal according to a preferred embodiment of the present invention.

Also, the groove portion 552*d* is provided in the vicinity of the tip end portion on the main body side joint 551 side (arrow BWD direction side) of the outer peripheral surface 552*c*. Therefore, the O-ring 554 is arranged in the vicinity of the tip end portion on the main body side joint 551 side (arrow BWD direction side) of the outer peripheral surface 552*c* of the hose side joint 552.

In detail, as shown in FIG. 25, a first distance B3 is a distance in the front-rear direction from a tip end portion of the projecting portion 553*i* to a tip end portion of the inner peripheral surface of the opening 551*b*. The first distance B3 is defined as positive when tip end portion of the inner peripheral surface of the opening 551*b* is positioned closer to the hose side joint 552 than the tip end portion of the projecting portion 553*i*. Further, as shown in FIG. 26, a second distance A3 is a distance in the front-rear direction from a tip end of the spherical member 557*b* to the O-ring 554. The second distance A3 is defined as negative when the O-ring 554 is positioned closer to the main body side joint 551 than the tip end of the spherical member 557*b*. The joint unit 55C is arranged such that the first distance B3 becomes greater than the second distance A3 (A3<0, B3<0, and B3>A3). In addition, the tip end portion of the inner peripheral surface of the opening 551*b* is a tip end portion of the cylindrical surface, and does not include a tapered portion. The valve member 553*c* is an example of a first valve body according to a preferred embodiment of the present invention, and the tip end portion of the projecting portion 553*i* is an example of a first pressing end according to a preferred embodiment of the present invention. Also, the spherical member 557*b* is an example of a second valve body according to a preferred embodiment of the present invention, and the tip end of the spherical member 557*b* is an example of a second pressing end according to a preferred embodiment of the present invention.

Also, as shown in FIG. 26, on the outer peripheral surface 552*c* of the hose side joint 552, a pair of flange portions 552*e* and 552*f* are provided. The pair of flange portions 552*e* and 552*f* have disk shapes, respectively. The pair of flange portions 552*e* and 552*f* are arranged on the arrow FWD direction side of the groove portion 552*d*. The pair of flange portions 552*e* and 552*f* are opposed to each other via a predetermined space in the front-rear direction. Between the pair of flange portions 552*e* and 552*f*, an annular groove arranged to extend in the circumferential direction of the outer peripheral surface 552*c* is provided. The annular groove is an example of an annular groove according to a preferred embodiment of the present invention. Also, two surfaces opposed to each other of the pair of flange portions 552*e* and 552*f* are an example of a pair of inner wall surfaces according to a preferred embodiment of the present invention.

The pair of flange portions 552*e* and 552*f* are arranged to hold a protruding portion 555*a* of a joint cover 555 rotatably. In detail, between the pair of flange portions 552*e* and 552*f*, the protruding portion 555*a* of the joint cover 555 is fitted. The joint cover 555 is an example of a cover member and a connecting member according to a preferred embodiment of the present invention. The flange portion 552*e* is arranged to come into contact with a surface on the arrow BWD direction side of the protruding portion 555*a*. Further, the flange portion 552*e* is arranged to be pressed in the arrow BWD direction by the protruding portion 555*a* when moving the hose side joint 552 in a direction (arrow BWD direction) of connection to the main body side joint 551. Also, the flange portion 552*f* is arranged to come into contact with a surface on the arrow FWD direction side of the protruding portion 555*a*. Further, the flange portion 552*f* is arranged to be pressed in the arrow FWD direction by the protruding portion 555*a* when moving the hose side joint 552 in a direction (direction of separation) (arrow FWD direction) opposite to the direction of connection to the main body side joint 551.

Figure 27:
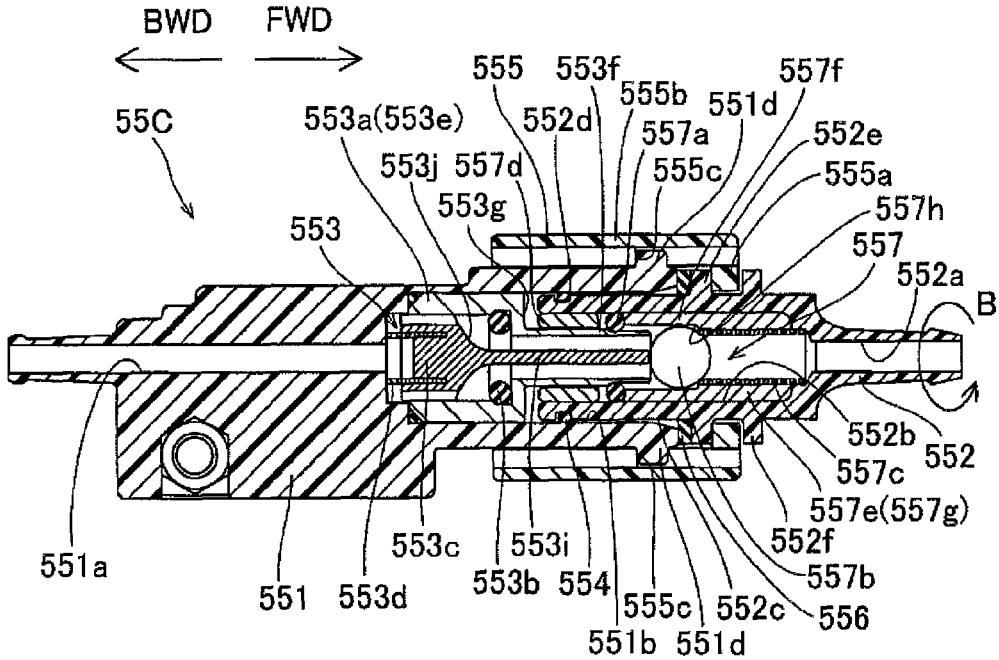
FIG. 27 is a sectional view for describing the structure of the joint unit of the fuel supply system for an outboard motor of the fourth preferred embodiment of the present invention.
Figure 28:
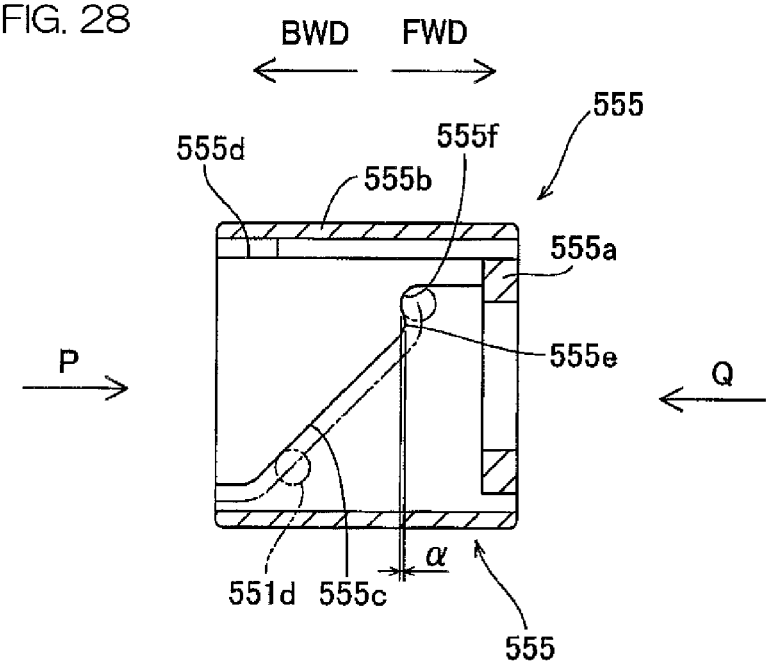
FIG. 28 is a sectional view for describing a structure of a joint cover of the fuel supply system for an outboard motor of the fourth preferred embodiment of the present invention.
Figure 29:
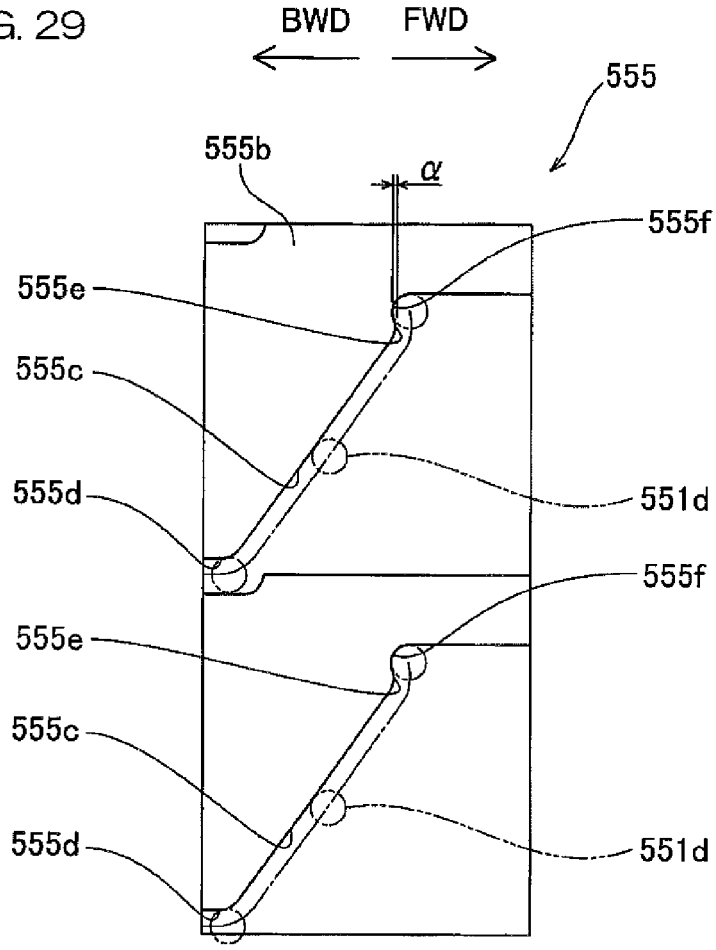
FIG. 29 is a development view for describing a structure of an inner peripheral surface of the joint cover of the fuel supply system for an outboard motor of the fourth preferred embodiment of the present invention.
Figure 30:
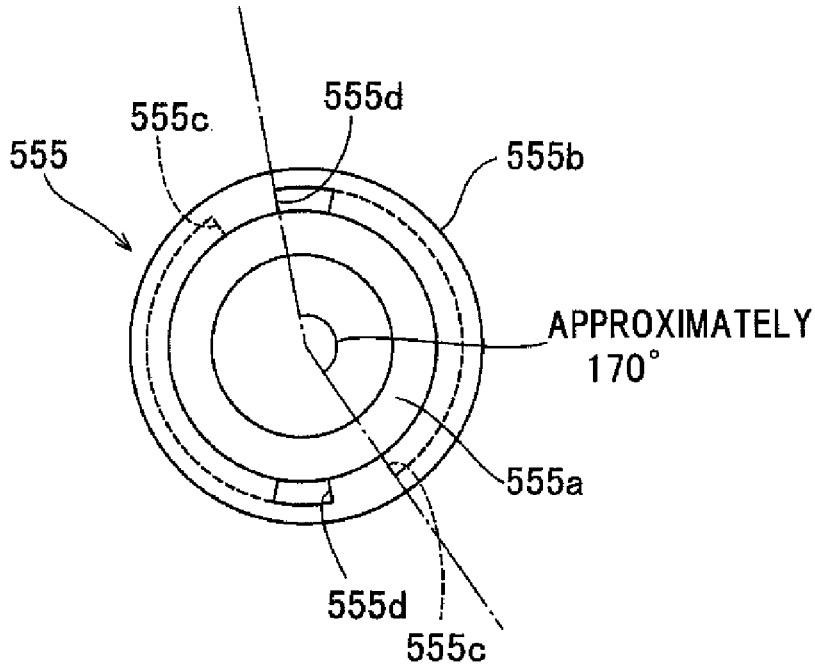
FIG. 30 is a view from the arrow P direction of FIG. 28.
Figure 31:
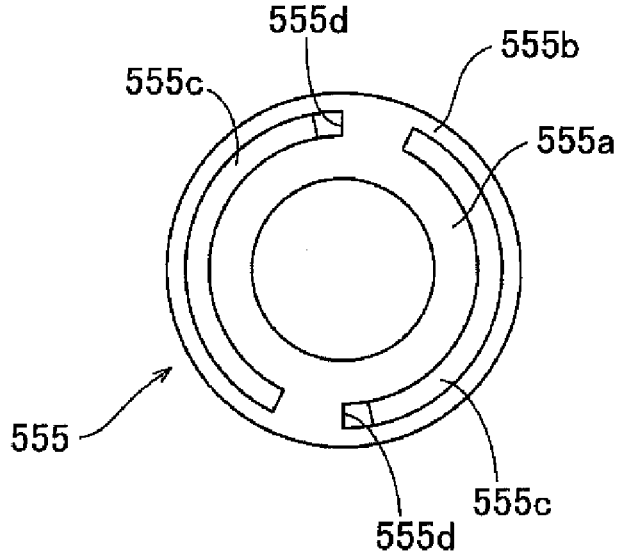
FIG. 31 is a view from the arrow Q direction of FIG. 28.

The joint cover 555 is made of, for example, a resin. The joint cover 555 includes a protruding portion 555*a* and a cylindrical cover portion 555*b*. As shown in FIG. 27, the joint cover 555 is arranged to be engageable with the pair of convex portions 551*d* of the main body side joint 551. In detail, as shown in FIG. 27 to FIG. 29, on the inner peripheral surface of the cover portion 555*b* of the joint cover 555, a pair of guide surfaces 555*c* are provided. The pair of guide surfaces 555*c* are an example of a concave portion and a guide surface according to a preferred embodiment of the present invention. As shown in FIG. 28 to FIG. 31, each guide surface 555*c* extends in the circumferential direction of the cover portion 555*b* along the inner peripheral surface of the cover portion 555*b*. Further, each guide surface 555*c* inclines with respect to the front-rear direction. Each guide surface 555*c* is arranged to define a curved surface opening in the arrow FWD direction. As shown in FIG. 28, each guide surface 555*c* is arranged to guide the convex portion 555*d* to the accommodating portion 555*f* (connecting position) along the guide surface 555*c*. In other words, the pair of convex portions 555*d* of the main body side joint 551 are arranged to be pressed by the corresponding guide surfaces 555*c* in the arrow FWD direction when the joint cover 555 is rotated clockwise (direction B of FIG. 27) in a state in which each convex portion 551*d* is engaged with the corresponding guide surface 555*c*.

Also, on an end portion on the arrow BWD direction side of the cover portion 555*b*, a pair of openings 555*d* are provided. The pair of openings 555*d* are arranged corresponding to the pair of convex portions 551*d* of the main body side joint 551. The pair of openings 555*d* are connected to the pair of guide surfaces 555*c*, respectively.

Also, the guide surfaces 555*c* are arranged to extend across a rotation angle (see FIG. 30) of approximately 170 degrees on the inner peripheral surface of the cover portion 555*b* as viewed from the front side (arrow Q direction of FIG. 28). The main body side joint 551 and the hose side joint 552 are connected by turning of the joint cover 555 by approximately 170 degrees. In detail, the guide surfaces 555*c* of the joint cover 555 are engaged with the convex portions 551*d* of the main body side joint 551. Then, in this state, the joint cover 555 is turned clockwise by approximately 170 degrees relative to the main body side joint 551. In other words, the joint cover 555 is turned by an angle less than one rotation (360 degrees) and less than a half rotation (180 degrees). The pair of convex portions 551*d* of the main body side joint 551 move toward the corresponding accommodating portions 555*f* along with turning of the joint cover 555, and reach the accommodating portions 555*f*. Accordingly, the main body side joint 551 and the hose side joint 552 are connected.

Also, as shown in FIG. 28 and FIG. 29, on each guide surface 555*c*, a mountain portion 555*e* and an accommodating portion 555*f* are provided. Each mountain portion 555*e* is arranged to protrude to the arrow FWD direction side. Each accommodating portion 555*f* is provided adjacent to the corresponding mountain portion 555*e*. Each accommodating portion 555*f* is arranged to accommodate one of the convex portions 551*d* of the main body side joint 551 at a connecting position when the main body side joint 551 and the hose side joint 552 are connected. Each accommodating portion 555*f* is arranged to restrict one of the convex portions 551*d* of the main body side joint 551 from moving from the connecting position when the main body side joint 551 and the hose side joint 552 are connected. The accommodating portion 555*f* is an example of a movement restricting portion according to a preferred embodiment of the present invention.

By arranging the joint cover 555 as described above, the pair of convex portions 551*d* of the main body side joint 551 can be inserted from the openings 555*d* on the arrow BWD direction side of the cover portion 555*b* of the joint cover 555. Further, the pair of convex portions 551*d* of the main body side joint 551 can be engaged with the pair of guide surfaces 555*c*, respectively. Then, in this state, by rotating the joint cover 555 counterclockwise (direction B in FIG. 27) by approximately 170 degrees as viewed from the arrow FWD direction side, each convex portion 551*d* can be moved along the corresponding guide surface 555*c* while being brought into contact with the guide surface 555*c*. In other words, along with pressing of the corresponding convex portions 551*d* by the guide surfaces 555*c*, the joint cover 555 is moved in a direction of approaching the main body side joint 551. Accordingly, the flange portion 552*e* of the hose side joint 552 is pressed in the arrow FWD direction by the protruding portion 555*a* of the joint cover 555. Further, the hose side joint 552 can be moved to the main body side joint 551 side against reaction forces of the two spring members 553*d* and 557*c*, that is, forces in directions of separating the main body side joint 551 and the hose side joint 552 from each other. Accordingly, the main body side joint 551 and the hose side joint 552 can be connected to each other.

Also, when the main body side joint 551 and the hose side joint 552 are connected, on the main body side joint 551 and the hose side joint 552, forces in directions of separating from each other are generated by reaction forces of the spring members 553*d* and 557*c* and a damper 556 described later. Therefore, each convex portion 551*d* is pressed in the arrow BWD direction to the corresponding accommodating portion 555*f*. Therefore, the state in which each convex portion 551*d* is accommodated in the corresponding accommodating portion 555*f* is reliably kept. The distance α (see FIG. 28 and FIG. 29) in the front-rear direction between the mountain portion 555*e* of the guide surface 555*c* and the accommodating portion 555*f* of the guide surface 555*c* is, for example, approximately 0.5 millimeters.

Also, as shown in FIG. 26, on the arrow BWD direction side of the flange portion 552*e*, a damper 556 is provided. The damper 556 is adjacent to the flange portion 552*e*. The damper 556 is made of, for example, rubber. The damper 556 has substantially the same shape as the disk-shaped flange portion 552*e*. The damper 556 is sandwiched by the tip end portion 551*e* on the arrow FWD direction side of the main body side joint 551 and the flange portion 552*e* when the main body side joint 551 and the hose side joint 552 are connected. Therefore, when the main body side joint 551 and the hose side joint 552 are connected, the damper 556 urges the tip end portion 551*e* of the main body side joint 551 and the flange portion 552*e* in directions of separating from each other. Accordingly, each convex portion 551*d* is urged to the accommodating portion 555*f* of the corresponding guide surface 555*c*.

Also, as shown in FIG. 26, in the opening 552*b* of the hose side joint 552, a valve unit 557 is provided. The valve unit 557 is an example of a second valve according to a preferred embodiment of the present invention. The valve unit 557 includes an O-ring 557*a*, a spherical member 557*b*, a spherical member 557*b* and a spring member 557*c*. The O-ring 557*a* is arranged along the opening 552*b* (inner peripheral surface) of the hose side joint 552. The O-ring 557*a* extends in the circumferential direction of the opening 552*b*. The spherical member 557*b* is arranged to be capable of coming into linear contact with the O-ring 557*a* across the entire circumference of the O-ring 557*a*. Also, the spherical member 557*b* is urged to the O-ring 557*a* by the spring member 557*c*.

As shown in FIG. 26, the O-ring 557*a* is held between an opening side sleeve 557*d* and a hose side sleeve 557*e*. The opening side sleeve 557*d* is fitted in the opening 552*b*. Also, the hose side sleeve 557*e* has a large-diameter portion 557*f* and a small-diameter portion 557*g*. The large-diameter portion 557*f* is arranged on the arrow BWD direction side of the small-diameter portion 557*g*. The outer diameter of the large-diameter portion 557*f* and the outer diameter of the small-diameter portion 557*g* are substantially equal to each other. Also, the inner diameter of the large-diameter portion 557*f* is larger than the inner diameter of the small-diameter portion 557*g*. Between the inner peripheral surface of the large-diameter portion 557*f* and the inner peripheral surface of the small-diameter portion 557*g*, a step portion 557*h* is provided.

The spherical member 557*b* is arranged inside the large-diameter portion 557*f* of the hose side sleeve 557*e*. The spherical member 557*b* is arranged to be movable between the O-ring 557*a* and the step portion 557*h*. By bringing the spherical member 557*b* into linear contact with the O-ring 557*a* across the entire circumference of the O-ring 557*a*, the spherical member 557*b* and the O-ring 557*a* are closed to each other. Accordingly, the flow of the fuel in the hose side joint 552 is stopped.

Also, the spring member 557*c* may be a coil spring, for example. One side of the spring member 557*c* is supported on an end portion on the arrow FWD direction side of the opening 552*b* of the hose side joint 552. Also, the other side of the spring member 557*c* is arranged to urge a portion on the arrow FWD direction side of the spherical member 557*b*. Accordingly, the spherical member 557*b* is pressed toward the O-ring 557*a* by the spring member 557*c*.

As shown in FIG. 27, when the main body side joint 551 and the hose side joint 552 are connected, the spherical member 557*b* is pressed in the arrow FWD direction by the projecting portion 553*i* of the valve unit 553 of the main body side joint 551. Accordingly, the spherical member 557*b* and the O-ring 557*a* separate from each other and the valve unit 557 opens. Then, when the spherical member 557*b* comes into contact with the step portion 557*h*, the projecting portion 553*i* is pressed in the arrow BWD direction by the spherical member 557*b*. Therefore, the valve member 553*c* of the valve unit 553 moves in the arrow BWD direction. Accordingly, the O-ring 553*b* and the valve member 553*c* of the valve unit 553 separate from each other and the valve unit 553 opens.

Figure 32:
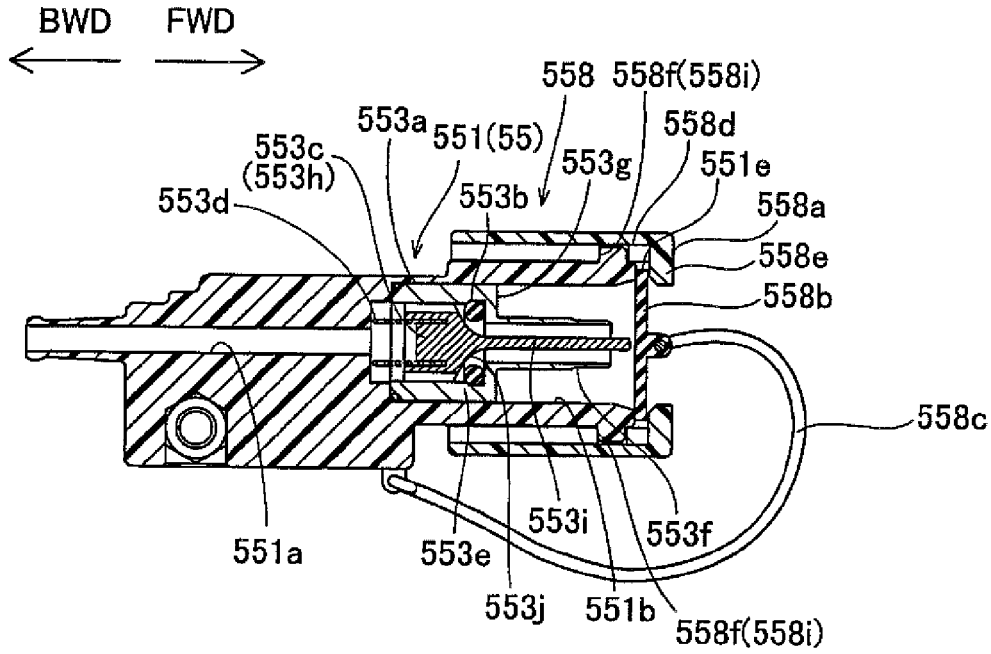
FIG. 32 is a sectional view showing a state in which a cover member is fitted to the main body side joint of the fuel supply system for an outboard motor of the fourth preferred embodiment of the present invention.

Also, as shown in FIG. 32, to the main body side joint 551, a cover member 558 is attached. The cover member 558 is arranged to cover the opening 551*b* of the main body side joint 551 when the main body side joint 551 and the hose side joint 552 separate from each other. The cover member 558 includes a main body member 558*a* made of, for example, a resin, a lid member 558*b* made of rubber attachable to the main body member 558*a*, and a string member 558*c* which connects the lid member 558*b* and the main body side joint 551.

Figure 33:
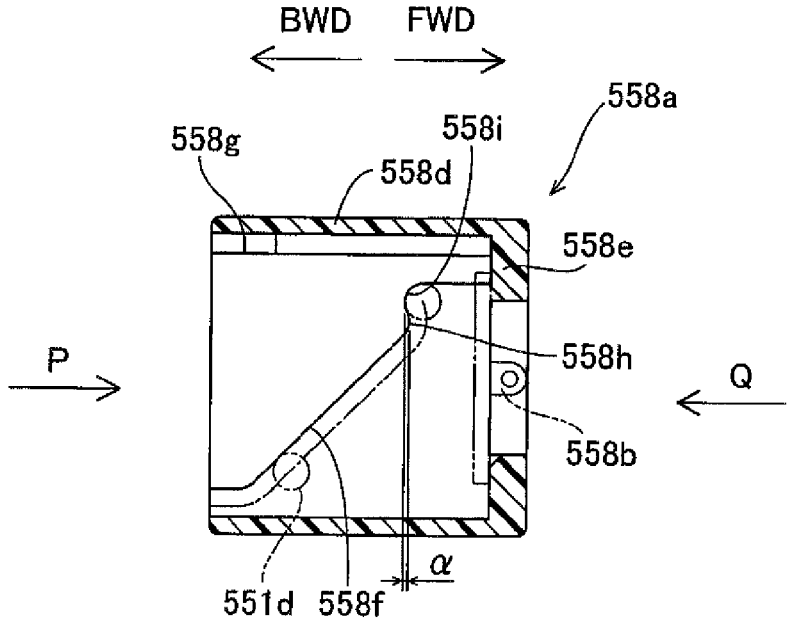
FIG. 33 is a sectional view for describing an arrangement of the cover member of the fuel supply system for an outboard motor according to the fourth preferred embodiment of the present invention.

As shown in FIG. 33, the main body member 558 includes a cylindrical portion 558*d* and a protruding portion 558*e* protruding inside the cylindrical portion 558*d*. The cylindrical portion 558*d* is arranged to be engageable with the pair of convex portions 551*d* of the main body side joint 551. In detail, on the inner peripheral surface of the cylindrical portion 558*d* of the main body member 558*a*, a pair of guide surfaces 558*f* are provided as in the case of the joint cover 555. Each guide surface 558*f* extends in the circumferential direction of the cylindrical portion 558*d* along the inner peripheral surface of the cylindrical portion 558*d* of the main body member 558*a*. Further, each guide surface 558*f* inclines with respect to the front-rear direction. Each guide surface 558*f* is arranged to guide the corresponding convex portion 551*d* to the accommodating portion 558*i* (fitting position).

Also, on an end portion on the arrow BWD direction side of the cylindrical portion 558*d* of the main body member 558*a*, a pair of openings 558*g* are provided. The pair of openings 558*g* are arranged corresponding to the pair of convex portions 551*d* of the main body side joint 551. Also, the pair of openings 558*g* are connected to the pair of guide surfaces 558*f*, respectively.

Each convex portion 551*d* of the main body side joint 551 is arranged to be pressed in the arrow FWD direction (the other side) by the corresponding guide surface 558*f* when the cover member 558 is rotated clockwise in a state in which each convex portion 551*d* is engaged with the corresponding guide surface 558*f*. Also, each convex portion 551*d* of the main body side joint 551 is arranged to move to the accommodating portion 558*i* as the fitting position when the cover member 558 is turned clockwise by approximately 170 degrees relative to the main body side joint 551 in a state in which each convex portion 551*d* is engaged with the corresponding guide surface 558*f*. In other words, by turning the cover member 558 by an angle less than one rotation (360 degrees) and less than a half rotation (180 degrees), each convex portion 551*d* of the main body side joint 551 moves to the corresponding accommodating portion 558*i*.

Also, on each guide surface 558*f*, a mountain portion 558*h* and an accommodating portion 558*i* are provided. Each mountain portion 558*f* is arranged to protrude to the arrow FWD direction side. Also, each accommodating portion 558*i* is provided adjacent to the corresponding mountain portion 558*h*. Each accommodating portion 558*i* is arranged to accommodate the convex portion 551*d* of the main body side joint 551 when the main body side joint 551 and the cover member 558 are connected. Further, each accommodating portion 558*i* is arranged to restrict the convex portion 551*d* of the main body side joint 551 from moving from the fitting position when the main body side joint 551 and the cover member 558 are connected.

Also, as shown in FIG. 32, the lid member 558*b* is arranged to cover the opening portion of the protruding portion 558*e*. In detail, the lid member 558*b* is sandwiched between the protruding portion 558*e* and the tip end portion 551*e* of the main body side joint 551 in a state in which the cover member 558 is fitted to the main body side joint 551. Also, the lid member 558*b* urges the tip end portion 551*e* of the main body side joint 551 and the protruding portion 558*e* in directions of separating from each other in the state in which the cover member 558 is fitted to the main body side joint 551. Therefore, the convex portions 551*d* of the main body side joint 551 are urged to the accommodating portions 558*i* of the guide surfaces 558*f* in the state in which the cover member 558 is fitted to the main body side joint 551.

Also, the string member 558*c* connects the main body side joint 551 and the lid member 558*b*. The string member 558*c* prevents the main body member 558*a* and the lid member 558*b* from coming off from the cover member 558.

FIG. 34 to FIG. 41 are views for describing operations of valve units when the main body side joint and the hose side joint are connected with the fuel supply system for an outboard motor of the fourth preferred embodiment. First, with reference to FIG. 28, FIG. 29, and FIG. 34 to FIG. 41, operations of the valve units 553 and 556 when the main body side joint 551 and the hose side joint 552*a* reconnected with the fuel supply system of the outboard motor 1 of the fourth preferred embodiment of the present invention will be described.

Figure 34:
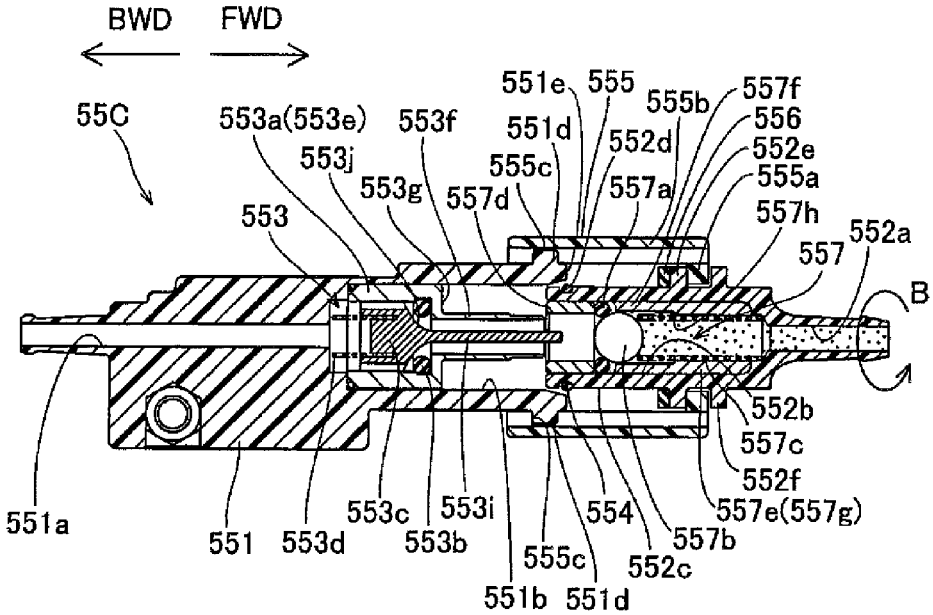
FIG. 34 is a view for describing operations of valve units when the main body side joint and the hose side joint are connected with the fuel supply system for an outboard motor of the fourth preferred embodiment of the present invention.

First, as shown in FIG. 34, the opening 552*b* of the hose side joint 552 is engaged with the opening 551*b* of the main body side joint 551. Further, the pair of openings 555*d* of the joint cover 555 and the pair of convex portions 551*d* of the main body side joint 551 are engaged with each other.

Thereafter, in the state in which the pair of convex portions 551*d* are engaged with the pair of openings 555*d*, respectively, the joint cover 555 is rotated in the direction B. Accordingly, each convex portion 551*d* moves along the corresponding guide surface 555*c*. Then, along with the movements of the convex portions 551*d*, the main body side joint 551 and the hose side joint 552 are moved in connecting directions relative to each other.

Figure 35:
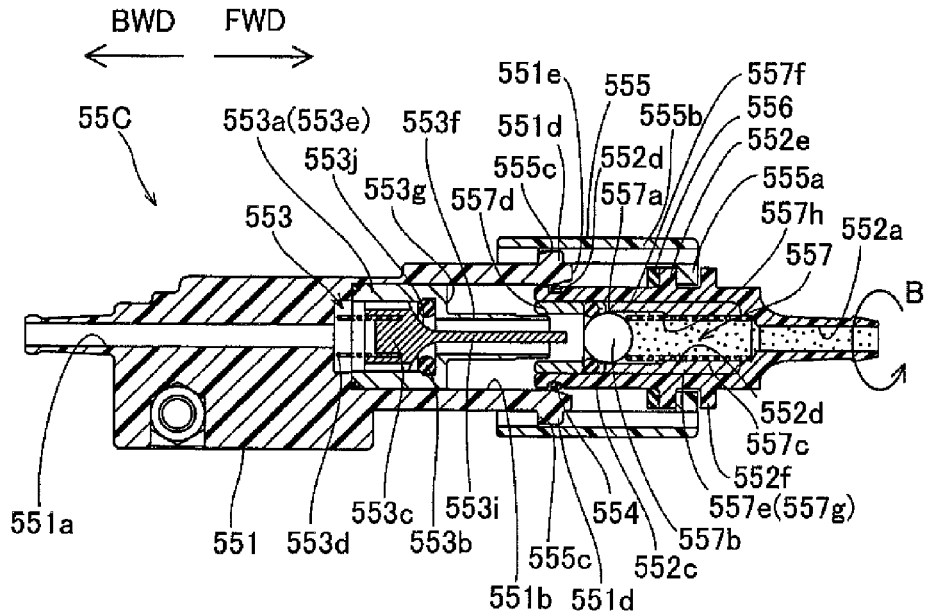
FIG. 35 is a view for describing operations of the valve units when the main body side joint and the hose side joint are connected with the fuel supply system for an outboard motor of the fourth preferred embodiment of the present invention.

Thereafter, as shown in FIG. 35, when the joint cover 555 is further rotated in the direction B, the opening 551*b* (inner peripheral surface) of the main body side joint 551 comes into contact with the O-ring 554 arranged in the groove portion 552*d* of the hose side joint 552. Accordingly, a gap between the opening 551*b* of the main body side joint 551 and the outer peripheral surface 552*c* of the hose side joint 552 is sealed.

Figure 36:
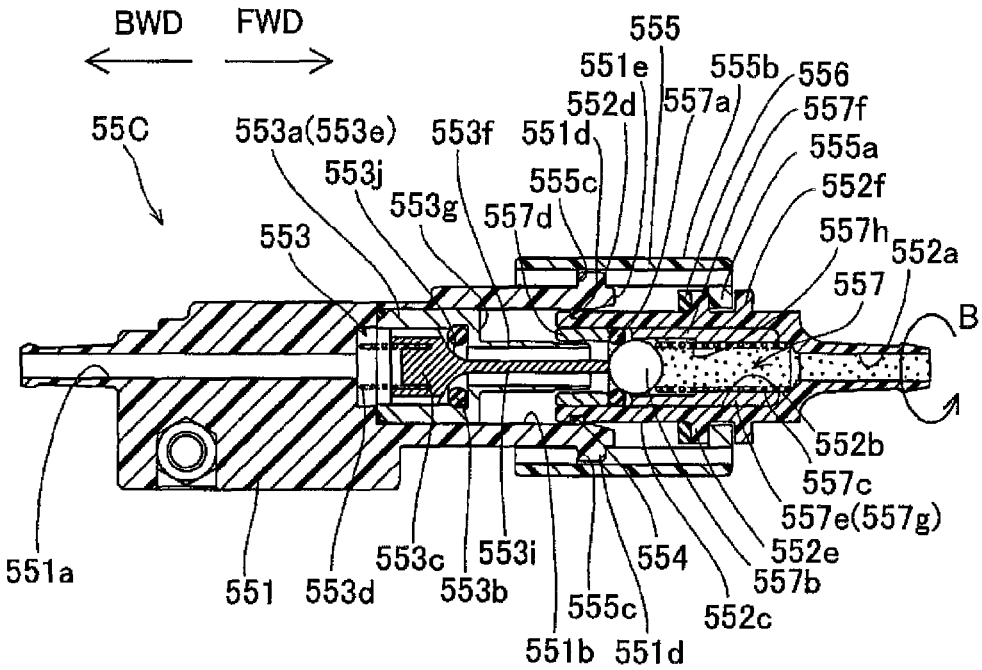
FIG. 36 is a view for describing operations of the valve units when the main body side joint and the hose side joint are connected with the fuel supply system for an outboard motor of the fourth preferred embodiment of the present invention.
Figure 37:
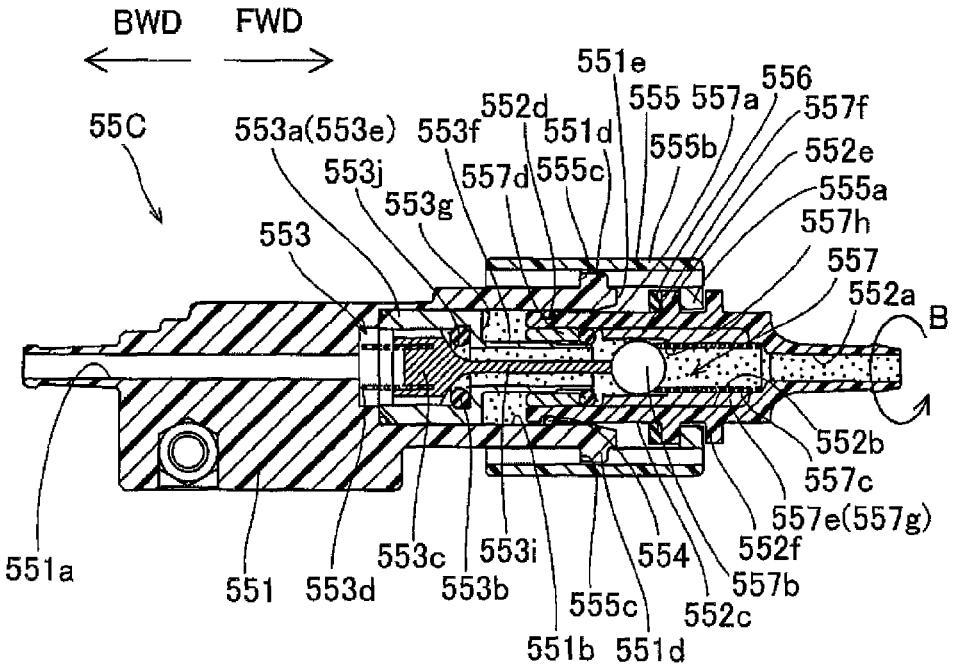
FIG. 37 is a view for describing operations of the valve units when the main body side joint and the hose side joint are connected with the fuel supply system for an outboard motor of the fourth preferred embodiment of the present invention.

Then, as shown in FIG. 36 and FIG. 37, when the joint cover 555 is further rotated in the direction B, the tip end portion of the projecting portion 553*i* and the spherical member 557*b* come into contact with each other. Also, the spherical member 557*b* is pressed to the arrow FWD direction side by the tip end portion of the projecting portion 553*i*. Accordingly, the spherical member 557*b* moves to the arrow FWD direction side against the urging force of the spring member 557*c*. Therefore, a gap is generated between the spherical member 557*b* and the O-ring 557*a*. As a result, the valve unit 557 of the hose side joint 552 is opened. Therefore, as shown in FIG. 37, fuel from the hose 54 side flows into the opening 551*b* of the main body side joint 551. At this time, a gap between the opening 551*b* of the main body side joint 551 and the outer peripheral surface 552*c* of the hose side joint 552 is sealed by the O-ring 554, such that the fuel which flew into the opening 551 does not substantially flow out to the outside.

Figure 38:
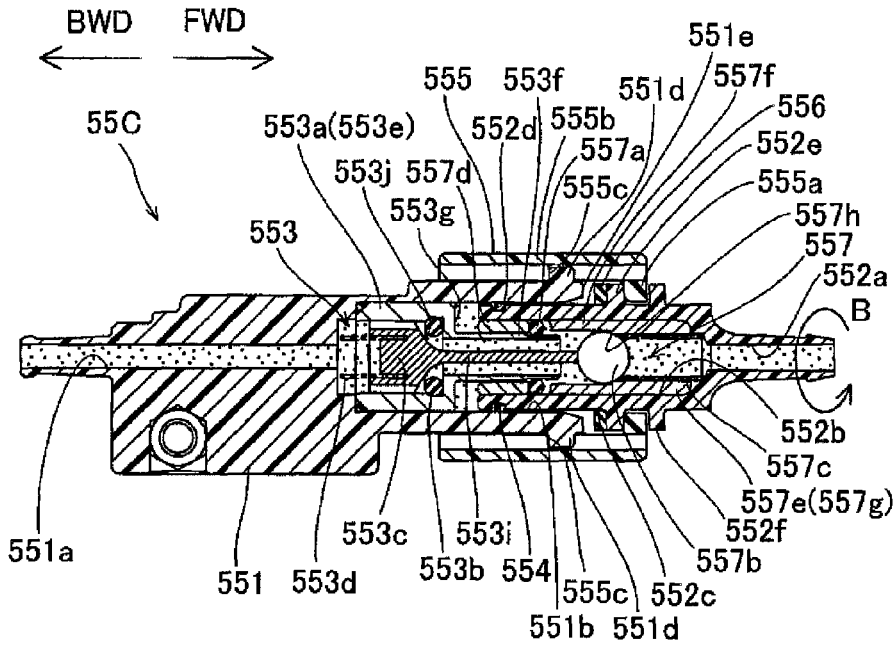
FIG. 38 is a view for describing operations of the valve units when the main body side joint and the hose side joint are connected with the fuel supply system for an outboard motor of the fourth preferred embodiment of the present invention.
Figure 39:
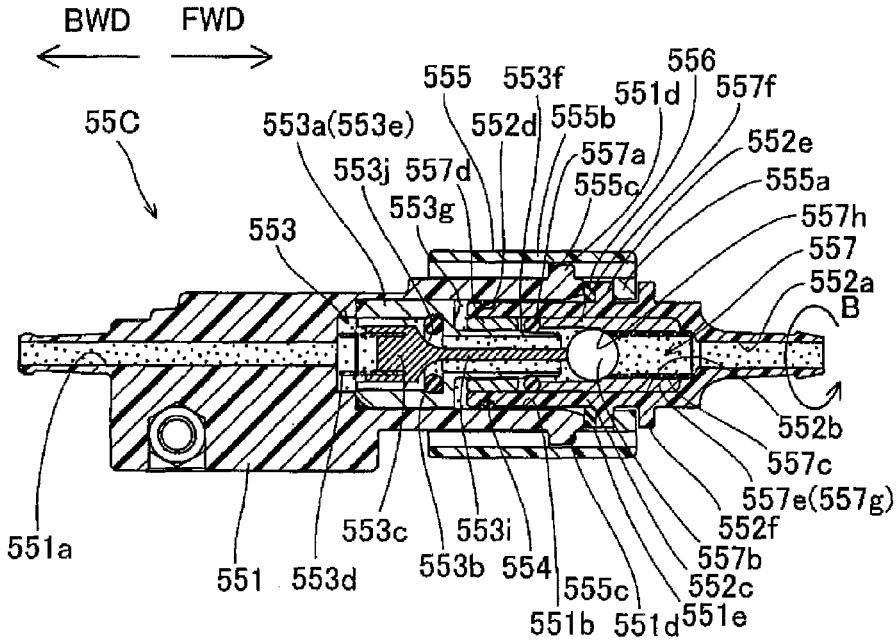
FIG. 39 is a view for describing operations of the valve units when the main body side joint and the hose side joint are connected with the fuel supply system for an outboard motor of the fourth preferred embodiment of the present invention.

Thereafter, as shown in FIG. 38 and FIG. 39, when the joint cover 555 is further rotated in the direction B, the spherical member 557*b* comes into contact with the step portion 557*h* of the hose side sleeve 557*e*. As a result, the projecting portion 553*i* is pressed in the arrow BWD direction. Therefore, the valve member 553*c* moves in the arrow BWD direction against an urging force of the spring member 553*d*. Accordingly, a gap is generated between the O-ring 553*b* and the connecting portion 553*j* of the valve member 553*c*. As a result, the fuel from the hose 54 side and the fuel which flew into the opening 551*b* flow into the passage portion 551*a*.

Figure 40:
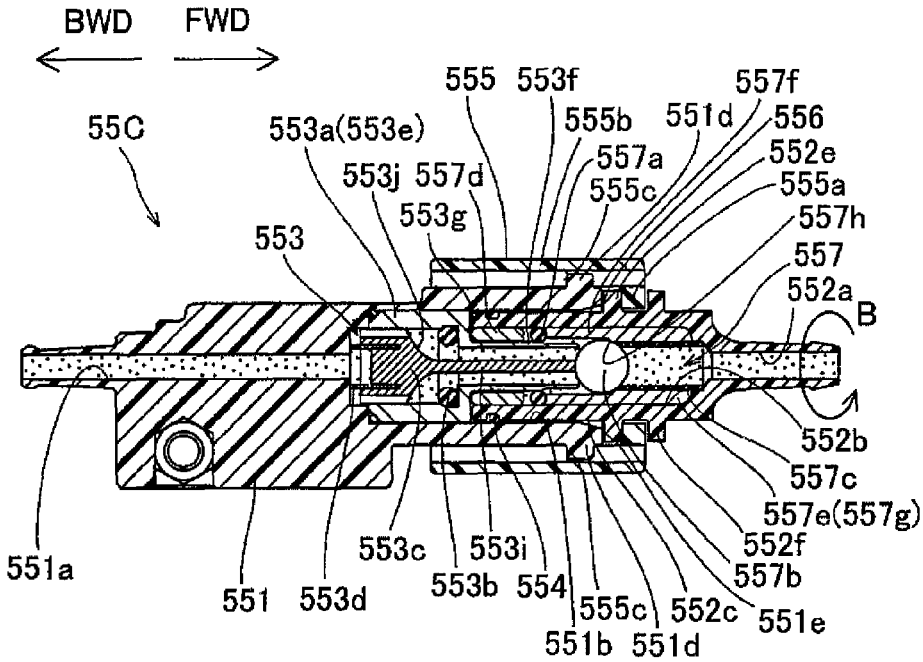
FIG. 40 is a view for describing operations of the valve units when the main body side joint and the hose side joint are connected with the fuel supply system for an outboard motor of the fourth preferred embodiment of the present invention.
Figure 41:
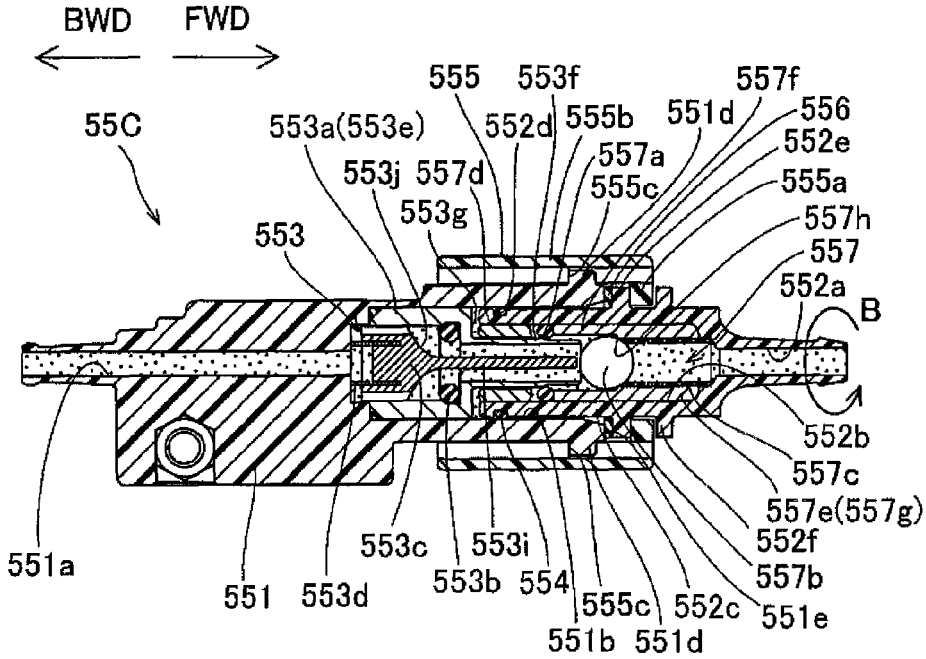
FIG. 41 is a view for describing operations of the valve units when the main body side joint and the hose side joint are connected with the fuel supply system for an outboard motor of the fourth preferred embodiment of the present invention.

Then, when the joint cover 555 is further rotated in the direction B, as shown in FIG. 28 and FIG. 29, the convex portions 551*d* of the main body side joint 551 reach the mountain portions 555*e* of the guide surfaces 555*c*. At this time, as shown in FIG. 40, the outer peripheral portion of the small-diameter portion 553*f* of the case member 553*a* and the O-ring 557*a* are brought into linear contact with each other, and the fuel from the hose 54 side directly flows into the passage portion 551*a* via the inside of the case member 553*a*. Further, the damper 556 is sandwiched by the surface on the arrow BWD direction side of the flange portion 552*e* of the hose side joint 552 and the tip end portion 551*e* on the arrow FWD direction side of the main body side joint 551. Accordingly, the damper 556 is compressed. Therefore, an elastic force is generated on the damper 556. By this elastic force of the damper 556, the surface in the arrow BWD direction side of the flange portion 552*e* and the tip end portion 551*e* of the main body side joint 551 are pressed in directions of separating from each other. Accordingly, the hose side joint 552 and the main body side joint 551 are urged in directions of separating from each other.

Thereafter, when the joint cover 555 is further rotated in the direction B, as shown in FIG. 28 and FIG. 29, the convex portions 551*d* of the main body side joint 551 move over the mountain portions 555*e* of the guide surface 555*c* and are accommodated in the accommodating portions 555*f*. Also, at this time, the valve member 553*c* (projecting portion 553*i*) of the valve unit 553 and the spherical member 557*b* of the valve unit 557 press each other by the urging forces of the spring members 553*d* and 557*c*. Therefore, it is hard for the convex portions 551*d* to separate from the accommodating portions 555*f*. Further, the damper 556 urges the hose side joint 552 and the main body side joint 551 in directions of separating from each other. Therefore, the convex portions 551*d* are urged to the accommodating portions 555*f*. Therefore, it is more difficult for the convex portions 551*d* to separate from the accommodating portions 555*f*. Accordingly, the main body side joint 551 and the hose side joint 552 are connected.

Next, technical effects in the outboard motor and the fuel supply system for the same of the fourth preferred embodiment of the present invention will be exemplified hereinafter.

In the fourth preferred embodiment, when the main body side joint 551 and the hose side joint 552 are connected, the pair of guide surfaces 555*c* of the joint cover 555 are engaged with the convex portions 551*d* of the main body side joint 551, respectively. Then, in this state, the joint cover 555 is turned by a predetermined angle (approximately 170 degrees) in a predetermined direction (direction B) relative to the main body side joint 551. Accordingly, each convex portion 551*d* moves to the connecting position along the corresponding guide surfaces 555*c* and the main body side joint 551 and the hose side joint 552 are connected. In other words, the main body side joint 551 and the hose side joint 552 can be connected simply by turning the joint cover 555. Therefore, a user can connect the main body side joint 551 and the hose side joint 552 with a force smaller than in the case in which the main body side joint 551 and the hose side joint 552 are pressed to each other. Accordingly, the workability of the user when connecting the joint unit 55C can be improved.

Also, in the fourth preferred embodiment, when the main body side joint 551 and the hose side joint 552 are connected, the joint cover 555 is turned by an angle (approximately 170 degrees) less than one rotation in a predetermined direction (direction B) relative to the main body side joint 551. Therefore, different from the case in which the joint cover 555 is rotated a plurality of times, an operator can connect the main body side joint 551 and the hose side joint 552 by turning the joint cover 555 substantially only once. Therefore, the workability of the operator can be further improved.

Also, in the fourth preferred embodiment, on the main body side joint 551, the pair of convex portions 551*d* are provided. Further, on the joint cover 555, the pair of guide surfaces 555*c* corresponding to the pair of convex portions 551*d* of the main body side joint 551 are provided. The pair of convex portions 551*d* are engageable with the pair of guide surfaces 555*c*, respectively. Therefore, by engaging the pair of convex portions 551*d* with the pair of guide surfaces 555*c*, the main body side joint 551 and the joint cover 555 can be firmly engaged with each other.

Also, in the fourth preferred embodiment, the pair of convex portions 551*d* of the main body side joint 551 are pressed in a direction of approaching the main body side joint 551 by the pair of guide surfaces 555*c* of the joint cover 555 when the joint cover 555 is turned in the predetermined direction. Accordingly, each guide surface 555*c* is pressed in a direction of approaching the main body side joint 551 by the corresponding convex portion 551*d*. Therefore, the joint cover 555 can be moved in a direction of approaching the main body side joint 551. Further, together with the joint cover 555, the hose side joint 552 can be moved in a direction of approaching the main body side joint 551. Accordingly, the main body side joint 551 and the hose side joint 552 can be connected easily.

Also, in the fourth preferred embodiment, the accommodating portion 555*f* is provided on each guide surface 555*c*. Each accommodating portion 555*f* restricts the convex portion 551*d* from moving from the connecting position when the convex portion 551*d* of the main body side joint 551 reaches the connecting position and the main body side joint 551 and the hose side joint 552 are connected. Therefore, after the main body side joint 551 and the hose side joint 552 are connected, the convex portions 551*d* can be prevented from moving from the connecting positions along the guide surfaces 555*c*. Therefore, the main body side joint 551 and the hose side joint 552 being connected to each other can be prevented from separating from each other.

Also, in the fourth preferred embodiment, the pair of flange portions 552*e* and 552*f* are provided on the hose side joint 552. The pair of flange portions 552*e* and 552*f* are opposed to each other via a predetermined space in the front-rear direction. The protruding portion 555*a* of the joint cover 555 is held between the pair of flange portions 552*e* and 552*f*. Therefore, when the joint cover 555 is turned to move in the arrow BWD direction, the protruding portion 555*a* of the joint cover 555 presses the flange portion 552*e* in the arrow BWD direction. Accordingly, the hose side joint 552 can be moved in a direction of connection to the main body side joint 551. Also, when the joint cover 555 is turned such that the joint cover 555 moves in the arrow FWD direction, the protruding portion 555*a* of the joint cover 555 presses the flange portion 552*f* in the arrow FWD direction. Accordingly, the hose side joint 552 can be moved in a direction opposite to the direction of connection to the main body side joint 551.

Also, in the fourth preferred embodiment, the damper 556 is provided on the joint unit 55*c*. The damper 556 is arranged to urge the convex portions 551*d* of the main body side joint 551 toward the accommodating portions 555*f* of the guide surfaces 555*c* after the main body side joint 551 and the hose side joint 552 are connected. Therefore, after the main body side joint 551 and the hose side joint 552 are connected, the convex portions 551*d* of the main body side joint 551 can be prevented from separating from the accommodating portions 555*f* of the guide surfaces 555*c* by the damper 556. Accordingly, the main body side joint 551 and the hose side joint 552 can be prevented from separating from each other.

Also, in the fourth preferred embodiment, the cover member 558 is provided on the joint unit 55C. The cover member 558 can cover the opening 551*b* of the main body side joint 551 when the main body side joint 551 and the hose side joint 552 separate from each other. Therefore, when the main body side joint 551 and the hose side joint 552 separate from each other, entrance of dust, etc., into the inside of the main body side joint 551 can be prevented.

Fifth Preferred Embodiment

Figure 42:
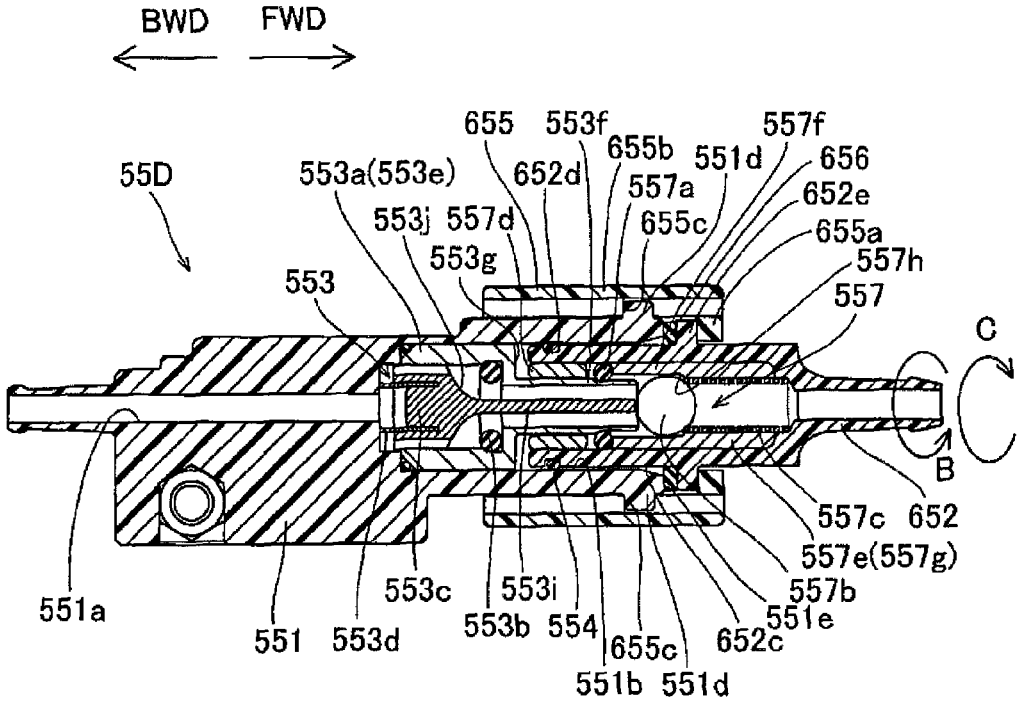
FIG. 42 is a view for describing an arrangement of a joint unit and a joint cover of a fuel supply system for an outboard motor of a fifth preferred embodiment of the present invention.
Figure 43:
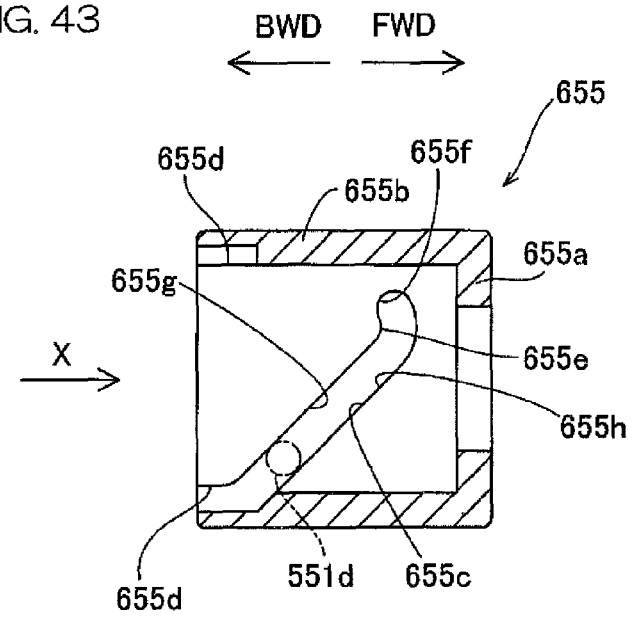
FIG. 43 is a sectional view for describing an arrangement of the joint cover of the fuel supply system for an outboard motor of the fifth preferred embodiment of the present invention.
Figure 44:
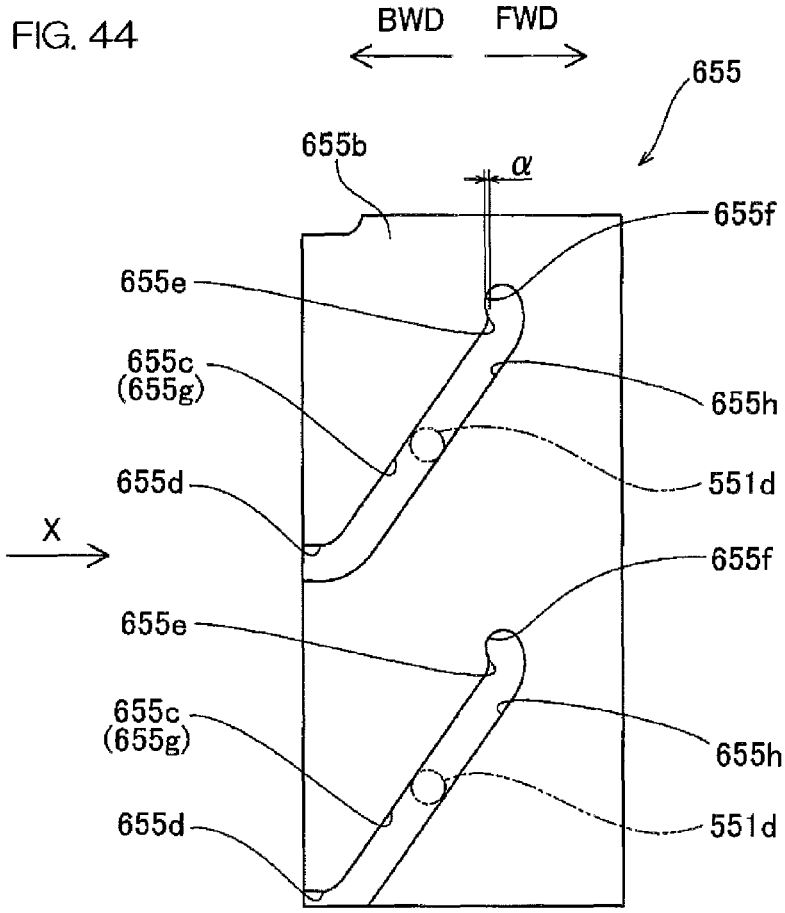
FIG. 44 is a development view for describing an arrangement of an inner peripheral surface of the joint cover of the fuel supply system for an outboard motor of the fifth preferred embodiment of the present invention.

FIG. 42 is a view for describing an arrangement of a joint unit and a joint cover of a fuel supply system for an outboard motor of a fifth preferred embodiment of the present invention. FIG. 43 and FIG. 44 are views for describing an arrangement of the joint cover of the fuel supply system for an outboard motor of the fifth preferred embodiment of the present invention. Hereinafter, an arrangement of the fuel supply system for an outboard motor of the fifth preferred embodiment of the present invention will be described with reference to FIG. 42 to FIG. 44. Different from the fourth preferred embodiment described above, the fifth preferred embodiment describes an example in which guide surfaces 655*c* of a joint cover 655 of a joint unit 55D have groove shapes.

As shown in FIG. 42, on the outer peripheral surface 652*c* of the hose side joint 652, one flange portion 652*e* is provided. The flange portion 652*e* has a disk shape. The flange portion 652*a* is arranged on the arrow FWD direction side of a groove portion 652*d*. In detail, the flange portion 652*e* is provided at substantially the center in the front-rear direction of the outer peripheral surface 652*c* of a hose side joint 652. The hose side joint 652 is an example of a second joint member according to a preferred embodiment of the present invention.

Also, a protruding portion 655*a* of the joint cover 655 is arranged adjacent to a surface on the arrow FWD direction side of the flange portion 652*e*. The joint cover 655 is an example of a cover member and a connecting member according to a preferred embodiment of the present invention. The joint cover 655 is made of, for example, a resin. The joint cover 655 includes the protruding portion 655*a* and a cylindrical cover portion 655*b*. In the groove portion 652*d* of the hose side joint 652, an O-ring 554 is arranged. The cover portion 655*b* is arranged to cover the O-ring 554 via a predetermined space.

Also, the joint cover 655 is arranged to be engageable with a pair of convex portions 551*d* of the outer peripheral portion 551*c* of the main body side joint 551. In detail, as shown in FIG. 42 to FIG. 44, on the inner peripheral surface of the cover portion 655*b* of the joint cover 655, a pair of guide surfaces 655*c* are provided. As shown in FIG. 43 and FIG. 44, each guide surface has a groove shape. Each guide surface 655*c* is an example of a concave portion and a guide groove according to a preferred embodiment of the present invention. Each guide surface 655*c* extends in the circumferential direction of the cover portion 655*b* along the inner peripheral surface of the cover portion 655*b*. Each guide surface 655*c* inclines with respect to the front-rear direction. Each guide surface 655*c* is arranged to guide the convex portion 551*d* (see FIG. 42) to accommodating portion 655*f* (connecting position).

When the joint cover 655 is rotated clockwise (direction B of FIG. 42) in a state in which the pair of convex portions 551*d* (see FIG. 42) of the main body side joint 551 are engaged with the pair of guide surfaces 655*c*, respectively, each convex portion 551*d* comes into contact with and is pressed by one side surface 655*g* of the corresponding guide surface 655*c*. In other words, the joint cover 655 is arranged to move in the arrow BWD direction when it is rotated clockwise (direction B of FIG. 42). Accordingly, the main body side joint 551 and the hose side joint 652 can be moved in directions of connection to each other.

On the other hand, when the joint cover 655 is rotated counterclockwise (direction C of FIG. 42) in the state in which the pair of convex portions 551*d* (see FIG. 42) of the main body side joint 551 are engaged with the pair of guide surfaces 655*c*, respectively, each convex portion 551*d* comes into contact with and is pressed by the other side surface 655*h* of the corresponding guide surface 655*c*. In other words, the joint cover 655 is arranged to move in the arrow FWD direction when it is rotated counterclockwise (direction C of FIG. 42). Accordingly, the main body side joint 551 and the hose side joint 652 can be moved in directions of separating from each other.

Also, on an end portion on the arrow BWD direction side of the cover portion 655*b*, a pair of openings 655*d* are provided. The pair of openings 655*d* are arranged corresponding to the pair of convex portions 551*d* (see FIG. 42) of the main body side joint 551. Also, the pair of openings 655*d* are connected to the pair of guide surfaces 655*c*, respectively.

Also, each guide surface 655*c* is arranged to extend across a rotation angle of approximately 170 degrees on the inner peripheral surface of the cover portion 655*b* as viewed from the front side (arrow X direction of FIG. 43 and FIG. 44). The main body side joint 551 and the hose side joint 652 are connected by turning of the joint cover 655 by approximately 170 degrees. In detail, as shown in FIG. 42, the guide surfaces 655*c* of the joint cover 655 are engaged with the convex portions 551*d* of the main body side joint 551. Then, in this state, the joint cover 655 is turned clockwise by approximately 170 degrees relative to the main body side joint 551. The convex portions 551*d* of the main body side joint 551 move to the accommodating portions 655*f* along with turning of the joint cover 655, and reach the accommodating portions 655*f* (see FIG. 43 and FIG. 44). Accordingly, the main body side joint 551 and the hose side joint 652 are connected.

Also, as shown in FIG. 43 and FIG. 44, on each guide surface 655*c*, a mountain portion 655*e* and the accommodating portion 655*f* are provided. Each mountain portion 655*e* is arranged to protrude to the arrow FWD direction side. Also, each accommodating portion 655*f* is provided adjacent to the corresponding mountain portion 655*e*. Each accommodating portion 655*f* is arranged to accommodate the convex portion 551*d* (see FIG. 42) of the main body side joint 551 at a connecting position when the main body side joint 551 (see FIG. 42) and the hose side joint 652 (see FIG. 42) are connected. Further, each accommodating portion 655*f* is arranged to restrict the convex portion 551*d* (see FIG. 42) of the main body side joint 551 from moving from the connecting position when the main body side joint 551 (see FIG. 42) and the hose side joint 652 (see FIG. 42) are connected. The accommodating portion 655 is an example of a movement restricting portion according to a preferred embodiment of the present invention.

Also, when the main body side joint 551 and the hose side joint 652 are connected to each other, on the main body side joint 551 and the hose side joint 652, forces in directions of separating from each other are generated due to reaction forces of the spring members 553*d* and 557*c* and a damper 656 described later. Therefore, each convex portion 551*d* (see FIG. 43 and FIG. 44) is pressed in the arrow BWD direction to the corresponding accommodating portion 655*f*. Therefore, the state in which each convex portion 551*d* is accommodated in the corresponding accommodating portion 655*f* is reliably kept. As shown in FIG. 44, the distance $\alpha$ in the front-rear direction between the mountain portion 655*e* and the accommodating portion 655*f* of the guide surface 655*c* is, for example, approximately 0.5 millimeters.

Also, as shown in FIG. 42, on the arrow BWD direction side of the flange portion 652*e* of the hose side joint 652, a damper 656 is arranged. The damper 656 is made of, for example, rubber. The damper 656 has substantially the same shape as the disk-shaped flange portion 652*e*. The damper 656 is sandwiched by the tip end portion 551*e* of the main body side joint 551 and the flange portion 652*e* when the main body side joint 551 and the hose side joint 652 are connected. Therefore, when the main body side joint 551 and the hose side joint 652 are connected, the damper 656 urges the tip end portion 551*e* of the main body side joint 551 and the flange portion 652*e* in directions of separating from each other. Accordingly, each convex portion 551*d* is urged to the accommodating portion 656*f* (see FIG. 43 and FIG. 44) of the corresponding guide surface 655*c*.

Next, technical effects in the outboard motor and the fuel supply system for the same of the fifth preferred embodiment of the present invention will be exemplified, hereinafter.

In the fifth preferred embodiment, each guide surface 655*c* has a groove shape. Each convex portion 551*d* can press both surfaces, that is, one side surface 655*g* and the other side surface 655*h* of the groove-shaped guide surface 655*c*. Therefore, by turning the joint cover 655 in a predetermined direction (direction B of FIG. 42), the joint cover 655 can be moved in the one side direction (arrow BWD Direction). Also, by turning the joint cover 655 in a direction (direction C of FIG. 42) opposite to the predetermined direction, the joint cover 655 can be moved in the other side direction (arrow FWD direction). Accordingly, the main body side joint 551 and the hose side joint 652 can be easily connected to and separated from each other.

Other structures and operations of the fifth preferred embodiment are the same as those of the fourth preferred embodiment described above.

Sixth Preferred Embodiment

Figure 45:
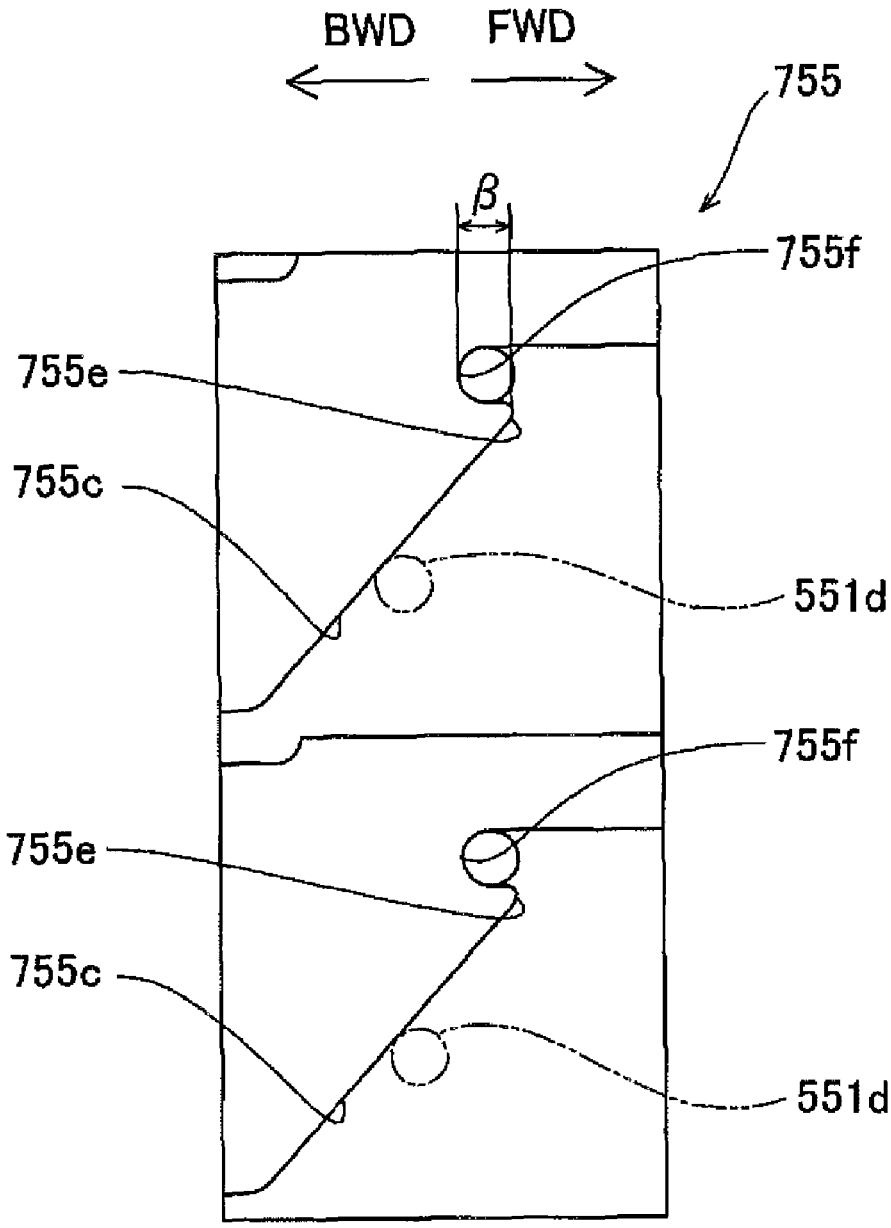
FIG. 45 is a development view for describing an arrangement of an inner peripheral surface of a joint cover of a fuel supply system for an outboard motor of a sixth preferred embodiment of the present invention.

FIG. 45 is a sectional view for describing an arrangement of a joint cover of a fuel supply system for an outboard motor of a sixth preferred embodiment of the present invention. Hereinafter, with reference to FIG. 25, FIG. 26, and FIG. 45, an arrangement of the fuel supply system for an outboard motor of the sixth preferred embodiment of the present invention will be described in detail. The sixth preferred embodiment describes an example in which, different from the fourth preferred embodiment described above, the dimension between an accommodating portion 755*f* and a mountain portion 755*e* of a guide surface 755*c* of a joint cover 755 is substantially equal to the outer diameter of the convex portion 551*d*.

As shown in FIG. 45, on each guide surface 755*c*, the mountain portion 755*e* and the accommodating portion 755*f* are provided. The joint cover 755 is an example of a connecting member according to a preferred embodiment of the present invention. Each guide surface 755*c* is an example of a concave portion and a guide surface according to a preferred embodiment of the present invention. Each mountain portion 755*e* is arranged to protrude to the arrow FWD direction side. Also, each accommodating portion 755*f* is provided adjacent to the corresponding mountain portion 755*e*. Each accommodating portion 755*f* is arranged to accommodate the convex portion 551*d* of the main body side joint 551 at the connecting position when the main body side joint 551 (see FIG. 25) and the hose side joint 552 (see FIG. 26) are connected. Further, each accommodating portion 755*f* is arranged to restrict the convex portion 551*d* of the main body side joint 551 from moving from the connecting position when the main body side joint 551 and the hose side joint 552 are connected. The accommodating portion 755*f* is an example of a movement restricting portion according to a preferred embodiment of the present invention. Also, the dimension β (see FIG. 45) between the accommodating portion 755*f* and the mountain portion 755*e* of the guide surface 755*c* of the joint cover 755 is substantially equal to the outer diameter of the convex portion 551*d*. Accordingly, the convex portions 551*d* can be reliably prevented from separating from the accommodating portions 755*f*.

Other structures and effects of the sixth preferred embodiment are the same as those of the fourth preferred embodiment described above.

Seventh Preferred Embodiment

Figure 46:
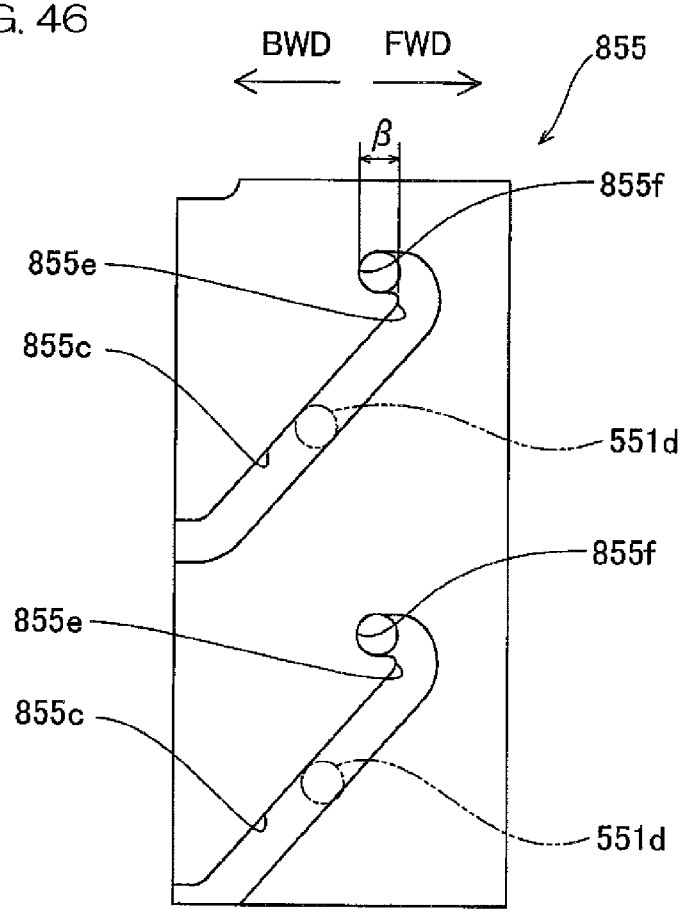
FIG. 46 is a development view for describing an arrangement of an inner peripheral surface of a joint cover of a fuel supply system for an outboard motor of a seventh preferred embodiment of the present invention.

FIG. 46 is a sectional view for describing an arrangement of a joint cover of a fuel supply system for an outboard motor of a seventh preferred embodiment of the present invention. Hereinafter, with reference to FIG. 42 and FIG. 46, an arrangement of the fuel supply system for an outboard motor of the seventh preferred embodiment of the present invention will be described in detail. The seventh preferred embodiment describes an example in which, different from the fifth preferred embodiment described above, the dimension between an accommodating portion 855*f* and a mountain portion 855*e* of a guide surface 855*c* of a joint cover 855 is substantially equal to the outer diameter of the convex portion 551*d*.

As shown in FIG. 46, on each guide surface 855*c* of the joint cover 855, the mountain portion 855*e* and the accommodating portion 855*f* are provided. The joint cover 855 is an example of a cover member and a connecting member according to a preferred embodiment of the present invention. Also, the guide surface 855*c* is an example of a concave portion and a guide groove according to a preferred embodiment of the present invention. Each mountain portion 855*e* is arranged to protrude to the arrow FWD direction side. Also, each accommodating portion 855*f* is provided adjacent to the corresponding mountain portion 855*e*. Each accommodating portion 855*f* is arranged to accommodate the convex portion 551*d* of the main body side joint 551 at the connecting position when the main body side joint 551 (see FIG. 42) and the hose side joint 652 (see FIG. 42) are connected to each other. Further, each accommodating portion 855*f* is arranged to restrict the convex portion 551*d* of the main body side joint 551 from moving from the connecting position when the main body side joint 551 and the hose side joint 652 are connected. The accommodating portion 855*f* is an example of a movement restricting portion according to a preferred embodiment of the present invention.

Also, as shown in FIG. 42, on the main body side joint 551 and the hose side joint 652, forces in directions of separating from each other are generated by reaction forces of the spring members 553*d* and 557*c* and the damper 656. Each convex portion 551*d* is accommodated in the accommodating portion 855*f* (see FIG. 46) by the separating forces. Also, as shown in FIG. 46, the dimension β between the accommodating portion 855*f* and the mountain portion 855*e* is substantially equal to the outer diameter of the convex portion 551*d*. Accordingly, the convex portions 551*d* can be reliably prevented from separating from the accommodating portions 855*f*.

Other structures and effects of the seventh preferred embodiment are the same as those of the fifth preferred embodiment described above.

Eighth Preferred Embodiment

FIG. 47 to FIG. 52 are views for describing an arrangement of an outboard motor and a fuel supply system for the same of an eighth preferred embodiment of the present invention. Next, with reference to FIG. 47 to FIG. 52, an arrangement of the fuel supply system for an outboard motor of the eighth preferred embodiment of the present invention will be described in detail. The eighth preferred embodiment describes an example in which, different from the fourth to seventh preferred embodiments described above, guide surfaces 951*d* are provided on the main body side joint 951, and convex portions 955*c* engageable with the guide surfaces 951*d* are provided on the joint cover 955.

Figure 49:
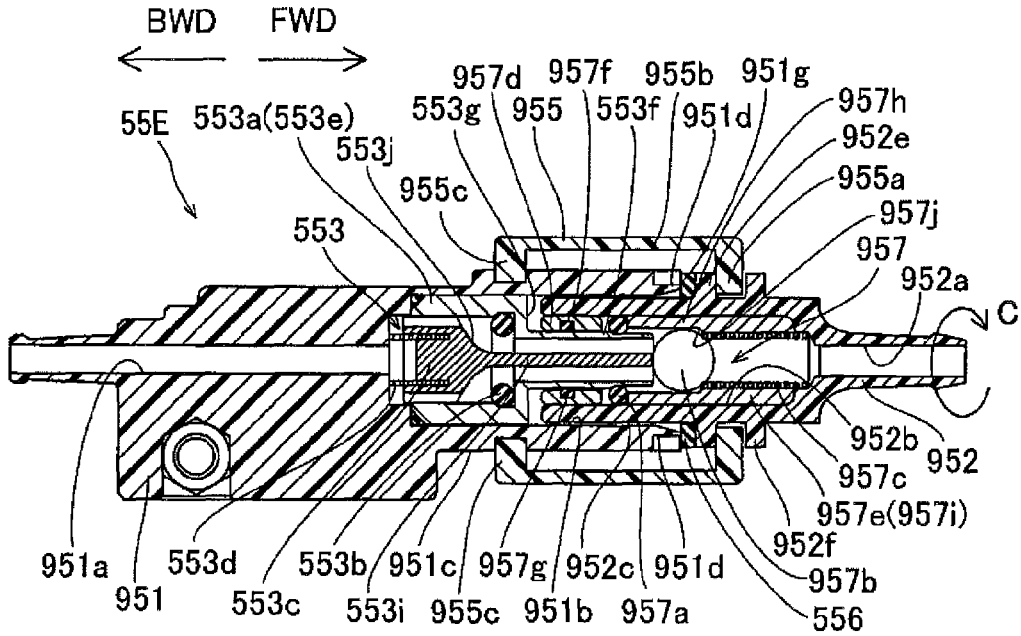
FIG. 49 is a sectional view for describing a structure of a joint unit of the fuel supply system for an outboard motor of the eighth preferred embodiment of the present invention.

As shown in FIG. 49, the joint unit 55E includes a main body side joint 951, and a hose side joint 952 arranged to be connectable to the main body side joint 951. The main body side joint 951 is an example of a first joint member according to a preferred embodiment of the present invention, and the hose side joint 952 is an example of a second joint member according to a preferred embodiment of the present invention.

Figure 47:
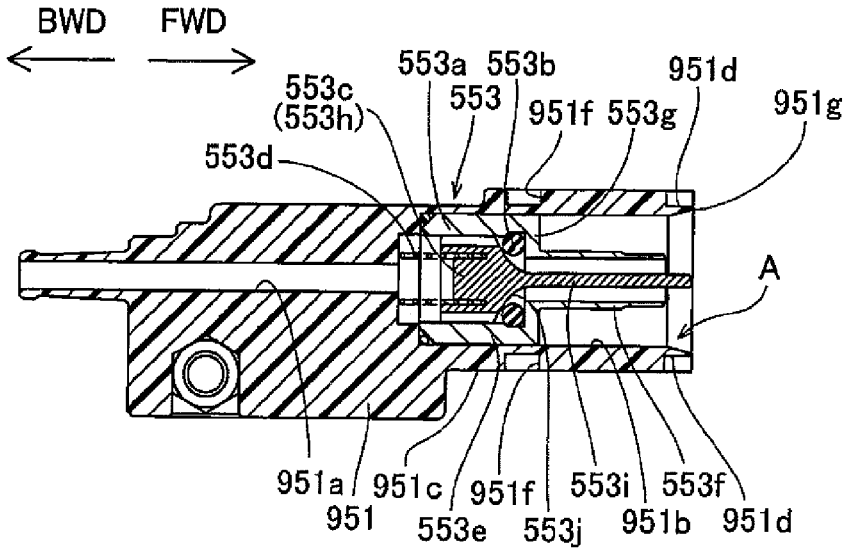
FIG. 47 is a sectional view for describing a structure of a main body side joint of a fuel supply system for an outboard motor of an eighth preferred embodiment of the present invention.

As shown in FIG. 47, the main body side joint 951 is made of, for example, a resin. Inside the main body side joint 951, a passage portion 951*a* arranged to extend in the front-rear direction in which a fuel can flow is provided. Also, on the arrow FWD direction side of the passage portion 951*a*, an opening 951*b* with a diameter larger than that of the passage portion 951*a* is provided. The opening 951*b* is arranged to extend in the front-rear direction similar to the passage portion 951*a*. In the opening 951*b*, a portion on the side (arrow FWD direction side) to be connected to the hose side joint 952 is a tip end portion 951*b* (front end portion) of the opening 951*b*. The vicinity A of the front end portion 951*b* of the opening 951*b* is arranged to increase (expand) in diameter of the opening 951*b* as it goes to the tip end portion 951*g*.

Figure 50:
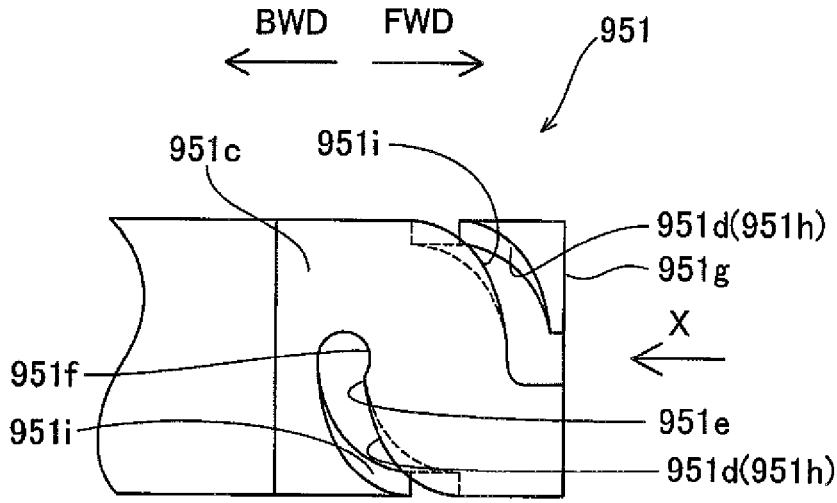
FIG. 50 is a side view for describing an arrangement of an outer peripheral surface of the main body side joint of the fuel supply system for an outboard motor of the eighth preferred embodiment of the present invention.
Figure 51:
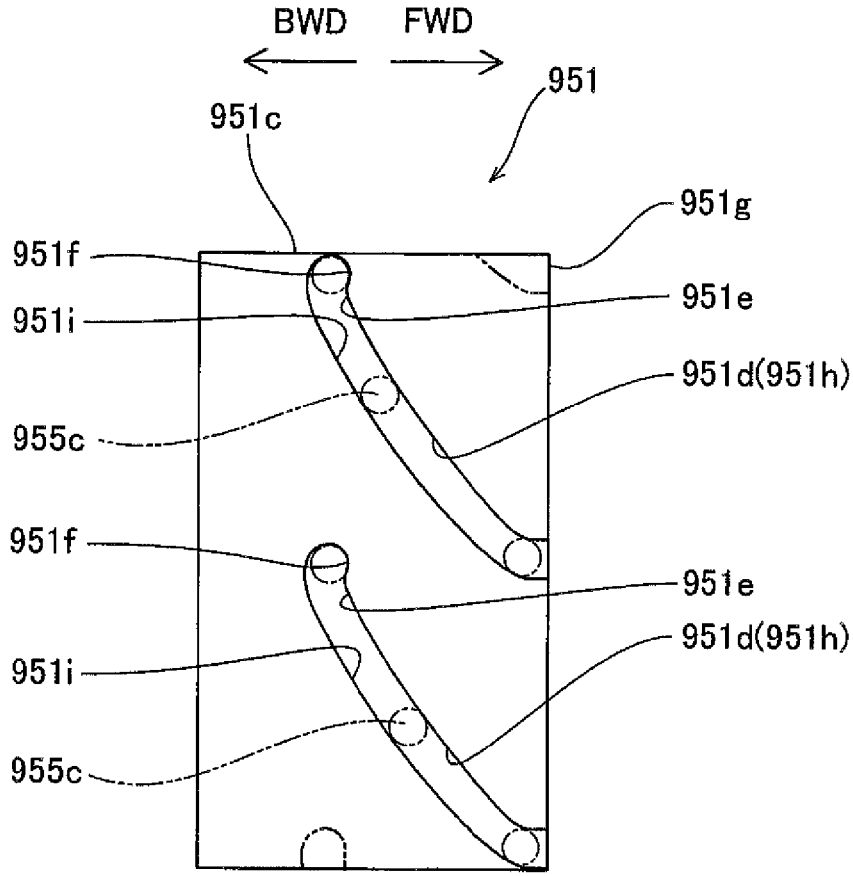
FIG. 51 is a development view for describing an arrangement of the outer peripheral surface of the main body side joint of the fuel supply system for an outboard motor of the eighth preferred embodiment of the present invention.
Figure 52:
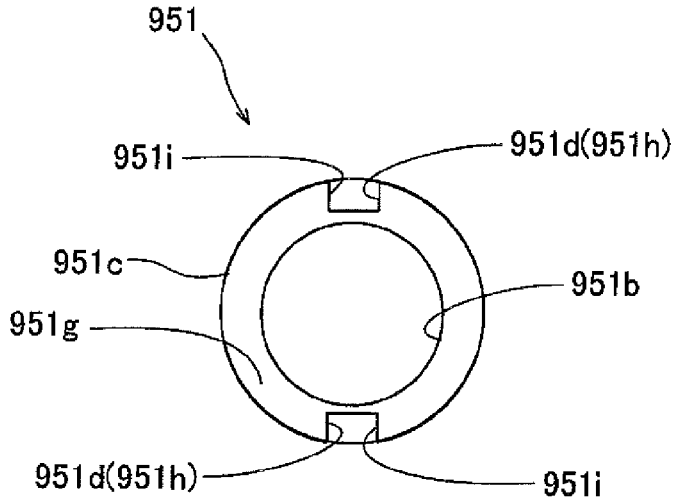
FIG. 52 is a view from the arrow X direction of FIG. 50.

As shown in FIG. 47 and FIG. 50 to FIG. 52, on the outer peripheral portion 951*c* of the opening 951*b* of the main body side joint 951, a pair of guide surfaces 951*d* are provided. Each guide surface 951*d* has a groove shape. Each guide surface 951*d* is recessed inward of the opening 951*b*. Each guide surface 951*d* is an example of a concave portion and a guide groove according to a preferred embodiment of the present invention. As shown in FIG. 50 and FIG. 51, each guide surface 951*d* extends in the circumferential direction of the outer peripheral portion 951*c* along the outer peripheral portion 951*c*. Further, each guide surface 951*c* inclines with respect to the front-rear direction. Each guide surface 951*d* is arranged to guide a convex portion 955*c* to an accommodating portion 951*f* (connecting position). In other words, each guide surface 951*d* is arranged to press the convex portion 955*c* in the arrow BWD direction when the joint cover 955 is rotated clockwise (direction C) in a state in which each guide surface 951*d* is engaged with the corresponding convex portion 955*c*.

When the joint cover 955 is rotated clockwise (direction C) in the state in which the convex portions 955*c* (see FIG. 48) of the joint cover 955 are engaged with the guide surfaces 951*d*, the convex portions 955*c* come into contact with and are pressed by one side surfaces 951*h* of the guide surfaces 951*d*. In other words, the joint cover 955 is arranged to move in the arrow BWD direction when it is rotated clockwise (direction C). Accordingly, the main body side joint 951 and the hose side joint 952 can be moved in directions of connection to each other.

On the other hand, when the joint cover 955 is rotated counterclockwise (direction opposite to the direction C) in the state in which the convex portions 955*c* (see FIG. 48) of the joint cover 955 are engaged with the guide surfaces 951*d*, the convex portions 955*c* come into contact with and are pressed by the other side surfaces 951*i* of the guide surfaces 951*d*. In other words, the joint cover 955 is arranged to move in the arrow FWD direction when it is rotated counterclockwise (direction opposite to the direction C). Accordingly, the main body side joint 951 and the hose side joint 952 can be moved in directions of separating from each other.

Also, as shown in FIG. 50 and FIG. 51, the guide surfaces 951*d* are arranged to extend across a rotation angle of approximately 180 degrees on the outer peripheral portion 951*c* of the opening 951*b*. The main body side joint 951 and the hose side joint 952 are connected to each other by turning of the joint cover 955 by approximately 180 degrees. In detail, as shown in FIG. 49, the convex portions 955*c* of the joint cover 955 are engaged with the guide surfaces 951*d* of the main body side joint 951. Then, in this state, the joint cover 955 is turned clockwise (direction C) by approximately 180 degrees relative to the main body side joint 951. The convex portions 955*c* of the joint cover 955 move to the accommodating portions 951*f* along with turning of the joint cover 955 and reach the accommodating portions 951*f*. Accordingly, the main body side joint 951 and the hose side joint 952 are connected to each other.

Also, as shown in FIG. 50 and FIG. 51, on each guide surface 951*d*, a mountain portion 951*e* and an accommodating portion 951*f* are provided. Each mountain portion 951*e* is arranged to protrude to the arrow BWD direction side. Also, each accommodating portion 951*f* is provided adjacent to the corresponding mountain portion 951*e*. Each accommodating portion 951*f* is arranged to accommodate the convex portion 955*c* at the connecting position when the main body side joint 951 and the hose side joint 952 are connected to each other. Further, each accommodating portion 951*f* is arranged to restrict the convex portion 955*c* from moving from the connecting position when the main body side joint 951 and the hose side joint 952 are connected. The accommodating portion 951*f* is an example of a movement restricting portion according to a preferred embodiment of the present invention.

Figure 48:
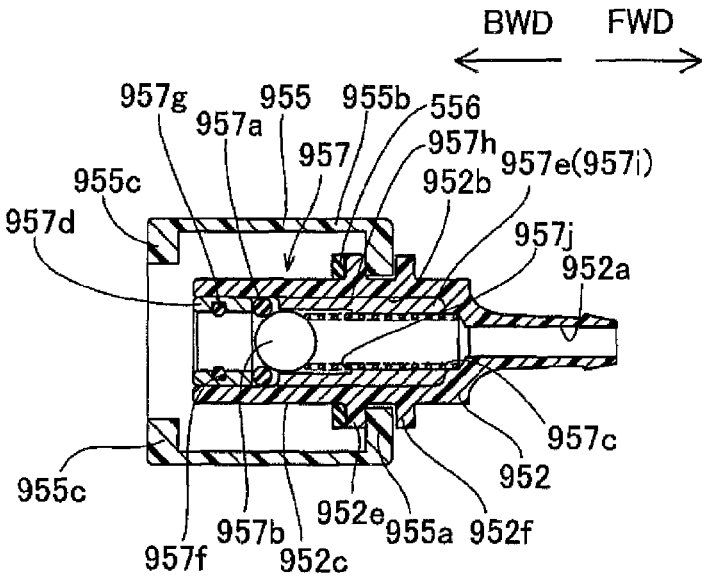
FIG. 48 is a sectional view for describing a structure of a hose side joint of the fuel supply system for an outboard motor of the eighth preferred embodiment of the present invention.

Also, as shown in FIG. 48, the hose side joint 952 is made of, for example, a resin. Inside the hose side joint 952, a passage portion 952*a* arranged to extend in the front-rear direction is provided. Also, on the arrow BWD direction side of the passage portion 952*a*, an opening 952*b* with a diameter larger than that of the passage portion 952*a* is provided. The opening 952*b* is arranged to extend in the front-rear direction similar to the passage portion 952*a*.

Also, as shown in FIG. 48, on the outer peripheral surface 952*c* of the hose side joint 952, a pair of flange portions 952*e* and 952*f* are provided. The pair of flange portions 952*e* and 952*f* have disk shapes, respectively. The pair of flange portions 952*e* and 952*f* are arranged on the arrow FWD direction side of the outer peripheral surface 952*c* of the hose side joint 952. The pair of flange portions 952*e* and 952*f* are opposed to each other via a predetermined space in the front-rear direction. Between the pair of flange portions 952*e* and 952*f*, an annular groove arranged to extend in the circumferential direction of the outer peripheral surface 952*c* is provided. The annular groove is an example of an annular groove according to a preferred embodiment of the present invention. Also, two surfaces opposed to each other of the pair of flange portions 952*e* and 952*f* are an example of a pair of inner wall surfaces according to a preferred embodiment of the present invention.

The pair of flange portions 952*e* and 952*f* are arranged to hold a protruding portion 955*a* of the joint cover 955 rotatably. In detail, between the pair of flange portions 952*e* and 952*f*, the protruding portion 955*a* of the joint cover 955 is fitted. The joint cover 955 is an example of a cover member and a connecting member according to a preferred embodiment of the present invention. The flange portion 952*e* is arranged to come into contact with a surface on the arrow BWD direction side of the protruding portion 955*a*. Further, the flange portion 952*e* is arranged to be pressed in the arrow BWD direction by the protruding portion 955*a* when the hose side joint 952 is moved in a direction (arrow BWD direction) of connection to the main body side joint 951. Also, the flange portion 952*f* is arranged to come into contact with a surface on the arrow FWD direction side of the protruding portion 955*a*. Further, the flange portion 952*f* is arranged to be pressed in the arrow FWD direction by the protruding portion 955*a* when the hose side joint 952 is moved in a direction (arrow FWD direction) (direction of separating) opposite to the direction of connection to the main body side joint 951.

Also, the joint cover 955 is made of, for example, a resin. The joint cover 955 includes the protruding portion 955*a*, a cylindrical cover portion 955*b*, and a pair of convex portions 955*c* provided on the inner peripheral surface of an end portion on the arrow BWD direction side of the cover portion 955*b*. As shown in FIG. 49, the pair of convex portions 955*c* of the joint cover 955 are arranged to be engageable with a pair of guide surfaces 951*d* of the outer peripheral portion 951*c* of the main body side joint 951. Also, the pair of convex portions 955*c* are arranged at an interval of approximately 180 degrees around the central axis of the cover portion 955*b*.

When the main body side joint 951 and the hose side joint 952 are connected, on the main body side joint 951 and the hose side joint 952, forces in directions of separating from each other are generated due to reaction forces of the spring members 553*d* and 957*c* and the damper 556. Each convex portion 955*c* is accommodated in the accommodating portion 951*f* positioned on the arrow FWD direction side of the mountain portion 951*e* (see FIG. 50) by the separating forces.

Also, as shown in FIG. 48, in the opening 952*b* of the hose side joint 952, a valve unit 957 is provided. The valve unit 957 is an example of a second valve according to a preferred embodiment of the present invention. The valve unit 957 includes an O-ring 957*a*, a spherical member 957*b*, and a spring member 957*c*. The O-ring 957*a* is arranged along the opening 952*b* (inner peripheral surface) of the hose side joint 952. The O-ring 957*a* extends in the circumferential direction of the opening 952*b*. The spherical member 957*b* is arranged to be capable of coming into linear contact with the O-ring 957*a* across the entire circumference of the O-ring 957*a*. Also, the spherical member 957*b* is urged to the O-ring 957*a* by the spring member 957*c*.

As shown in FIG. 48, the O-ring 957*a* is held between the opening side sleeve 957*d* and the hose side sleeve 957*e*. The opening side sleeve 957*d* is fitted in the inner periphery of the opening 952*b*. The opening sleeve 957*d* is arranged to allow the small-diameter portion 553*f* of the case member 553*a* to be inserted therein. On an inner peripheral portion of the opening side sleeve 957*d*, a groove portion 957*f* arranged to extend in the circumferential direction of the opening side sleeve 957*d* is provided. Inside the groove portion 957*f*, an O-ring 957*g* is arranged. The O-ring 957*g* is an example of a sealing member and a first seal according to a preferred embodiment of the present invention. The O-ring 957*g* is arranged to seal a gap between the inner peripheral surface of the opening side sleeve 957*d* and the outer peripheral surface of the small-diameter portion 553*f*.

Also, the hose side sleeve 957*e* has a large-diameter portion 957*h* and a small-diameter portion 957*i*. The large-diameter portion 957*h* is arranged on the arrow BWD direction side of the small-diameter portion 557*g*. The outer diameter of the large-diameter portion 957*h* and the outer diameter of the small-diameter portion 957*i* are substantially equal to each other. Also, the inner diameter of the large-diameter portion 957*h* is larger than the inner diameter of the small-diameter portion 957*i*. Between the inner peripheral surface of the large-diameter portion 957*h* and the inner peripheral surface of the small-diameter portion 957*i*, a step portion 957*j* is provided.

Other structures of the eighth preferred embodiment are the same as those of the fourth to seventh preferred embodiments described above.

Figure 53:
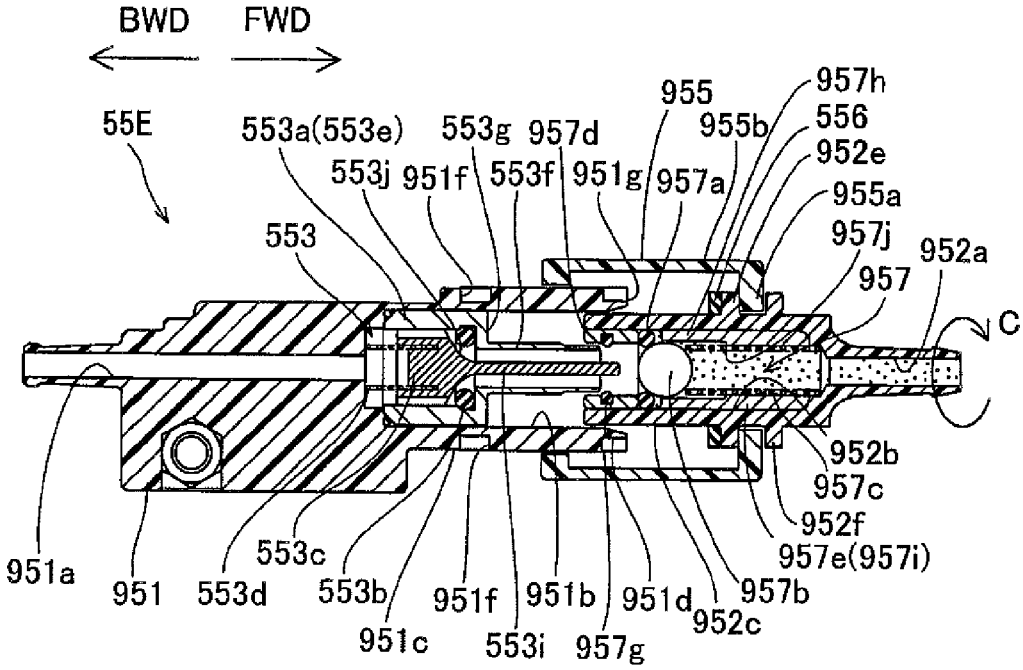
FIG. 53 is a view for describing operations of valve units when the main body side joint and the hose side joint are connected with the fuel supply system for an outboard motor of the eighth preferred embodiment of the present invention.
Figure 54:
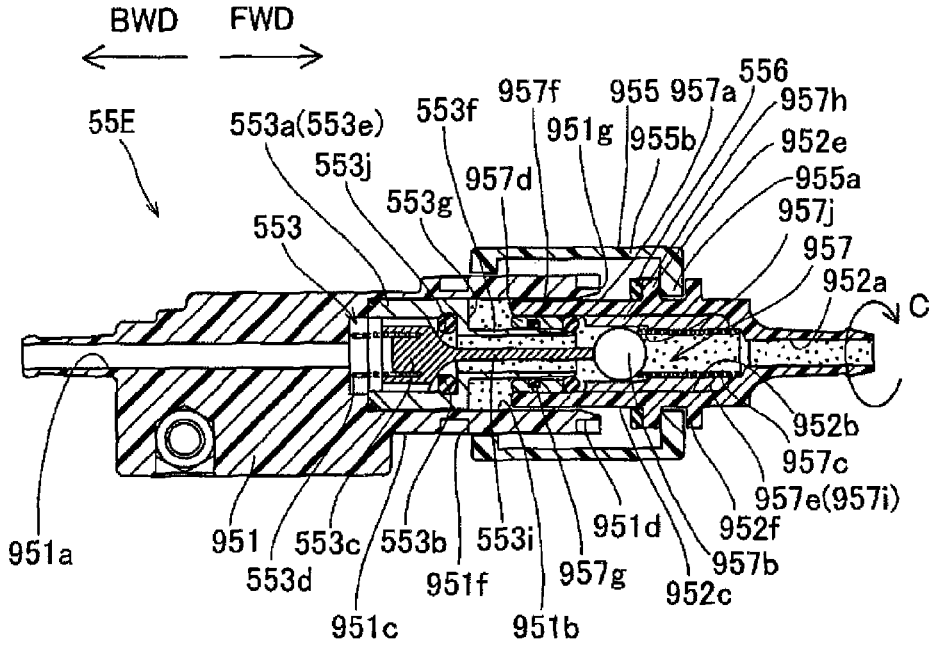
FIG. 54 is a view for describing operations of the valve units when the main body side joint and the hose side joint are connected with the fuel supply system for an outboard motor of the eighth preferred embodiment of the present invention.
Figure 55:
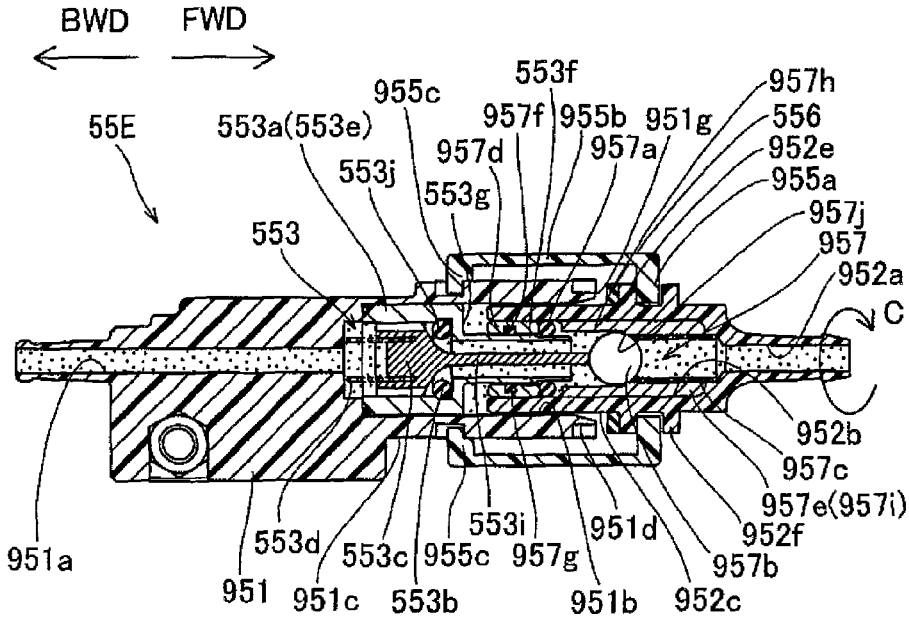
FIG. 55 is a view for describing operations of the valve units when the main body side joint and the hose side joint are connected with the fuel supply system for an outboard motor of the eighth preferred embodiment of the present invention.

FIG. 53 to FIG. 55 are views for describing operations of the valve units when the main body side joint and the hose side joint are connected with the fuel supply system for an outboard motor of the eighth preferred embodiment of the present invention. Next, with reference to FIG. 49 to FIG. 51 and FIG. 53 to FIG. 55, operations of the valve units 553 and 957 when the main body side joint 951 and the hose side joint 952 are connected with the fuel supply system for an outboard motor of the eighth preferred embodiment of the present invention will be described.

First, as shown in FIG. 53, the pair of convex portions 955*c* of the joint cover 955 are engaged with the pair of guide surfaces 951*d* of the main body side joint 951, respectively. Then, the joint cover 955 is rotated in the direction C. Accordingly, as shown in FIG. 50 and FIG. 51, the convex portions 955*c* of the joint cover 955 move along the guide surfaces 951*d* of the main body side joint 951. Also, along with the movements of the convex portions 955*c*, the main body side joint 951 and the hose side joint 952 are moved in directions of connection relative to each other.

Thereafter, when the joint cover 955 is further rotated in the direction C, as shown in FIG. 53, the small-diameter portion 553*f* of the case member 553*a* of the valve unit 553 comes into contact with the O-ring 957*g* held on the inner peripheral portion of the opening side sleeve 957*d*. As a result, a gap between the inner peripheral surface of the opening side sleeve 957*d* and the outer peripheral surface of the small-diameter portion 553*f* is sealed.

Then, as shown in FIG. 54, when the joint cover 955 is further rotated in the direction C, the tip end portion of the projecting portion 553*i* and the spherical member 957*b* come into contact with each other. Further, the spherical member 957*b* is pressed to the arrow FWD direction side by the tip end portion of the projecting portion 553*i*. Accordingly, the spherical member 957*b* moves to the arrow FWD direction side against an urging force of the spring member 957*c*. Therefore, a gap is generated between the spherical member 957*b* and the O-ring 957*a*. As a result, the valve unit 957 of the hose side joint 952 is opened. Therefore, as shown in FIG. 54, the fuel flows into the opening 951*b* of the main body side joint 951. At this time, a gap between the inner peripheral surface of the opening side sleeve 957*d* and the outer peripheral surface of the small-diameter portion 553*f* is sealed by the O-ring 957*g*, such that the fuel which flew into the opening 951*b* does not substantially flow out to the outside.

Thereafter, as shown in FIG. 55, when the joint cover 955 is further rotated in the direction C, the spherical member 957*b* comes into contact with the step portion 957*j* of the hose side sleeve 957*e*. As a result, the valve member 553*c* of the valve unit 553 moves in the arrow BWD direction against the urging force of the spring member 553*d*. Accordingly, a gap is generated between the O-ring 553*b* and the connecting portion 553*j* of the valve member 553*c*. Therefore, the fuel is made to flow into the passage portion 951*a*.

Then, when the joint cover 955 is further rotated in the direction C, as shown in FIG. 50 and FIG. 51, each convex portion 955*c* of the joint cover 955 reaches the mountain portion 951*e* of the corresponding guide surface 951*d*. At this time, as shown in FIG. 49, the damper 556 is sandwiched by the surface on the arrow BWD direction side of the flange portion 952*e* and the tip end portion 951*g* of the main body side joint 951. Accordingly, the damper 556 is compressed. Therefore, an elastic force is generated on the damper 556. The elastic force of the damper 556 presses the surface on the arrow BWD direction side of the flange portion 952*e* and the tip end portion 951*g* of the main body side joint 951 in directions of separating from each other. Accordingly, the hose side joint 952 and the main body side joint 951 are urged in directions of separating from each other.

Thereafter, when the joint cover 955 is further rotated in the direction C, as shown in FIG. 50 and FIG. 51, the convex portions 955*c* of the joint cover 955 move over the mountain portions 951*e* of the guide surfaces 951*d* and are accommodated in the accommodating portions 951*f*. Also, at this time, the valve member 553*c* (projecting portion 553*i*) of the valve unit 553 and the spherical member 957*b* of the valve unit 957 press each other by the urging forces of the spring members 553*d* and 557*c*. Therefore, it is difficult for the convex portions 955*c* to separate from the accommodating portions 951*f*. Further, the hose side joint 952 and the main body side joint 951 are urged in directions of separating from each other by the damper 556. Therefore, the convex portions 955*c* are urged to the accommodating portions 951*f*. Therefore, it is more difficult for the convex portions 955*c* to separate from the accommodating portions 951*f*. Accordingly, the main body side joint 951 and the hose side joint 952 are connected to each other.

Other effects of the eighth preferred embodiment are the same as those of the fourth to seventh preferred embodiments described above.

Preferred embodiments of the present invention are described above, and the present invention is not limited to the contents of the preferred embodiments described above, but can be variously modified within the scope of the claims. For example, in the first to third preferred embodiments, an example in which an O-ring is arranged in the vicinity of the tip end portion of the hose side joint is shown. However, the O-ring may be arranged at a position other than the vicinity of the tip end portion of the main body side joint as long as valve units of the main body side joint and the hose side joint are at positions which are before they come into contact with each other when the main body side joint and the hose side joint are connected to each other.

Also, in the first to third preferred embodiments, an example in which the valve unit of the hose side joint is arranged to open earlier when the hose side joint and the main body side joint are connected to each other, is shown. However, the valve unit of the main body side joint may be arranged to open earlier. Alternately, the valve unit of the main body side joint and the valve unit of the hose side joint may be arranged to open simultaneously.

Also, in the first to third preferred embodiments, an example in which a mechanical valve unit is used as the valve unit of the main body side joint and the valve unit of the hose side joint is shown. However, a valve unit which is electrically controllable such as a solenoid valve can be used as one or both of the valve unit of the main body side joint and the valve unit of the hose side joint.

Figure 56:
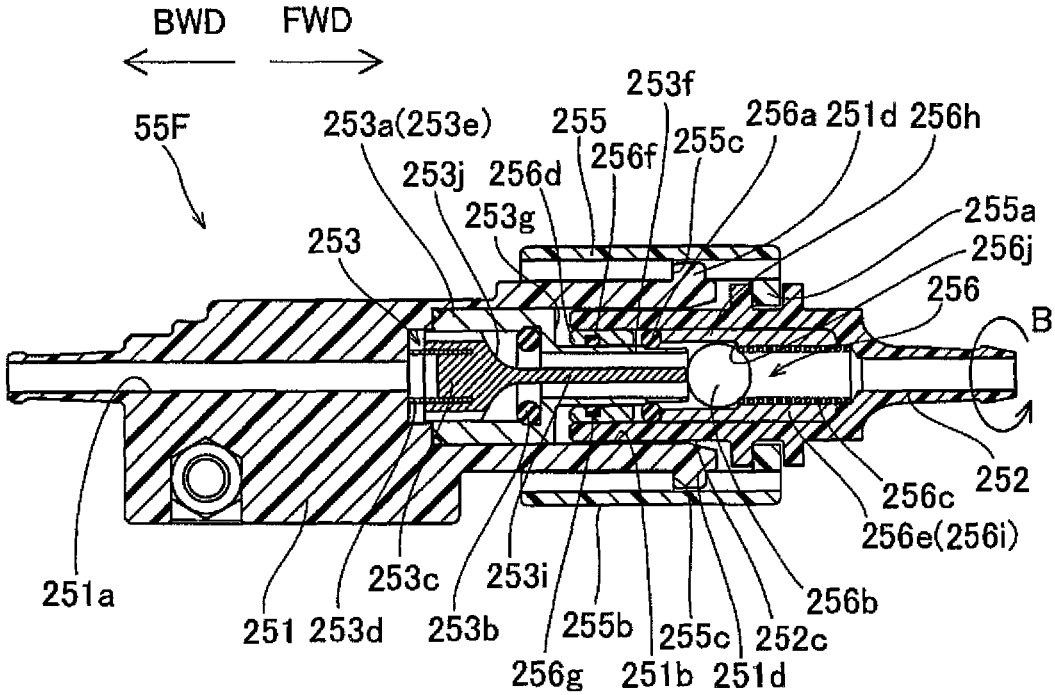
FIG. 56 is a view for describing an arrangement of a joint unit and a joint cover of a fuel supply system for an outboard motor of an exemplary variation of the first to third preferred embodiments of the present invention.

Also, in the first to third preferred embodiments, an example in which two O-rings (O-rings 256*f* and 254) arranged to seal between the main body side joint and the hose side joint are provided is shown. However, the number of O-rings arranged to seal between the main body side joint and the hose side joint may be one. In detail, for example, like the joint unit 55F shown in FIG. 56, only an O-ring 256*f* which seals a gap between the outer peripheral surface of the small-diameter portion 253*f* of the case member 253*a* and the inner peripheral surface of the opening side sleeve 256*d* may be provided. In other words, it is possible that only the O-ring 256*f* is provided, and the O-ring 254 which seals a gap between the inner peripheral surface of the opening 251*b* of the main body side joint 251 and the outer peripheral surface 252*c* of the hose side joint 252 is not provided. In this case, as compared with the case in which only the O-ring 254 is provided, the amount of fuel to be held inside the joint unit 55F can be reduced. Therefore, when the main body side joint 251 and the hose side joint 252 are disconnected from each other, the fuel can be prevented from spilling out from the joint unit 55F.

Also, in the fourth to eighth preferred embodiments, an example in which either of a pair of convex portions or guide surfaces are provided on the main body side joint and the other of the pair of convex portions or guide surfaces are provided on the joint cover is shown. However, a convex portion and a guide surface may be provided on the main body side joint and the joint cover, respectively. Alternatively, three or more convex portions and guide surfaces may be provided on the main body side joint and the joint cover, respectively.

Also, in the fourth to eighth preferred embodiments, an example in which the main body side joint and the hose side joint are arranged to be connected by rotating the joint cover by approximately 170 degrees is shown. However, the main body side joint and the hose side joint may be arranged to be connected by rotating the joint cover by an angle smaller than approximately 170 degrees. Alternatively, the main body side joint and the hose side joint may be arranged to be connected by rotating the joint cover by, for example, a half rotation and one rotation or more, larger than approximately 170 degrees.

Also, in the fourth to eighth preferred embodiments, an example in which a damper made of rubber is provided is shown. However, for example, an elastic member such as a compression coil spring or an O-ring other than the rubber-made damper is also applicable.

Also, in the fifth and seventh preferred embodiments, an example in which only one flange portion on which the protruding portion of the joint cover is arranged in the hose side joint is provided is shown. However, a pair of flange portions may be provided on the hose side joint to sandwich the protruding portion of the joint cover.

Also, in the fourth to sixth preferred embodiments, an example in which the present invention is applied to the main body side joint and the hose side joint which connect the outboard motor main body and the hose as an example of a joint unit according to a preferred embodiment of the present invention, is shown. However, for example, the present invention may also be applied to the tank side joint and the hose side joint which connect the fuel tank and the hose. In other words, the present invention is applicable to a joint unit other than the joint unit which connects the outboard motor main body and the hose.

Figure 57:
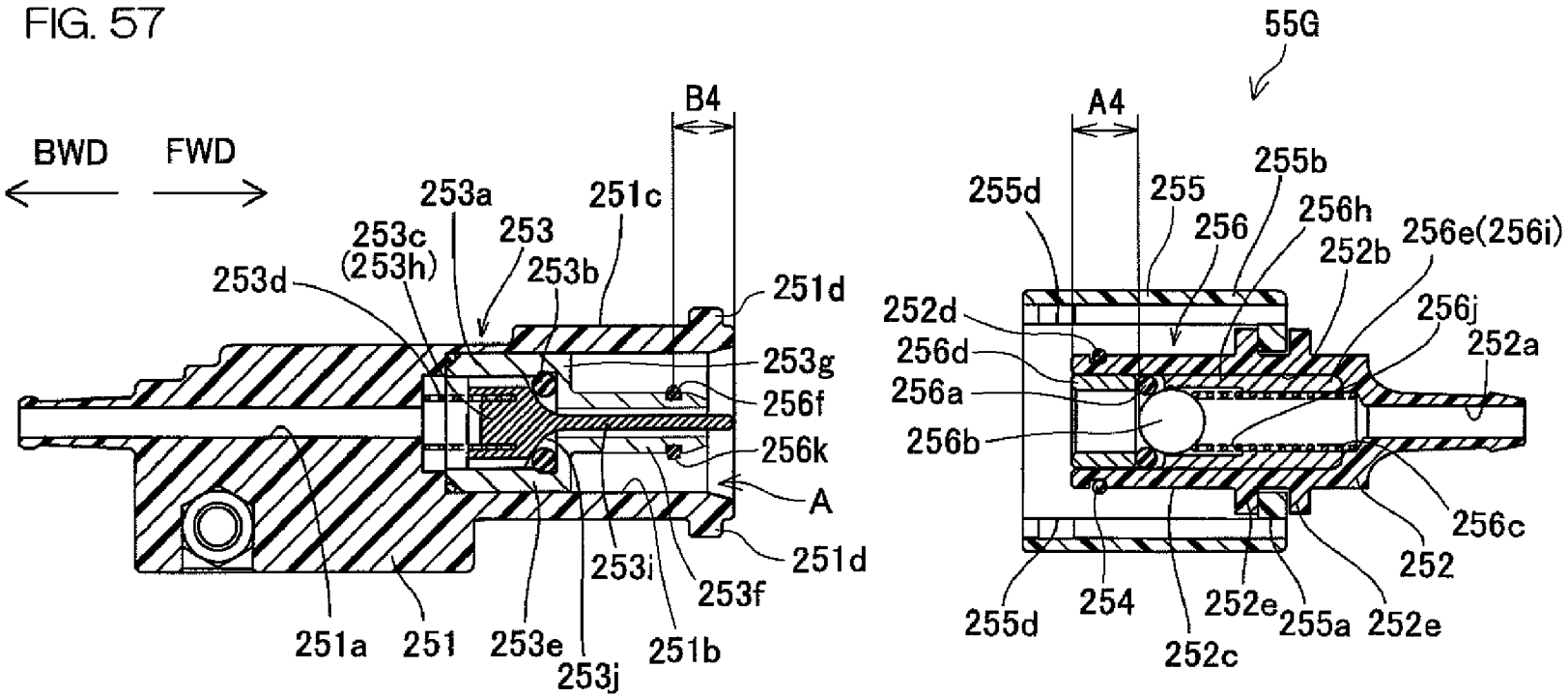
FIG. 57 is a view for describing an arrangement of the joint unit and the joint cover of the fuel supply system for an outboard motor of the exemplary variation of the first to third preferred embodiments of the present invention.

Also, in the first to eighth preferred embodiments, an example in which the O-ring arranged to seal a gap between the main body side joint and the hose side joint is held on the hose side joint is shown. However, the O-ring may be held on the main body side joint. In detail, for example, like the joint unit 55G shown in FIG. 57, the O-ring 256*f* may be arranged in a groove portion 256*k* provided on the outer peripheral portion of the small-diameter portion 253*f* of the case member 253*a*. Also, in this case, the O-ring 256*f* is preferably arranged at a position which is before the two valve units 253 and 256 come into contact with each other when the main body side joint 251 and the hose side joint 252 are connected. In further detail, as shown in FIG. 57, a third distance B4 is a distance in the front-rear direction from the tip end portion of the projecting portion 253*i* to the O-ring 256*f*. The third distance B4 is defined as positive when the O-ring 256*f* is positioned closer to the hose side joint 252 than the tip end portion of the projecting portion 253*i*. Further, as shown in FIG. 57, a fourth distance A4 is a distance in the front-rear direction from the tip end of the spherical member 256*b* to a tip end portion of the opening side sleeve 256*d*. The fourth distance A4 is defined as negative when the tip end portion of the opening side sleeve 256*d* is positioned closer to the main body side joint 251 than the tip end of the spherical member 256*b*. The joint unit 55G is arranged such that the first distance B4 becomes greater than the fourth distance A4 (A4<0, B4<0, and B4>A4).

Also, in the first to eighth preferred embodiments, an example in which a valve member having a needle shape is used as a first valve body is shown. Further, an example in which a spherical member is used as a second valve body is shown. However, the first valve body may have a shape other than the needle shape. Similarly, the second valve body may have a shape other than the spherical shape.

The present application corresponds to Japanese Patent Application No. 2008-238885 and Japanese Patent Application No. 2008-246809 filed on Sep. 18, 2008 and Sep. 25, 2008, respectively, to the Japan Patent Office, and whole disclosures of these applications are incorporated in its entirety herein by reference.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A fuel supply system for an outboard motor, arranged to supply fuel into an outboard motor main body from a fuel tank, comprising:

a fuel supply channel; and a joint unit arranged to join the fuel supply channel to the fuel tank or the outboard motor main body; wherein the joint unit includes first and second joint members arranged to be connectable to and separable from each other, and a sealing member arranged to seal a gap between the first and second joint members;

the first joint member includes a first flow channel arranged to allow fuel to flow therethrough, a first valve arranged in the first flow channel, and a tubular first fitting portion arranged to surround the first flow channel;

the second joint member includes a second flow channel arranged to allow fuel to flow therethrough, a second valve arranged in the second flow channel, and a tubular second fitting portion arranged to surround the second flow channel;

the first valve has a first pressing end arranged to be pressed by the second joint member when the first and second joint members are connected in a predetermined coupling direction, and includes a first valve body arranged to be displaced when the first pressing end is pressed;

the second valve has a second pressing end arranged to be pressed by the first joint member when the first and second joint members are connected in the coupling direction, and includes a second valve body arranged to be displaced when the second pressing end is pressed;

the first and second tubular fitting portions are arranged to fit each other before the first and second pressing ends come into contact with the second and first joint members, respectively, when the first and second joint members are connected; and the sealing member is held on the first or second joint member so as to seal a gap between the first and second tubular fitting portions before the first and second pressing ends come into contact with the second and first joint members, respectively, when the first and second joint members are connected.

2. The fuel supply system for an outboard motor according to claim 1, wherein the sealing member is held on the second fitting portion; and a first distance in the coupling direction from the first pressing end to a tip end of the first fitting portion is greater than a second distance in the coupling direction from the second pressing end to the sealing member, the first distance being defined as positive when the tip end of the first fitting portion is positioned closer to the second joint member than is the first pressing end, the second distance being defined as negative when the sealing member is positioned closer to the first joint member than is the second pressing end.

3. The fuel supply system for an outboard motor according to claim 1, wherein the sealing member is held on the first fitting portion; and a first distance in the coupling direction from the first pressing end to the sealing member is greater than a second distance in the coupling direction from the second pressing end to a tip end of the second fitting portion, the first distance being defined as positive when the sealing member is positioned closer to the second joint member than is the first pressing end, the second distance being defined as negative when the tip end of the second fitting portion is positioned closer to the first joint member than is the second pressing end.

4. The fuel supply system for an outboard motor according to claim 1, wherein the first fitting portion includes a tubular inner fitting portion arranged to surround the first flow channel and, a tubular outer fitting portion arranged to surround a periphery of the inner fitting portion;

respective first ends of the inner fitting portion and the outer fitting portion are arranged to allow the second fitting portion to be fitted therebetween from the second joint member side;

respective second ends of the inner fitting portion and the outer fitting portion are arranged to be hermetically sealed to each other; and the sealing member includes a first seal arranged to seal a gap between the inner fitting portion and the second fitting portion.

5. The fuel supply system for an outboard motor according to claim 4, wherein the sealing member further includes a second seal arranged to seal a gap between the outer fitting portion and the second fitting portion.

6. The fuel supply system for an outboard motor according to claim 1, wherein the first fitting portion includes a tubular inner fitting portion arranged to surround the first flow channel and, a tubular outer fitting portion arranged to surround a periphery of the inner fitting portion;

respective first ends of the inner fitting portion and the outer fitting portion are arranged to allow the second fitting portion to be fitted therebetween from the second joint member side;

respective second ends of the inner fitting portion and the outer fitting portion are arranged to be hermetically sealed to each other; and the sealing member includes a seal arranged to seal a gap between the outer fitting portion and the second fitting portion.

7. The fuel supply system for an outboard motor according to claim 1, wherein the joint unit further includes a tubular cover member which is attached to the second joint member and arranged to surround a periphery of the second joint member; and the sealing member is held on an outer peripheral portion of the second joint member inside the cover member.

8. The fuel supply system for an outboard motor according to claim 1, wherein the joint unit further includes a tubular connecting member arranged to surround a periphery of the first joint member in a state in which the first and second joint members are connected, a convex portion provided on one of an outer peripheral portion of the first joint member and an inner peripheral portion of the connecting member, and a concave portion provided on the other of the outer peripheral portion of the first joint member and the inner peripheral portion of the connecting member, the convex portion and the concave portion are arranged to be engageable with each other and rotatable relative to each other while engaging with each other, the concave portion is arranged to guide the convex portion to a predetermined connecting position along the concave portion along with relative rotations of the convex portion and the concave portion in one of the rotation directions, the second joint member and the connecting member are arranged to move integrally to the first joint member side when the convex portion is guided toward the connecting position, and the first and second joint members are arranged to be connected to each other when the convex portion is arranged at the connecting position.

9. The fuel supply system for an outboard motor according to claim 8, wherein the concave portion is arranged such that the convex portion is arranged at the connecting position according to relative rotations by an angle less than one rotation of the convex portion and the concave portion.

10. The fuel supply system for an outboard motor according to claim 8, wherein the concave portion includes a guide surface arranged to extend so as to incline with respect to the coupling direction.

11. The fuel supply system for an outboard motor according to claim 8, wherein the joint unit further includes a movement restricting portion which is provided on one of the outer peripheral portion of the first joint member and the inner peripheral portion of the connecting member together with the concave portion, and arranged to restrict the convex portion from moving from the connecting position.

12. The fuel supply system for an outboard motor according to claim 8, wherein the concave portion includes a guide groove arranged to extend so as to incline with respect to the coupling direction.

13. The fuel supply system for an outboard motor according to claim 8, wherein the second joint member further includes an annular groove which is provided on the outer peripheral portion of the second joint member, and arranged to surround the outer peripheral portion of the second joint member, the connecting member includes a tubular portion arranged to surround the second joint member and an engagement protruding portion arranged to protrude inward from the tubular portion, the annular groove includes a pair of inner wall surfaces opposed to each other via a space in the coupling direction, the engagement protruding portion is arranged between the pair of inner wall surfaces, and the connecting member is arranged to move to the first joint member side when the convex portion is guided toward the connecting position by the concave portion.

14. The fuel supply system for an outboard motor according to claim 1, wherein one of the first and second joint members is joined to the fuel tank or the outboard motor main body, and the other of the first and second joint members is joined to the fuel supply channel.

15. An outboard motor comprising:

a fuel tank;

an outboard motor main body; and a fuel supply system arranged to supply fuel to the outboard motor main body from the fuel tank; wherein the fuel supply system includes a fuel supply channel and a joint unit arranged to join the fuel supply channel to the fuel tank or the outboard motor main body;

the joint unit includes first and second joint members arranged to be connectable to and separable from each other and a sealing member arranged to seal a gap between the first and second joint members;

the first joint member includes a first flow channel arranged to allow fuel to flow therethrough, a first valve arranged in the first flow channel, and a tubular first fitting portion arranged to surround the first flow channel;

the second joint member includes a second flow channel arranged to allow a fuel to flow therethrough, a second valve arranged in the second flow channel, and a tubular second fitting portion arranged to surround the second flow channel;

the first valve has a first pressing end to be pressed by the second joint member when the first and second joint members are connected in a predetermined coupling direction, and includes a first valve body arranged to be displaced when the first pressing end is pressed;

the second valve has a second pressing end to be pressed by the first joint member when the first and second joint members are connected in the coupling direction, and includes a second valve body arranged to be displaced when the second pressing end is pressed;

the first and second fitting portions are arranged to fit each other before the first and second pressing ends come into contact with the second and first joint members, respectively, when the first and second joint members are connected; and the sealing member is held on the first or second joint member so as to seal a gap between the first and second fitting portions before the first and second pressing ends come into contact with the second and first joint members, respectively, when the first and second joint members are connected.

* * * * *